US008954190B2

(12) United States Patent
Braunstein

(10) Patent No.: US 8,954,190 B2
(45) Date of Patent: Feb. 10, 2015

(54) OPTIMIZATION OF PHARMACY OPERATIONS USING AUTOMATIC DISTRIBUTED VENDING SYSTEM

(76) Inventor: Zachary Leonid Braunstein, San Marcos, CA (US)

( * ) Notice: Subject to any disclaimer, the term of this patent is extended or adjusted under 35 U.S.C. 154(b) by 269 days.

(21) Appl. No.: 13/335,954

(22) Filed: Dec. 23, 2011

(65) Prior Publication Data

US 2013/0092700 A1 Apr. 18, 2013

Related U.S. Application Data

(60) Provisional application No. 61/514,014, filed on Aug. 1, 2011.

(51) Int. Cl.

| | |
|---|---|
| ***G07F 17/00*** | (2006.01) |
| ***G07F 9/00*** | (2006.01) |
| ***G07F 9/02*** | (2006.01) |

(52) U.S. Cl.

CPC ..... *G07F 9/006* (2013.01); *G07F 9/026* (2013.01); *G07F 17/0092* (2013.01)

USPC ..... 700/242; 700/236; 221/197

(58) Field of Classification Search

CPC ..... G07F 17/0092; G07F 11/46; G07F 11/04; G07F 11/10; A61J 1/03; A61J 7/0076; A61J 7/0084

USPC ..... 221/186, 197, 287; 700/231, 236, 242

See application file for complete search history.

(56) References Cited

U.S. PATENT DOCUMENTS

| | | | | |
|---|---|---|---|---|
| 6,814,256 | B2 * | 11/2004 | Clark | 221/79 |
| 7,366,586 | B2 * | 4/2008 | Kaplan et al. | 700/241 |
| 7,689,318 | B2 * | 3/2010 | Draper | 700/236 |
| 7,886,931 | B2 * | 2/2011 | Handfield et al. | 221/154 |
| 8,521,327 | B2 * | 8/2013 | Pinney et al. | 700/242 |

* cited by examiner

*Primary Examiner* — Timothy Waggoner

(57) ABSTRACT

Invention describes apparatus automating pharmacy operations. Apparatus includes portable vending cartridges, cartridge transport components, automatic vending modules, controllers. Cartridge contains conveyor transporting containers with medications secured inside carriers. Cartridges slide-into receptacles inside vending module. Controllers monitor in real-time presence of cartridges, inventory of carries and containers with medications, and execute controls, including: indexing conveyors; loading and/or unloading medications in/from carriers; maintaining medications within specifications—environment, handling, safety with reports confirming compliance. Controllers execute in real-time optimization algorithm to achieve required performance: rates of medications loading/unloading, power consumption. Apparatus supports centralized and on-site processing of prescription medications with centralized distributed deliveries of medications inside portable cartridges to vending modules located at pharmacies, stand-alone kiosks, customer homes. Apparatuses supports configuration as closed-loop real-time process control system allowing optimum utilization of pharmacy resources for centralized and onsite processing of prescription medications within specifications. Controller maintains all medications inside apparatus within specification requirements.

18 Claims, 62 Drawing Sheets

OPTIMIZATION OF PHARMACY OPERATIONS USING AUTOMATIC DISTRIBUTED VENDING SYSTEM

CROSS-REFERENCE TO RELATED APPLICATIONS

Figure 1:
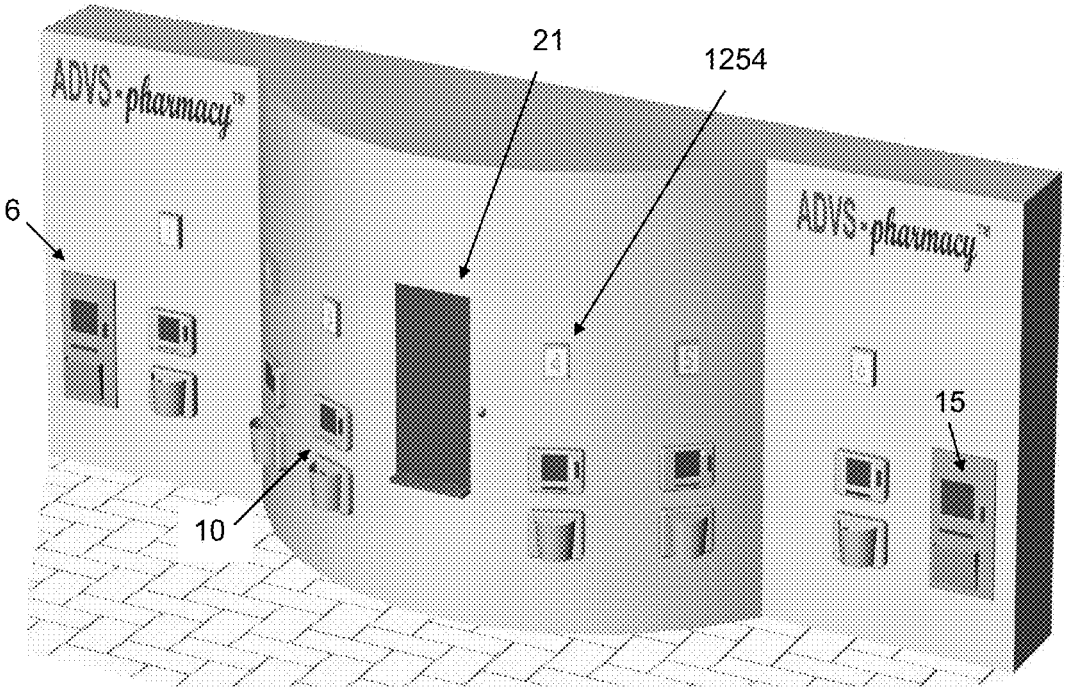

I claim the benefits of Provisional Application No. 61/514,014 filed on Aug. 1, 2011, title "Optimization of Pharmacy Operations using Automatic Distributed Vending System".

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The existing operation of pharmacies is inadequate, and as result, pharmacies struggle to meet requirements in respect to: quality of medication, quality of services, safety of raw materials and medications, security of customers sensitive data, etc. These problems are known and documented, including media reports, etc. ADVSP, described in this application, provides ultimate comprehensive cost-effective solutions which solve majority of problems at pharmacies, by providing automation technology which will automate and optimize operations of pharmacies, including: stand-alone pharmacy, or a chain of pharmacies. The application will explain in details essential features of the ADVSP, including:

a) Construction details of the flexible conveyor belt
b) Configurations of carrier conveyors with multi-track synchronized transportation of carriers
c) Configurations of portable vending cartridges with motorized and non-motorized carrier conveyors
d) Designs of automatic vending modules configured to accept variety of portable vending cartridges
e) Variety of item loading and item dispensing methods available for automatic vending modules
f) Process controls inside automatic vending module
g) Environmental controls with automatic dispensing of medications stored at refrigeration temperatures ADVSP objective is to ensure only quality medications, which were maintained within their respective specifications at all times, are dispensed to authorized customers, with practically no need to stay in-line.

BRIEF SUMMARY OF THE INVENTION

My designs of Automatic Distributed Vending System optimizing Pharmacy operations (ADVSP) provide outstanding features in processing prescription medications, allowing the provider to maintain competitive pricing while ensuring only quality medications are dispensed to authorized customers without a need to stay in-line. The entire processing of prescription medications, from the point of product manufacturing at one location to the point of product sale at another location, can be effectively automated using ADVSP. Throughout all processes, ADVSP components, including intelligent devices such as Controllers and Computers, will ensure reliable and safe coordinated effort by respective ADVSP components in executing control algorithm defined by the user as ADVSP Configuration Parameters. ADVSP can be configured to optimize operations of pharmacies as a part of a franchise of pharmacies, as well as stand-alone independent pharmacies. Depending on size of the operations, ADVSP can be configured to support: centralized processing of prescription medications and the follow-up distribution of processed medications to designated dispense locations, such as: pharmacies, stand-alone kiosks, portable kiosks; on-site processing of prescription medications and the follow-up dispensing to authorized customers via automated vending modules; or combination of centralized and on-site processing. ADVSP will allow pharmacies, via stand-alone automatic vending kiosks, to establish un-attended 24-hours dispensing of medications to authorized Customers at designated locations, including: pharmacies, grocery stores, medical facilities, care providing facilities, patient homes. Throughout all process steps, ADVSP controllers monitor status of medications, and ensure that only medications with 100% compliance to respective specifications are made available to Customers.

BRIEF DESCRIPTION

Drawing Content and Listing

List of all figures is presented in the Table 1, below.

TABLE 1

List of FIGS.

| FIG. | Description |
|---|---|
| 1 | 3-D view of ADVS-pharmacy (ADVSP) layout example |
| 2 | 3-D view of the components of the ADVS-pharmacy (ADVSP) layout example |
| 3 | 3-D view - conveyor belt with inserted bearings |
| 4 | 3-D view - conveyor belt with molded bearings |
| 5 | 3-D view - conveyor belt with inserted bearings construction details |
| 6 | 3-D view - conveyor belt with molded bearings construction details |
| 7 | 3-D view - conveyor belt with molded bearings and embedded perimeter rollers |
| 8 | 3-D view - conveyor belt with molded bearings and index holes |
| 9 | Z-X view - Portable Vending Cartridge (PVC), carrier conveyor horizontal layout inside |
| 10 | Z-X view - Automatic Vending Module (AVM) with 2 PVC horizontal layout inside |
| 11 | X-Y view - PVC with motorized carrier conveyor horizontal layout dual belt single track |
| 12 | Z-Y view - PVC with thermo-insulated motorized carrier conveyor layout dual belt single track |
| 13 | Z-X view - PVC with motorized carrier conveyor horizontal layout inside |
| 14 | Z-X view - PVC with non-motorized carrier conveyor horizontal layout inside |
| 15 | Z-X view - Layout PVC with non-motorized belt conveyor with molded-in carrier support bearings |

TABLE 1-continued

List of FIGS.

| FIG. | Description |
|---|---|
| 16 | Z-X view - Layout belt conveyor with molded-in carrier support bearings |
| 17 | Z-X view - Layout PVC with motorized carrier conveyor horizontal |
| 18 | Z-X view - Layout PVC with thermo-insulated motorized carrier conveyor horizontal |
| 19 | Z-X view - Layout belt conveyor with molded-in carrier support bearing vertical |
| 20 | Z-X view - Layout PVC with non-motorized carrier conveyor vertical |
| 21 | Z-X view - Layout PVC with thermo-insulated motorized carrier conveyor vertical |
| 22 | Z-Y view - Synchronized dual belt dual track conveyor, vertical |
| 23 | Z-Y view - Synchronized dual belt single track conveyor, vertical |
| 24 | Z-Y view - Synchronized dual belt dual track conveyor with support wheel, vertical |
| 25 | Z-X view - Layout belt conveyor with molded-in carrier support bearing horizontal |
| 26 | Z-X view - Layout belt conveyor with inserted carrier support bearing horizontal |
| 27 | Z-X view - Belt conveyor with molded-in carrier support bearing horizontal details |
| 28 | X-Y view - Belt conveyor with inserted Carrier Support Bearing horizontal |
| 29 | X-Y view - Synchronized dual belt dual track conveyor with support wheels, horizontal |
| 30 | Z-Y view - Automatic Vending Module (AVM) with 2 PVC (synchronized single track conveyor) |
| 31 | 3-D view - PVC-40 synchronized dual belt conveyor dual track horizontal, capacity 40 carriers |
| 32 | 3-D view - PVC-40 assembled |
| 33 | 3-D view - AVM-200 Customer side with 5 PVC-40 inside, capacity 200 |
| 34 | 3-D view - AVM-200 Provider side details with 5 PVC-40 inside, capacity 200 |
| 35 | Z-X view - AVM-200 mounting details |
| 36 | Z-X view - AVM-200 item indexing details |
| 37 | Z-X view - AVM-200 item loading and unloading details |
| 38 | 3-D view - AVM with 5 PVC-40 (AVM-200) Provider side |
| 39 | 3-D view - AVM with dual PVC-40 assembly details (AVM-80) |
| 40 | 3-D view - AVM-80 assembled |
| 41 | Z-Y view - PVC-40 based on synchronized dual belt dual track configuration with support wheels |
| 42 | Z-Y view - PVC-20 based on single belt single track configuration with support wheels |
| 43 | Z-Y view - AVM-80 with installed 2 PVC-40 synchronized dual belt dual track with support wheels |
| 44 | Z-Y view - AVM-40 with installed 2 PVC-20 single belt single track with support wheels |
| 45 | Z-Y view - AVM-120 with installed 2 PVC-40 and 2 PVC-20 with support wheels |
| 46 | Z-Y view - AVM-80 empty with PVC guiding channels with embedded rollers |
| 47 | Z-Y and Z-X views of section of AVM-80 with PVC guiding channels with embedded rollers |
| 48 | Z-X view - AVM-200 with five PVC-40 inside |
| 49 | Z-X view - AVM-200 with scales to measure weight of each PVC-40 inside |
| 50 | Z-X view - AVM-200 with common scales to measure combined weight of all PVC-40 inside |
| 51 | 3-D view - Dual pocket carrier with openings in the base |
| 52 | X-Y view - Dual pocket carrier with openings in the base |
| 53 | Z-Y view - PVC-60 with one track single pocket carrier and another track with dual pocket carrier |
| 54 | Z-X view - Single pulley conveyor belt with embedded bearing assemblies |
| 55 | Z-X view - 3-pulley conveyor belt |
| 56 | Z-Y view - AVM-120 with two PVC-60 single and dual pocket carriers |
| 57 | 3-D view - ADVSP-1400 layout based on 7 AVM-200 |
| 58 | 2-D view - ADVSP-1600 layout based on 8 AVM-200 |
| 59 | 3-D view - ADVSP-80 for personal use, customer side, details |
| 60 | 3-D view - ADVSP-80 for personal use, customer side |
| 61 | 2-D view - ADVSP-80 monitoring real-time patient status and dispensing medications |
| 62 | Z-Y view - PVC-40 synchronized dual belt dual track conveyor with environmental controls |
| 63 | Z-Y view - PVC-80 synchronized dual belt dual track with environmental control |
| 64 | Z-Y view - AVM-80 based on two PVC-40 without support wheels, with environmental control |
| 65 | Z-Y view - AVM-200 with two PVC-40 and two PVC-60 with environmental control |
| 66 | 3-D view - Section of a carrier with 2-side split-pocket spring loaded |
| 67 | Z-X view - Section of a carrier with 2-side split-pocket spring loaded |
| 68 | Z-X view - Carrier with 2-side split-pocket spring loaded, item inside |
| 69 | Z-X view - Carrier with 2-side split-pocket spring loaded, item being forced out, pocket sides open |
| 70 | Z-X view - Carrier 2-side split-pocket spring loaded, item inside, larger opening at the base |
| 71 | Z-X view - Carrier 2-side split-pocket spring loaded, item just came out |
| 72 | Z-X view - AVM-200 with five PVC-40 with split-pocket carriers |
| 73 | 3-D view - Single belt, 4 pulleys, single track, stationary conveyor, Z-Y index |
| 74 | 3-D view - Provider side AVM with space for PVC-40 units to be installed inside |
| 75 | 3-D view - Provider side AVM with five PVC-40 installed inside |
| 76 | 3-D view - Customer side AVM with stationary conveyor, five PVC-40 installed, right view |
| 77 | 3-D view - Customer side AVM with stationary conveyor, five PVC-40 installed, left view |
| 78 | Z-X view - PVC-20 with thermal insulation of carriers in support of environmental controls |
| 79 | Example - ADVSP system diagram |
| 80 | Example - ADVSP controller diagram |
| 81 | Example - ADVSP process diagram |
| 82 | Z-X view - AVM-200 with thermal insulation of PVC-40 in support of environmental controls |
| 83 | 3-D view - AVM-200 with thermal insulation of PVC-40 in support of environmental controls |
| 84 | Z-X view - PVC section synchronized dual belt single track conveyor, carriers loaded with items |
| 85 | Z-X view - PVC section and cover plate with attachments to secure items inside carriers |
| 86 | Z-X view - Assembly details of PVC cover plate with attachments to secure items inside carriers |
| 87 | Container cylindrical |
| 88 | Container cylindrical, multiple Items |
| 89 | Container cylindrical, compartmental |
| 90 | Container cylindrical bottle |
| 91 | Container cylindrical with top lid |

TABLE 1-continued

List of FIGS.

| FIG. | Description |
|---|---|
| 92 | Container rectangular |
| 93 | Carrier insert for rectangular Item |
| 94 | Carrier with insert - loading Item |
| 95 | Carrier with insert - loaded with Item |
| 96 | Carrier insert for cylindrical Item |
| 97 | Item inside carrier insert for cylindrical Item |
| 98 | Carrier configuration details-1 |
| 99 | Carrier configuration details-2 |
| 100 | 3-D view - Loading items into AVM |
| 101 | Z-X view - Loading items into AVM |
| 102 | Carrier with removable plate |
| 103 | Carrier with removable plate, side panel |
| 104 | Carrier with removable plate assembly |
| 105 | Item shaped as vial |
| 106 | Process Chamber configuration details-1 |
| 107 | Process Chamber configuration details-2 |
| 108 | Process Chamber configuration details-3 |
| 109 | Process Chamber configuration details-4 |
| 110 | Process Chamber configuration details-5 |
| 111 | Process Chamber configuration details-6 |
| 112 | Item Processing example-1 |
| 113 | Item Processing example-2 |
| 114 | Automatic item feeding configuration |
| 115 | Automatic item feeding configuration with entry scales and size verifications |
| 116 | Automatic item feeding conveyor configuration details |
| 117 | Empty package automatic side feeding configuration details |
| 118 | Empty package automatic bottom feeding configuration details |
| 119 | Empty package configuration details |
| 120 | AVM Module Feeding configuration details |
| 121 | Block-diagram - ADVS closed-loop Control System |
| 122 | 3-D view of Carrier Support configuration components |
| 123 | 3-D view of Carrier Support configuration assembly |
| 124 | Z-X view item Sliding Unloading Tunnel, default position |
| 125 | Z-X view item Sliding Unloading Tunnel, Carrier conveyor unloading position all aligned carriers |
| 126 | Z-X view item Sliding Unloading Tunnel, Carrier conveyor unloading position designated carriers |
| 127 | 3-D view configuration of support components of self-adjusting plate of Sliding Unloading Tunnel |
| 128 | 3-D view configuration of components of self-adjusting plate of Sliding Unloading Tunnel |
| 129 | Z-Y view of assembled components of self-adjusting plate of Sliding Unloading Tunnel |

DRAWING CONVENTION AND FORMAT

Drawings with this application are not to scale and are referenced to "X-Y-Z" coordinate system, which is consistent throughout all Drawings, where shown. The "X-Y-Z" coordinate system orientation is as follows:

X points toward Provider side. Elements facing Provider can be labeled with suffix "P".

−X points toward Customer side. Elements facing Customer side can be labeled with suffix "C".

Y points toward right side of Module. Elements facing right side can be labeled with suffix "R".

−Y points toward left side of Module. Elements facing left side can be labeled with suffix "L".

Z points toward top of Module. Elements facing topside can be labeled with suffix "T".

−Z points toward bottom of Module. Elements facing bottom side can be labeled with suffix "B".

Elements on computer-generated drawings have identification numbers inside a circle. For simplicity—not all elements are shown on each drawing. Drawings are for illustration of principals and important details related to unique features of ADVSP. Most of drawings, for simplicity, do not show all details, and are intended for illustration of respective design and configuration principals. Some of the drawings, for simplicity, illustrate components shown as "transparent". In addition, physical dimensions and/or proportions between various components, are shown for illustration of design and configuration principals. Actual production units will be configured to achieve required design criteria, including: performance, costs and utilization of available space.

DEFINITIONS

My application contains definitions of specific components or processes, which are scripted in "bold italic", and which are listed below in alphabetical order. Definitions are used and expanded in greater details in later paragraphs of this application, as needed.

ADVS Pharmacy

Pharmacy configured with ADVSP components. Example: ADVS pharmacy model ADVS-1200 (capacity—1200 items).

ADVS Pharmacy Central

Centralized location of a pharmacy business, which is configured with ADVSP components, and which can be used for centralized processing of: raw materials, refill prescriptions, other medications, which can be distributed and delivered to a remote pharmacy for serving customers. Distribution can also include serving customers directly at the designated locations, such as: stand-alone kiosks, medical facility, etc.

ADVS Pharmacy Kiosk

Stand-alone kiosk configured with ADVSP components allowing kiosk to be refilled with medications and other items, which then can be dispensed automatically to authorized customers. Examples: ADVS pharmacy kiosk ADVSP-420i (capacity—420 items, indoor mount); ADVS pharmacy kiosk ADVSP-720w (capacity—720 items, outdoors mount).

Conveyor Belt

Flexible belt assembly, including timing belt, which can be configured: with molded-in, permanent mounted Carrier support bearing assemblies; with insertable, or fastened—removable Carrier support bearing assemblies. Conveyor belt can be configured with rollers along their perimeter. Conveyor belt depending on construction can be configured to be supported by pulleys and/or guiding rails.

Items

Items, as referenced in this application, include: prescription medications inside a container; over-the-counter medications inside a container; test samples, such as patient blood, urine; general items. Container is configurable to provide required space for holding medications inside, and assist ADVSP in processing and maintaining items within respective specifications.

Process

One or more operations, which can be performed over Item(s). Example: Process of heating or cooling Item(s) within Process Chamber to specified temperature within specified time window.

Process Chamber

Area within Module, which can be configured for conducting specific Process(s), as defined by apparatus configuration parameters.

Process Index

Distance between entry into and exit from Process Chamber

Process Cycle

Time required for Item(s) to remain within Process Chamber to achieve Process objective(s)

Process Module

Module configured with Item Processing capabilities

Provider

Business, responsible for development, installation, operation and maintenance of ADVSP Portable Vending Cartridge Portable vending cartridge (PVC) is a portable enclosure configured with a carrier conveyor assembly inside, and other features described in this application. Carrier conveyor assembly, as well as carriers, can be configured with features described in this application. PVC, depending on size and weight, can remain inside either Automatic Vending Module (AVM) or inside ADVSP portable transport racks (PVC Racks). PVC Racks are configured for convenient insertion and removal of PVC in-between AVM units, as needed. PVC can be loaded with Items remotely, such as at a factory producing Items. Loading of items into PVC can take place while PVC is inside AVM or inside portable transport rack. Loaded PVC can then be transported to designated locations, where they can be inserted into respective Automatic Vending Modules for the purpose of vending items loaded inside PVC to authorized Customers. The accessibility of Items within PVC is monitored by respective Security Electronics connected to Controller. The environment inside PVC can be monitored by Controller connected to PVC sensors.

PVC Portable Racks

These racks are configured as a mechanical portable interface between Automatic Vending Modules (AVM) in following terms:

a) Racks have the same index for PVC slots as AVM
b) Racks elevation can be easily adjusted to aligned with AVM installed at a location
c) Once aligned, PVC or PVC's can slide out of an AVM right into the Rack, and wise-versa
d) Racks are used for transportation and/or storage of PVC's within a facility
e) Racks can be configured for mounting inside transportation vehicles to deliver PVC's to designated locations. AVM can be configured for stationary mounting into the transport vehicles, and allow to retain PVC's within specification environment, and support dispensing of medications from PVC at any stop of the vehicle, as required for such operations as serving individual customers along the route of delivery PVC's from central Pharmacy to local pharmacies, kiosks, etc.
f) Racks are mounted on the wheels, which allow a Provider to move them freely along a surface
g) Racks can have power and controller interfaces installed, as needed, for providing power and communication with PVC controllers and other ADVS controllers
h) When Racks are used inside vehicles for transportation, at destination points they can be pulled out of the vehicle and then wheeled over to designated AVM's for unloading PVC's to AVM's. Once unloaded, empty PVC's can be inserted into the Rack, and Rack wheeled back to the transport vehicle for returning back to Pharmacy.

100% Factory-Sealed Quality

Process of distribution of Item(s) from point of origination (centralized or on-site) to point of sale (vending via Module) with assurance that the Item (container with prescription medication inside) has remained inside the original sealed Container assembled or prepared at the point of origination within respective specifications, including: environment; parameters such as weight, size of the Container with medications inside. In addition, throughout the entire process the access to the Item, or to the Cartridge or Module containing the Item, and environment surrounding the Item—were monitored by non-volatile electronics, and respective safety information, such as: whether the Container, or Cartridge, or Module—were accessed (time stamp), and specific actual environment the Item was exposed—are reported by Cartridge and/or Module controller to the Host computer as needed. If any access violation noted or environmental specifications were exceeded, the local and/or Host Controller will inform the Provider, and as configured will execute in real-time respective controls, which can include—replacing the Item(s). The history of compliance to specifications is maintained in the log, which can be presented to Customer or Provider when requested.

DETAILED DESCRIPTION OF THE INVENTION

FIG. 1—illustrates 3-D view of a pharmacy example configured using Automatic Distributed Vending System, abbreviated as ADVSP. Application describes automation technology of pharmacy operations with number of objectives and features, including: superior quality of products delivered to customers with written reports confirming "100% factory sealed quality"; safety of raw materials and medications; highly efficient service rate of medications to customer; superior privacy of sensitive information related to customers; variety of configurations and layouts indoor and outdoor to enhance pharmacy appearance and expanding service to unattended kiosks. As part of automating pharmacy operations, ADVSP handles prescription and non-prescription medications, and both are dispensed to authorized customers, or provider. ADVSP includes features described in this application, some of which are listed in the description of FIG. 2 below. Figure elements are labeled as follows:

6, 15—Station Controller #1 and #2 respectively. Controller can be configured as a local Host Controller, and also for initial verification of Customer identification. As a Host, Station Controller will perform all required functions, including real-time synchronization controls, in support of the safe, reliable and efficient operations of the ADVSP-1200, and respective support components located at other locations, including centralized processing of prescription medications. Operation of all components within Automatic Distributed Vending System for Pharmacy (ADVSP) is synchronized in real-time by local and remote Controllers to achieve the most efficient, safe, reliable and cost-effective operations at all times. The ADVSP can be configured for direct synchronization by Controllers without operator assistance, or combination of direct and operator controls. When configured for direct, the remote or host ADVSP Controller will synchronize with all respective stand-alone Controllers and AVM Controllers to monitor and control in real-time a number of functions, including: status, inventory. Status will include: location, availability, operating condition, environment. Inventory will include: equipment, stored medications inside. Inventory will be monitored via local controllers connected to respective sensors, including: barcode, RFID. Status will be monitored via local controllers connected to respective sensors, including: environment, safety. Synchronization control will include support of: centralized processing of prescription medications, on-site processing of prescription medications, and combination of both. Synchronization control will optimize processing of prescription medications, including: location, date/time, selected PVC, selected available carrier within PVC, distribution to selected AVM—to ensure quality and efficiency of all process and logistics steps at all time. In respect to a specific ADVSP layout, remote or host Controller will monitor and control in real-time: the number, location, status of available equipment (AVM, PVC, support components, etc.); inventory of each AVM (number of PVC installed); inventory of each PVC components (number of carriers, status of carriers); inventory of each PVC content (number of medications, medications ID barcode). Controllers will also monitor and control status of medications within the ADVSP, including: expiration date, environment, weight, location, status (request date/time, location). ADVSP Controllers will synchronize the inventory and status information to ensure: required medications within respective specifications are available for dispensing to authorized Customers at specified locations and time; corrective controls are executed in real-time to ensure that only medications within their specifications are dispensed to authorized Customers. In respect to operation of AVM, Controller will synchronize operation of each PVC inside AVM, to ensure: Carrier Conveyors are synchronized to maintain required alignment and position accuracy; quality of each medication stored inside PVC is maintained within specifications (environment, safety, expiration, weight, size of container). Carrier conveyors inside each PVC can be controlled by PVC and/or AVM controller using the algorithm patented by the applicant under USPTO U.S. Pat. No. 7,844,416. In addition, AVM Controller can be configured to synchronize operation of all PVC's inside AVM, to ensure: safe, reliable and efficient operation of respective Carrier Conveyors. AVM Controller can be configured to start each Conveyor after a short delay from the start time of another Conveyor within AVM, to avoid peak demands in electrical power. Controller will align selected Carriers for loading of medications. Controller will align selected Carriers for unloading of medications, and when unloading Sliding Tunnel is used, Controller will synchronize operation of all Carrier Conveyors inside each PVC installed in the AVM to ensure: only selected Carriers with inspected medications inside are presented for unloading; dispensing rate of several medications to an authorized Customer is completed within shortest time possible. In respect to Customers, Controller can be configured to provide required user interface, including: verification of identification, on-site processing of payments for medications purchased, on-site help/assistance in respect to instructions on how to use medications. Authorized Customers can view available medications per processed Customer's prescriptions, and select the ones they would like to receive. Upon payment, Controller will direct Customer to Automatic Vending Module (AVM) with specific ID sign to receive selected medications. The Station Controller will inform identified AVM Controller, which in turn, if not occupied by another Customer, will have its ID sign (1254) lit to inform the Customer, and signify that an order is being processed. In addition, the AVM Controller will begin advancing Carriers inside to prepare selected medications for dispensing to authorized Customer. The Station Controller will inform the Customer of the time window allocated to pick up medications at the designated AVM.

10—Automatic Vending Module (AVM) configured with user interface and prescription medication pick-up bin. AVM can contain a number of Portable Vending Cartridges (PVC), which contain prescription medications processed at either: Central Pharmacy and delivered to this pharmacy location inside PVC; or processed on-site and loaded into available empty carriers of PVC; or combination of both. Controller at AVM, if not occupied, will lit the ID sign (1254), and advance Carriers inside to prepare medications for dispensing as soon as informed by the Station Controller of a pending transaction to an authorized Customer. AVM Controller via user interface will confirm Customer identification, and selected medications for which the Customer paid at the Station Controller. AVM Controller will allow Customer to specify if consultation is required, and if medications Log Report should be printed. Customer has a choice to select consultation via: on-site Pharmacist at the Service Window (21); or ADVS real-time voice/video on-site via AVM user interface; or remotely via Internet. Customer can also select if medications should be dispensed and packaged inside a box. AVM Controller will then proceed with dispensing medications. Customer will pick-up medications from the pick-up bin, and receive print-outs of instructions and the log history, as selected. The Log Report will contain essential information in respect to medications, including: origination date and location; conformance to specifications—environment, weight, size of container, due date. The AVM Controller will control the ID sign (1254), which can be configured per applicant's patent-pending application No. 12,221,337, to inform Customers of its status, including: idle mode; order pending; order being served; maintenance. The power distribution of the entire ADVSP can be configured per applicant patent-pending application No. 12,148,771.

Figure 2:
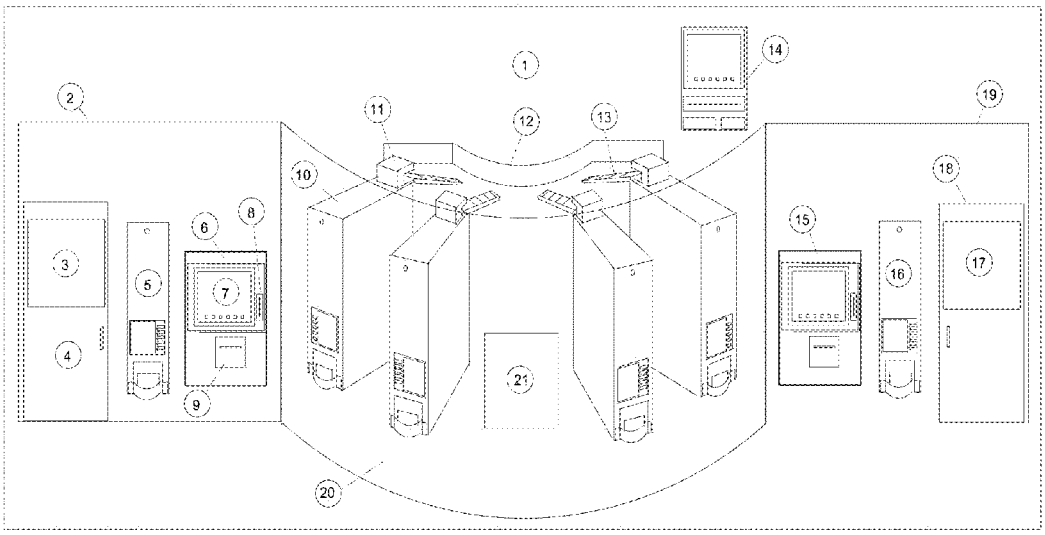

FIG. 2—ADVSP configuration similar to the one shown on FIG. 1, with details in respect to ADVSP components. For simplicity to view details, the wall (20) is shown as transparent. In this type of installations, ADVSP Stations or stand-alone Modules can offer Clear-View security. These ADVSP configurations can allow Provider to observe activities taken place from Customers end, and then promptly take appropriate action to assist Customer or correct a problem, as needed.

In addition, only front of Module can be exposed to Customer, while side and rear panels of both Inner and Outer Enclosures can be Clear-View type. This arrangement of Modules can allow Provider to periodically observe and/or inspect in real-time activities within Module, and then promptly take appropriate action to correct a potential problem, as needed. This arrangement of Modules can also allow Provider to effectively use ADVS Automatic Item Feeding assembly (13) and ADVS Automatic Item Loading assembly (11) for convenient Item loading and additional Item buffering capacity. The interface between Customer and Controllers can be configured, as described for FIG. 1. Figure elements are labeled as follows:

1—ADVSP installation, configured similarly to the one shown on FIG. 1

2—ADVSP left partition wall, shown as "clear through" for illustration purposes. As needed, the space available in between the installed components (modules, etc.) can be configured to provide additional functionality, including: privacy walls in between each AVM; shelves (recessed or outside) for storage of: conventional items available for purchase, helpful information to Customers; large display monitors situated on the upper sections of the wall for providing: marketing information; instructions, etc.

3—Customer service window, left side, which can be used for providing on-site assistance to Customers.

4—Provider access door, left side, which can be used for providing on-site assistance to Customers.

5—Dynamic Module, or AVM configured for on-site prescription medication processing, left side

6—Station Computer #1, which can be configured to provide initial processing of Customer's ID card, etc.

7—Station Computer #1 touch-screen monitor, as part of user interface. The monitor at the Station Computer or at the Automatic Vending Module (10) can be used by Controllers to interface with Customer and Provider, including allowing authorized Customer to preview the Log History of prescription medication stored inside respective AVM unit before selecting the medication for being dispensed.

8—Station Computer #1 card reader, which can be configured to perform variety of functions, including: accept ID cards, ATM/credit cards, as part of identification and payment options

9—Station Computer #1 printer, which can be configured to print: sales receipts; instructions; log history of dispensed medications.

10—Automatic Vending Module (AVM), which can be configured for General or Assigned vending of items, including prescription medications. For simplicity not all components, such as ID card reader, are shown. Each AVM can be configured for: centralized processing of prescription medications at a remote dedicated centralized pharmacy location; on-site processing of prescription medications; or combination of both. As shown in this example, each AVM is configured to have Automatic Feeding assembly (13), which will support on-site processing of prescription medications, in addition to centralized processing of prescription medications at a remote dedicated centralized pharmacy location. Centralized processing of prescription medications at a remote dedicated centralized pharmacy location includes; loading of containers with prescription medication into PVC; transporting PVC to on-site pharmacy, as the one shown on FIG. 2; slideably installing loaded PVC into available slots inside AVM units; dispensing prescription medications from PVC units installed in the AVM units to authorized Customers.

11—Automatic Item Loading/Unloading assembly configured together with Automatic Item Feeding assembly (13) for on-site loading of medications into Portable Vending Cartridges (PVC) installed inside AVM.

12—Area behind Modules, which can be configured for Provider working bench/area, including: monitoring on-site processes; filling prescriptions.

13—Automatic Item Feeding assembly, which can be configured to include: barcode reader to identify the prescription medication before being loaded; scale to measure weight of container with medication; feeding conveyor; and other support devices which can be used by ADVSP Controllers to monitor inventory, status and quality of prescription medications inside the ADVSP.

14—ADVS Host Computer, which can be configured to coordinate all activities within ADVSP, and interface with other Controllers within and outside ADVSP via wired or wireless LAN.

15—Station Computer #2, which can be configured to perform variety of functions, including: initial processing of Customer's ID card, etc.

16—Dynamic Module, or AVM configured for on-site prescription medication processing, right side. As needed, this AVM can be configured to have required thermal insulation inside and outside, which will allow Controller inside AVM to maintain medications at refrigeration temperatures

17—Customer service window, right side, which can be used for providing on-site assistance to Customers.

18—Provider access door, right side, which can be used for providing on-site assistance to Customers.

19—ADVSP right partition wall

20—ADVSP center partition wall

27—Item Pick-up Bin, Customer side. As needed, the dispensed medications can be presented to the Customer in privacy packaging, as described in this application.

ADVSP components are described in details in the application. Below is a brief review of key features. Carrier support conveyor inside each Portable Vending Cartridge (PVC) can be configured to support multiple number of tracks, with the number of tracks limited only by available physical size, weight and costs. Also includes carrier conveyors with single and multi-pocket carriers, with each pocket configured to support required item(s), container, bag with item(s). Each pocket of a carrier can be subjected to track-specific process control, including: environmental, loading and unloading methods. Carrier support conveyor can be configured to support horizontal, vertical and combination of horizontal and vertical layouts. Conveyor can be based on flexible belt, including timing belt. Carrier support conveyor can be configured to support required capacity by utilization of single and multiple carrier support conveyors. Carrier support conveyor can be configured to operate with a single drive pulley, or combination of drive and support pulleys.

Automatic Vending Module (AVM) can be configured to accept a number of Portable Vending Cartridges (PVC), with the number of cartridges limited by physical size, weight and costs. The number and indexing of each PVC inside AVM can be configured to include: PVC only with horizontal index; PVC only with vertical index; combination of PVC's, with some having horizontal index, and some having vertical index. Example: Front of AVM can be configured to have insertable PVC with vertical index, while the back side—configured to accept slide-able PVC's with horizontal index. Loading of items into the carriers can be configured to support: remote loading via Portable Vending Cartridges (PVC); on-site local loading; and combination of both. Dispensing of items can be configured to include: multi-item dispensing on Customer side; simultaneous multi-item dispensing on Customer and Provider sides. Depending on number of PVC installed and number of static conveyor assemblies installed, dispensing is configured to provide convenient access to items being dispensed from all carrier conveyors. As needed, the section of AVM designated for provider—can be located and sealed behind the pharmacy walls, or kiosk structure, while the section of AVM designated for customer, specifically—user interfaces and dispensed items pick-up bin—are exposed to customers for convenience. Dispensing via slideable tunnel is described in the application. ADVSP controllers located inside various components (PVC, AVM, etc.)—are interfaced via LAN with the Host controller, and operation of each component, as needed, can be coordinated in real-time directly by the Host controller with and/or without operator assistance. ADVSP control algorithm includes operation criteria, such as: optimization using available resources; sustaining required quality of operations; sustaining quality of items being processed; providing maximum rate of service to customers. Conveyor timing belt inside Portable Vending Cartridges (PVC) can be configured with: either permanently embedded or removable (pluggable) carrier support bearings; permanently embedded index slots; and permanently embedded rollers to reduce friction. Carrier support conveyor can be configured with multiple number of tracks, with the number of tracks limited only by available physical size, weight and costs. Carrier support conveyor can be configures with a variety of layouts, including: horizontal and vertical track layouts, with single belt, multi-belt, synchronized and non-synchronized configurations. Carriers are configured along the conveyor belt, as needed, including providing required space ("index dead zone", i.e. no carrier present is allowed) for convenient conveyor mounting of a configuration consisting of a single conveyor belt in the middle and carriers supported from bearing assemblies indexed on each side of the conveyor, forming a single belt dual track configuration. Carrier support conveyor required capacity can be achieved by utilization of multiple carrier support conveyors. Simple closed-loop dual pulley driven carrier conveyors will improve reliability, lower noise. Portable Vending Cartridge (PVC) can be configured with: one conveyor belt and one pulley; one conveyor belt and 2 pulleys; multiple conveyor belts with multiple number of pulleys. In addition, PVC can be configured with motorized conveyor, self-contained; or with conveyor only, while the motor drive located inside the mating slot of an Automatic Vending Module (AVM), which will engage with conveyor upon inserting of PVC into mating slot of AVM. Portable Vending Cartridge can be configured with: horizontal conveyors; or vertical conveyors. Automatic Vending Module can be configured to accept a number of slideably insertable PVC units, each with unique configuration, including: PVC with horizontal conveyors and PVC with vertical conveyors. The carrier conveyor inside PVC can be configured to support and index carriers, empty or loaded with items. Carrier conveyor can be configured as: single conveyor belt with dual track, one track of carriers on each side of the conveyor belt, sharing one carrier support bearing assembly; dual conveyor belt with single track in-between, with carriers supported from each side via respective carrier support bearing assembly; multi-conveyor belt with multi-track of carriers. Carrier conveyor can be aligned horizontally, vertically, or combination of two—sections with horizontal and vertical indexes. In its simplest configuration, a carrier conveyor will consist of: one conveyor belt with embedded or fasten-in carrier support bearing assemblies; drive/support pulley; and support mechanics for pulleys, mechanical couplings. In this case, the conveyor drive mechanics (motor, mechanical couplings) and control electronics will reside inside the mating slot of the Automatic Vending Module (AVM), which will engage with the carrier conveyor when respective PVC containing the conveyor will be inserted into the slot. Carrier conveyor can be configured to support any combination of carriers, including: carriers of different sizes; carriers with single and multiple pockets. Details are presented in the Table below.

TABLE 2

| Carrier Conveyor application | Number of Belts. Details | Number of Tracks. Details |
|---|---|---|
| 1. Transporting items inside carriers of a relatively small size and weight. Cost efficient, space efficient. | One. Carrier support bearing assemblies are "open-type", and are long enough to allow inserting of a carrier support shaft from each side | Two. Each track capable of supporting and advancing a number of relatively light-weight and small size carriers |
| 2. Transporting items inside carriers of a variety of sizes and weights. Stable, reliable. | Two. Carrier support bearing assemblies are "closed-type" (blind), and allow inserting of a carrier support shaft from only one side | One. Track capable of supporting and advancing a number of relatively wide variety (weights, size) of carriers |
| 3. Transporting items inside carriers of a variety of sizes and weights. Stable, reliable, cost efficient, space efficient. | Three. Carrier support bearing assemblies are "closed-type" (blind) on conveyor belts located on outside, and are "open-type" on conveyor belt located in the middle. | Two. Each track capable of supporting number of relatively wide variety (weights, size) of carriers. Each track can support track-specific size of carriers. |
| 4. Transporting items inside carriers of a variety of sizes and weights. Stable, reliable, cost efficient, space efficient. | Four. Carrier support bearing assemblies are "closed-type" (blind) on conveyor belts located on outside, and are "open-type" on conveyor belts located in the middle. | Three. Each track capable of supporting number of relatively wide variety (weights, size) of carriers. Each track can support and advance track-specific size of carriers. |
| 5. Transporting items inside carriers of a variety of sizes and weights. Stable (tracks inside), reliable, highly cost efficient, highly space efficient. | Four. Carrier support bearing assemblies are "closed-type" (blind) on conveyor belts located on outside, and are "open-type" on conveyor belts located in the middle. | Five. Each inside track capable of supporting number of relatively wide variety (weights, size) of carriers. Each outside track capable of supporting number of relatively light weight carriers. Each track can support track-specific size of carriers |

Carrier conveyors can be configured with a single drive pulley, or any number of pulleys required to efficiently utilize the space within PVC, as well as accommodate specific functions, such as: item loading, item unloading, item inspection, item process control. As shown, ADVSP in this example is configured as half-star layout, with service entry points on each side, and on-site consultation window in the middle. The illustrated ADVSP is configured to include 6 Automatic Vending Modules (AVM-200), each with capacity of 200 medications. The total capacity of the layout is 1200 items (ADVSP-1200), which can include: prescription medications, non-prescription medications, combination of both. The layout of the ADVSP-1200 provides flexibility. Table 3 below illustrates important functional parameters, based on the following example of configuration: AVM #2, 3, 4, 5 are selected for Centralized processing of prescription medications; AVM unit #1 selected for on-site processing of prescription medications required to be maintained at refrigeration temperatures; AVM unit #6 selected for on-site processing of prescription medications required to be maintained at ambient temperatures.

TABLE 3

| | |
|---|---|
| Number of AVM total | 6 |
| AVM Capacity (each) - Number of Prescription Medications | 200 |
| ADVSP-1200 Total Capacity - Number of Prescription Medications | 1200 |
| Number of Prescription Medications processed at Centralized location | 800 |
| Number of Prescription Medications processed on-site | 400 |
| Number of Prescription Medications stored at refrigeration temperatures | 200 |
| Number of Prescription Medications stored at ambient temperatures | 1000 |
| Number of on-site Computers for CUSTOMER support | 2 |
| MAX Service Rate - number of Customers served at once | 6 |
| Service MAX Rate per CUSTOMER (number of Prescriptions per time interval) | 12 in 15 sec |

ADVSP can be configured to match requirements of a specific pharmacy. ADVSP offers:

1) Superior throughput. An automatic vending module (AVM) can be configured to contain: multiple independent portable vending cartridges (PVC), which when installed inside the module, would form a multi-track horizontal and vertical carrier transport system, capable of simultaneous loading and/or unloading of a number of items; static built-in multi-track conveyors, which are installed along the perimeter of the vending module, surrounding portable vending cartridges. For example, a vending module configured with: three (3) independent portable vending cartridges, each configured as a 3-track carrier transport conveyor, and two static conveyors installed along the perimeter—can allow simultaneous loading and/or unloading of 22 items at designated pick-up bins located along the perimeter of the module. As result, the ADVSP will outperform any vending system ever configured.

2) Besides multiple loading/unloading, ADVSP can be configured to allow other operations, such as: simultaneous inspection of carriers and items inside carriers, simultaneous tracking of carriers and items inside carriers; simultaneous item processing, etc. to be conducted simultaneously along multiple tracks, which can be controlled by ADVSP Controllers, including in synch or independent operations.

3) Variety of ADVSP configuration including complete real-time, independent of operator, closed loop control of all process steps by controller. 100% guaranteed quality of prescription medications is accomplished initially by using ADVS Controller and components:

a) Once prescription is entered by Provider, ADVSP Controller will identify: respective container to store the prescription based on medication specifications (solid or liquid, temperature, humidity, unit weight, total weight) (size, weight, capacity); and calculate the expected combined weight of the container with correct amount of medication inside selected container b) Provider will follow directions from ADVSP Controller and will select appropriate container for storing medications c) Provider using ADVSP components will measure weight and size of the container with filled prescription medication, and ADVSP Controller will perform initial validation of these parameters to match the respective specification entered by Provider into non-volatile memory under identification record, such as barcode, attached to the container with medication, and will record and store the validated information under prescription barcode label code, attached to the container with medications d) While within ADVSP, each container with medication inside, will be periodically inspected by Controller for verification of: weight, size of the container to match the barcode label on the container e) ADVSP components, such as Portable Vending Cartridges (PVC), Automatic Vending Modules (AVM) will have quality inspection devices, such as: barcode readers, configured to be located at required inspection points, including: entry, transfer in-between sub-assemblies, prior-to-dispense (final verification); weight measuring scales, which can be configured to measure the weight of: each container individually, conveyor assembly with carriers, transfer sub-assemblies; size measuring devices (optical, etc.), which can be configured to measure the size of: each container as it passes check points along the conveyor assembly, at transfer points in-between sub-assemblies—with an objective to monitor specifications parameters of the container with medications per information stored by ADVSP Controller based on barcode label attached to the container, and ensure it is maintained within specifications prior to dispensing to authorized Customer. The containers, which failed inspection, will be rejected by ADVSP Controller, and as configured by Provider—will be dispensed directly back to the Provider.

4) The design of ADVSP can be configured with appropriate thermal isolation or insulation of heat generating components (motors, drives) from Carrier section inside Portable Vending Cartridges (PVC), and will support automatic dispensing of medications, which are maintained within respective environmental specifications (temperature, humidity) at all times. In addition, sections of the Automatic Vending Modules (AVM) containing medications inside installed PVC units, can be configured with thermal isolation, or insulation, or combination of both, and can be further configured to be enclosed structurally to allow portable environmental control devices, such as: temperature controllers, humidity controllers—to maintain all medications inside (AVM) within specified environment at all times.

ADVSP supports variety or configurations, which include specific configurations for each individual component, and combination of configurations for any given system to meet specific requirements. In addition, other ADVSP support components provide the following functions: Automated Container loading and unloading; Dispensed Container packing, etc. Operation of all components within Automatic Distributed Vending System for Pharmacy (ADVSP) is synchronized in real-time by local and remote Controllers to achieve the most efficient, safe, reliable and cost-effective operations at all times. The ADVSP can be configured for direct synchronization by Controllers without operator assistance, or combination of direct and operator controls. When configured for direct, the remote or host ADVSP Controller will synchronize with all respective stand-alone Controllers and AVM Controllers to monitor and control in real-time a number of functions, including: status, inventory. Status will include: location, availability, operating condition, environment. Inventory will include: equipment, stored medications inside. Inventory will be monitored via local controllers connected to respective sensors, including: barcode, RFID. Status will be monitored via local controllers connected to respective sensors, including: environment, safety. Synchronization control will include support of: centralized processing of prescription medications, on-site processing of prescription medications, and combination of both. Synchronization control will optimize processing of prescription medications, including: location, date/time, selected PVC, selected available carrier within PVC, distribution to selected AVM—to ensure quality and efficiency of all process and logistics steps at all time. In respect to a specific ADVSP layout, remote or host Controller will monitor and control in real-time: the number, location, status of available equipment (AVM, PVC, support components, etc.); inventory of each AVM (number of PVC installed); inventory of each PVC components (number of carriers, status of carriers); inventory of each PVC content (number of medications, medications ID barcode). Controllers will also monitor and control status of medications within the ADVSP, including: expiration date, environment, weight, location, status (request date/time, location). ADVSP Controllers will synchronize the inventory and status information to ensure: required medications within respective specifications are available for dispensing to authorized Customers at specified locations and time; corrective controls are executed in real-time to ensure that only medications within their specifications are dispensed to authorized Customers. In respect to operation of AVM, Controller will synchronize operation of each PVC inside AVM, to ensure: Carrier Conveyors are synchronized to maintain required alignment and position accuracy; quality of each medication stored inside PVC is maintained within specifications (environment, safety, expiration, weight). In addition, AVM Controller will synchronize operation of all PVC's inside AVM, to ensure: safe, reliable and efficient operation of respective Carrier Conveyors. AVM Controller will start each Conveyor after a short delay from the start time of another Conveyor within AVM, to avoid peak demands in electrical power. Controller will align selected Carriers for loading of medications. Controller will align selected Carriers for unloading of medications, and when unloading Sliding Tunnel is used, Controller will synchronize operation of all Carrier Conveyors inside each PVC installed in the AVM to ensure: only selected Carriers with inspected medications inside are presented for unloading; dispensing rate of several medications to an authorized Customer is completed within shortest time possible.

Figure 3:
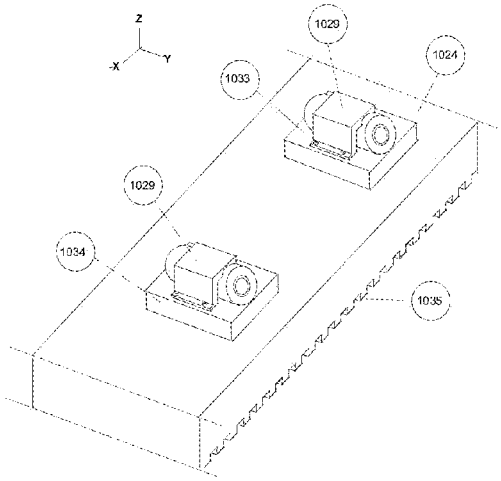

FIG. 3—illustrates 3-D view of conveyor timing belt (1024) configured with insertable and fastened into the belt (1024) bearing assemblies. Figure elements are labeled as follows:

1029—Fastened-in removable Carrier Support Bearing assembly open-type

1033—Fastening component, such as screws, which are used to secure and hold (1029) to (1024)

1035—Timing grooves of (1024)

Figure 4:
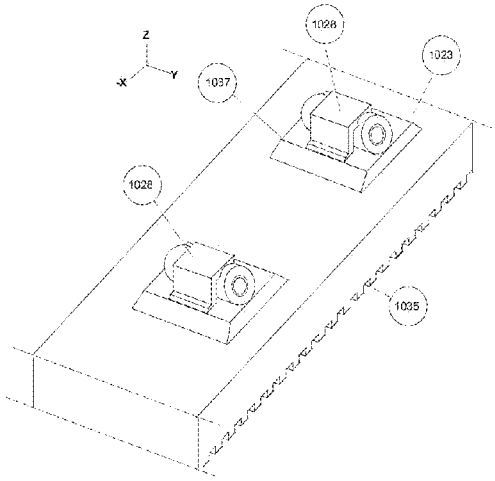

FIG. 4—illustrates 3-D view of conveyor timing belt assembly (1023) configured with embedded permanently attached bearing assemblies (1028). Figure elements are labeled as follows:

1028—Permanently attached Carrier Support Bearing assembly open-type. Open type bearings allow either a single shaft to be inserted through its opening or have one shaft inserted from one side and another shaft inserted from the opposite side.

1037—Base for (1028)

Figure 5:
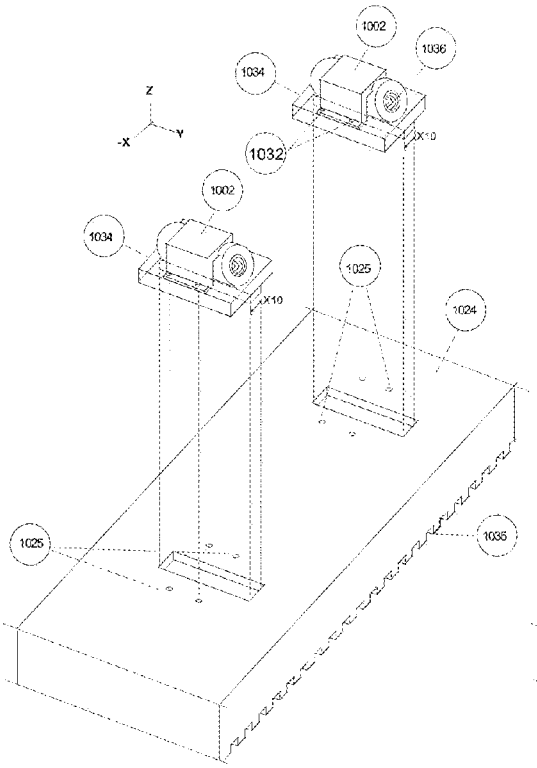

1035—Timing grooves of (1023) configured to engage with respective slots of the conveyor pulley FIG. 5—illustrates 3-D view of construction details of the conveyor timing belt assembly (1024) configured with insertable fastened-in carrier support bearing assemblies (1002). Figure elements are labeled as follows:

1002—Fastened-in type removable Carrier Support Bearing open-type

1025—Embedded fastening component, such as pem-nuts, installed into the 1-st surface of (1024)

1032—Openings in the (1002) for placing fastening component (1025)

1034—Base of the (1002)

Figure 6:
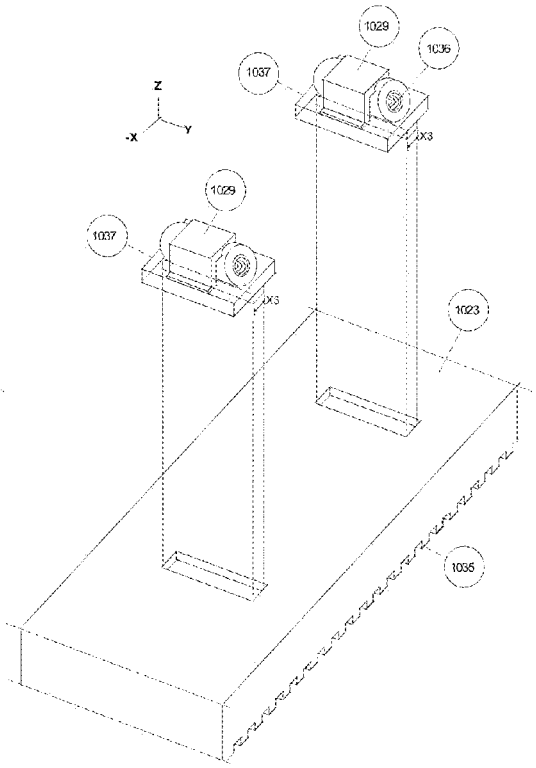

1035—Timing grooves of (1024) configured to engage with respective slots of the conveyor pulley FIG. 6—illustrates 3-D view of construction details of the conveyor timing belt assembly (1023) configured with embedded permanently attached bearing assemblies (1029). Figure elements are labeled as follows:

1029—Embedded permanently Carrier Support Bearing open-type

1037—Base for (1029)

Figure 7:
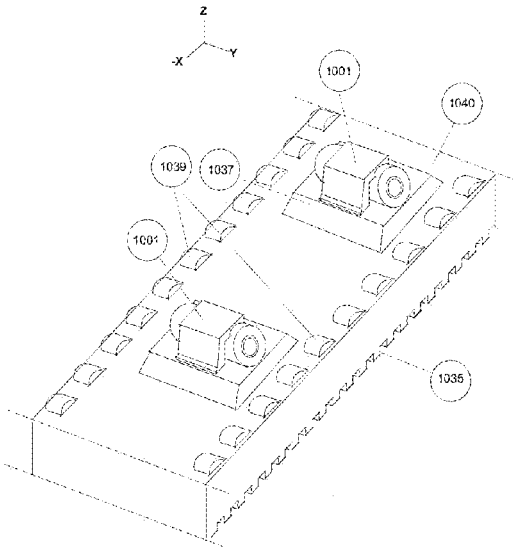

1035—Timing grooves of (1023) configured to engage with respective slots of the conveyor pulley FIG. 7—illustrates 3-D view of construction details of the conveyor timing belt assembly (1040) configured with embedded permanently attached bearing assemblies (1001) and rollers (1039) which can be either embedded or insertable into the belt along its perimeter. Figure elements are labeled as follows:

1037—Base for (1001)

1035—Timing grooves of (1040) configured to engage with respective slots of the conveyor pulley

1039—Embedded rollers into (1040) configured to reduce friction between (1040) and guiding rails (not shown)

Figure 8:
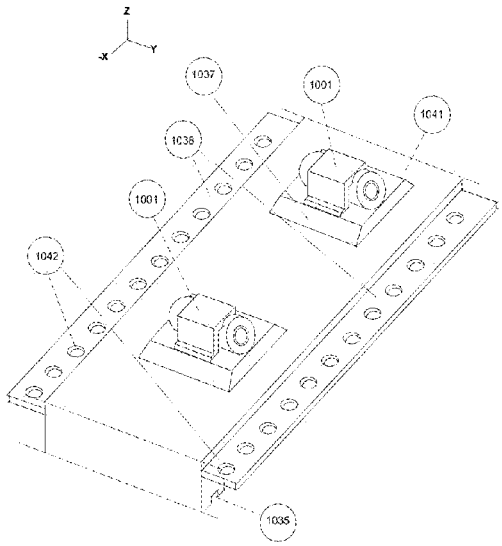

FIG. 8—illustrates 3-D view of construction details of the conveyor timing belt assembly (1041) with embedded permanently attached bearing assemblies (1001), and a strip (1038) with index slots (1042), which can be either embedded or insertable into the belt (1041) along perimeter. Figure elements labeled as follows:

1037—Base for (1001)

1042—Embedded index holes, which are used by sensors and controller to monitor/control motion of (1041)

Figure 9:
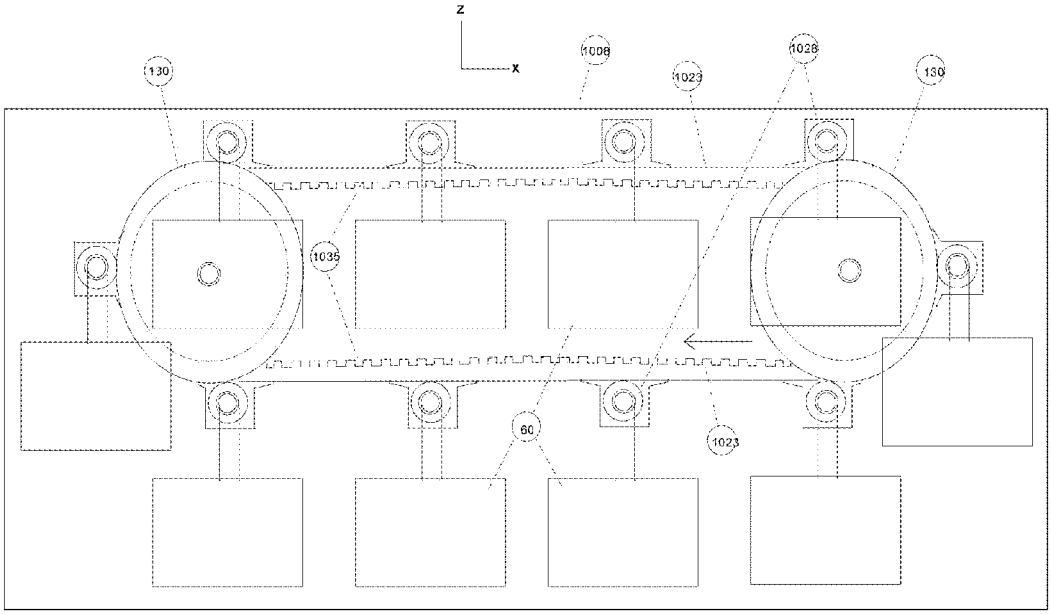

FIG. 9—illustrates Z-X view of a Portable Vending Cartridge (PVC) configured with non-motorized conveyor timing belt assembly (1023) aligned for horizontal indexing. When PVC with non-motorized conveyor timing belt assembly is installed into a mating Automatic Vending Module (AVM)—the conveyor inside PVC will engage mechanically and electrically with respective conveyor drive components of AVM, which will allow Controller to take full control over the conveyor. Figure elements are labeled as follows:

60—Carriers suspended from the Carrier Support Bearing assemblies (1028)

130—Support idle pulley for Timing Belt Conveyor (1023)

1008—PVC configured with non-motorized single belt dual track carrier conveyor assembly horizontal layout

1023—Timing Belt conveyor with embedded permanently attached bearing assemblies open type

1028—Permanently attached Carrier Support Bearing assembly open-type

1035—Timing grooves of (1023) configured to engage with respective slots of the conveyor pulley (130)

Figure 10:
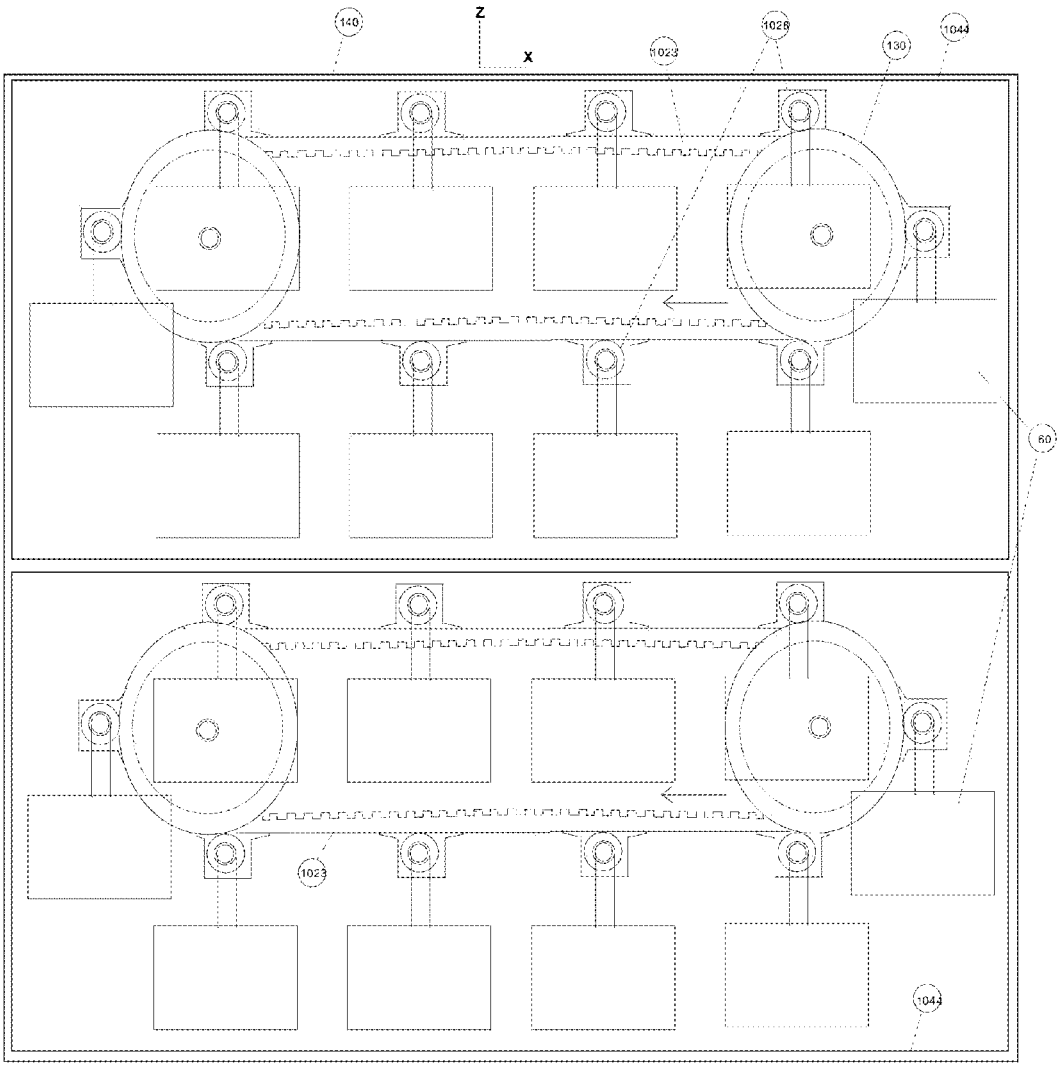

FIG. 10—illustrates Z-X view of an Automatic Vending Module (AVM) (140) configured with two independent PVC assemblies (1044) each with non-motorized conveyor timing belt assembly (1023) aligned for horizontal indexing. When each PVC with non-motorized conveyor timing belt assembly is installed into a mating slot of the AVM (140)—the conveyor (1023) inside PVC (1044) will engage mechanically and electrically with respective conveyor drive components of AVM (140), which are not shown for simplicity, which will allow Controller to take full control over the conveyor (1023). Figure elements are labeled as follows:

60—Carriers suspended from the Carrier Support Bearing assemblies (1028)

130—Support idle pulley for Timing Belt Conveyor (1023)

1028—Permanently attached Carrier Support Bearing assembly open-type

1035—Timing grooves of (1023) configured to engage with respective slots of the conveyor pulley (130)

Figure 11:
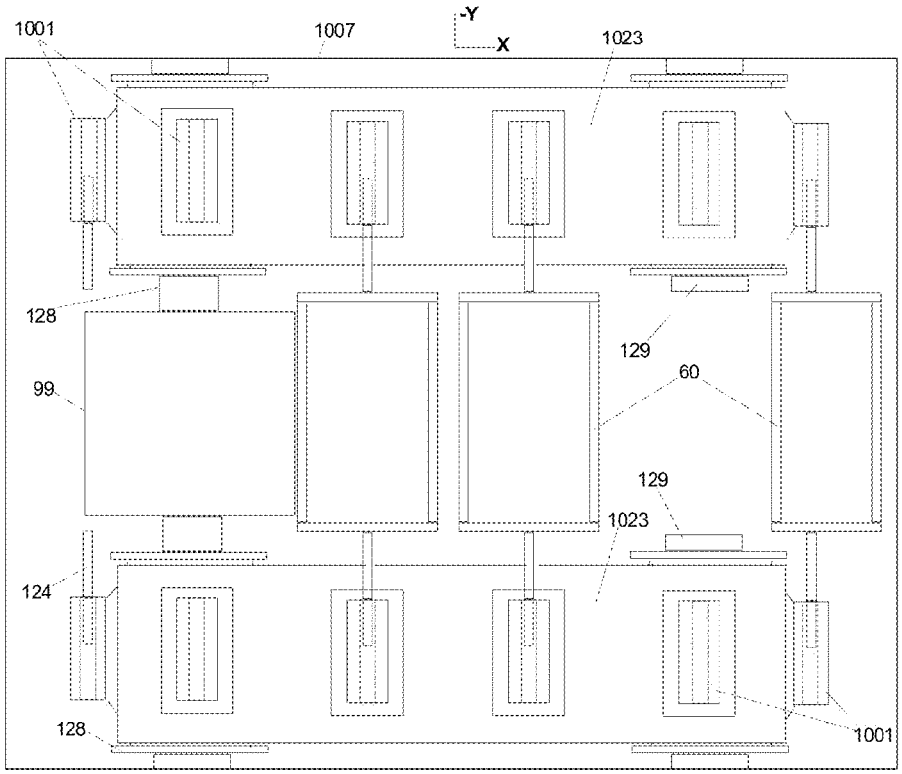

FIG. 11—illustrates X-Y view of (1007) Portable Vending Cartridge (PVC) layout, configured with synchronized dual belt single track motorized conveyor timing belt assembly, each conveyor labeled (1023) and configured with embedded open type carrier support bearing assemblies (1001) aligned for horizontal indexing. Figure elements labeled as follows:

60—Carriers suspended from the Carrier Support Bearing assemblies (1001) via carrier support shaft (124)

99—Conveyor drive motor assembly, which is configured to engage with the drive pulley (128)

124—Carrier support shaft, which is configured to be inserted into (1001)

128—Support drive pulley for Timing Belt Conveyor (1023), which is configured to transfer the drive torque from the motor (99) to linear motion of the conveyors (1023)

129—Support idle pulley for Timing Belt Conveyor (1023)

1001—Permanently embedded Carrier Support Bearing assembly open-type

Figure 12:
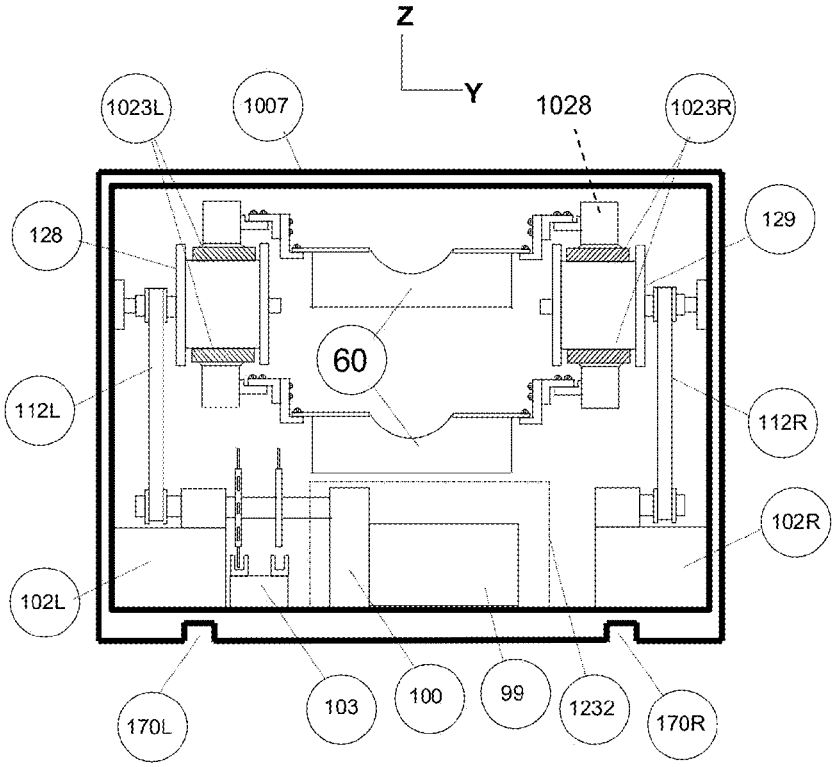

FIG. 12—illustrates Z-Y view of (1007) Portable Vending Cartridge (PVC) configured with synchronized dual belt conveyor single track (1023). The conveyor drive assembly is thermally isolated from the carriers (60), as indicated by insulation layer (1232). The thermal insulation (1232) will assist in maintaining environment surrounding carriers and the items inside carriers at the required specifications. PVC supports variety of configurations. Dimension of PVC (1007) Carriers (60) are configured to accommodate required sizes of Containers with items, or discrete items, or bags with item(s)—to be carried by the Carrier. Inserts into the Carriers (not shown for simplicity) are configured to further match the shape of the Container, and also add such safety features as: protection from vibrations, additional friction to hold Container inside the Carrier, assist in the environmental control. Layout of PVC Carriers is configured to provide required: aerodynamics; place for barcode label(s); necessity to enter Process sections; supporting selected method of loading items into Carriers; supporting selected method of unloading items from Carriers. Pockets inside Carriers are configured with one pocket to carry an item, or configured as multi-pocket, with each pocket configured to support an item, or container with items, or bag with items inside. Each pocket can have unique inner layout, inserts, etc. Pockets are shaped to support selected method of item loading into the pocket, and unloading item out of the pocket. PVC Carriers are configured from materials to meet strength requirements in support of: Containers weight; minimize overall weight of Carriers; longevity requirements; ratings in support of required Processes. Selection includes: plastic, metal, combination of both. Carrier support components are configured for: single shaft (facing Conveyor Timing belt); dual shaft (shaft from each side); shared shaft (with a Carrier in parallel track across the Conveyor Timing belt). PVC Conveyor Belt dimensions are configured to support required capacity of Carriers and the maximum weight of all loaded Carriers. Conveyor Belt layout is configured to provide required: aerodynamics; low friction; durability and reliability required; horizontal index; vertical index; zig-zag index; inserts along the perimeter with position tracking index holes; embedded or inserted rollers to lower the friction during motion. Conveyor Belt materials are configured to meet strength requirements in support of: all loaded Carriers for any given layout; minimize overall weight of the belt; longevity requirements. Selection can include: plastic, metal or combination of both, timing belt or any other suitable belt. The Conveyor Belt Bearing assemblies are configured to provide such options as: number of bearings; distance in-between; size of bearings; shaft of bearings (open; closed); material of bearings; attachment method (insertable; permanently embedded or attached); type of bearing (ball; roller). Configurations include: single, dual (side-by-side), dual with support component in-between the bearings; multiple (side-by-side) with and without support component in-between. PVC Conveyor configurations include: timing belt conveyor with embedded bearing assemblies; timing belt conveyor with insertable bearing assemblies. Conveyor dimensions are configured to support required capacity of Carriers and the maximum weight of all loaded Carriers. Conveyor layout configured to provide required: aerodynamics; low friction; durability and reliability; horizontal index; vertical index; zig-zag index; single pulley or multiple pulleys; process control functions; combination of timing belt assemblies and roller supports in support of variety of configurations of a single and multi-track indexing systems. Conveyor materials are configured to meet strength requirements in support of: all loaded Carriers for any given layout; minimize overall weight of Conveyor Timing Belt assembly; longevity requirements. Selection can include: plastic, metal or combination of both—for all respective components: support brackets; pulleys. Conveyor type is configured for installations inside PVC, or for static installations inside AVM. Static conveyors can be used to carry non-prescription "over the counter" type medications, while the ones installed inside PVC—can be used for prescription medications, or combinations of prescription and non-prescription medication. Conveyor Controls are configured to be executed by controller residing either inside PVC, inside AVM, or remotely. Control parameters include: direction, speed, acceleration, deceleration, position. The controls can be configured based on applicant U.S. Pat. No. 7,844,416. ADVSP PVC dimensions are configured to support required or selected Conveyor Timing Belt assembly, plus all required standard and optional components or features: conveyor drive (including motor, when motorized); controller; sensors; access gates; Item loading and unloading into/from Carriers; Process section; power distribution and control section; environmentally controlled section. PVC layout is configured to support: required or selected Conveyor Timing Belt assembly; mating with respective Outer enclosure of AVM, including alignment features (groves, channels), interface connectors. Handling features (handle bars) to assist with insertion and removal to/from AVM, to/from portable transport rack; round edges for safety. Loading and unloading of Containers in/from selected Conveyor carriers. PVC materials are configured to meet strength requirements in support of: all components mounted inside; minimize overall weight of PVC; longevity requirements. Selection can include: plastic, metal or combination of both. PVC type is configurable, and includes: Motorized (including motor and controls), or non-motorized (providing interface for motor and controls located inside AVM), or combination of. Including such standard and optional components: controller; motor gears; motor controller; controller interface; power supply; battery; user interface; sensors; environmental controls. PVC diagnostics are configurable, and include: status LED, user interface. Diagnostics are non-volatile. Rechargeable battery is provided to monitor critical parameters (sensors) at all times, which include: safety sensors, environmental sensors. Safety sensors—report whether all security panels are installed. Environmental sensors—report environment inside PVC, such as: temperature, humidity. Rechargeable battery will be charged via USB port of the PVC Controller, when the USB port of the PVC Controller is connected to USB port of the ADVS Host Controller or AVM Controller. PVC Controls include: conveyor; sensors monitoring position of safety cover plates; sensors monitoring environment inside; barcode scan devices; actuators for loading/unloading of items; user interface; self-diagnostics; local interface with AVM controller or other controller. PVC Control Algorithm is configurable based on ADVSP Configuration Parameters. Control software residing inside PVC controller will execute and also assist other ADVSP controllers an algorithm which will ensure most optimum utilization of available resources to achieve the highest quality and productivity. Loading of items into carriers will ensure items assigned to specific customer are situated in near proximity (example: single track—next to each other, sequentially; double track—side by side, in-parallel). Unloading steps of items to a customer, when respective AVM is not occupied, can begin as soon as customer is recognized within facility where the AVM is located, and when customer identifications are validated—the respective items will be dispensed at once. Figure elements are labeled as follows:

60—Carriers suspended from the Carrier Support Bearing assemblies (1028)

99—Conveyor drive motor assembly, configured to engage with Drive Pulley (128) via Drive Belt (112L)

100—Conveyor motor gearbox, configured to adjust motor (99) torque to required level

102—Support platforms for conveyor drive assembly

112L—Timing Belt drive assembly of the conveyor (1023L) drive main shaft

112R—Timing Belt idle assembly of the conveyor (1023R) drive main shaft

128—Support drive pulley for Timing Belt Conveyor (1023L)

129—Support idle pulley for Timing Belt Conveyor (1023R)

170—Alignment slots or grooves configured for aligning PVC (1007) with respective channels of a section inside AVM (not shown), configured for accepting PVC (1007)

1007—Portable Vending Cartridge (PVC) configured with synchronized dual belt single track motorized conveyor timing belt assembly (1023) with embedded carrier support bearing assemblies (1028)

1232—Section, which is configured to thermally isolate the motor drive components; (99), (100) from the section of PVC (1007), which in turn, is configured to sustain medications (not shown for simplicity) inside Carriers (60) within specification environment, including low and high temperatures. This section can be also configured for isolation of noise coming out from the motor components. Other components, as required per their specifications, will be also thermally isolated.

Figure 13:
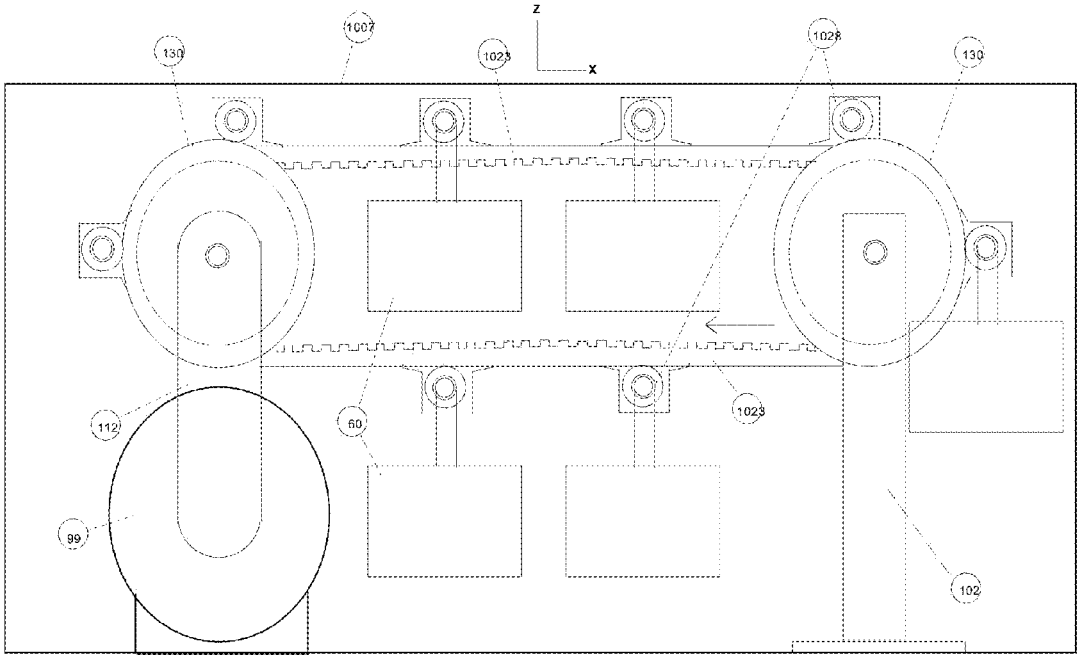

FIG. 13—illustrates Z-X view of PVC (1007) layout configured with dual motorized conveyor timing belt assembly (1023) with embedded carrier support bearing assemblies (1028) for horizontal indexing. Both pulleys are labeled (130), and supported by bracket (102). Remaining elements labeled same as FIG. 11.

Figure 14:
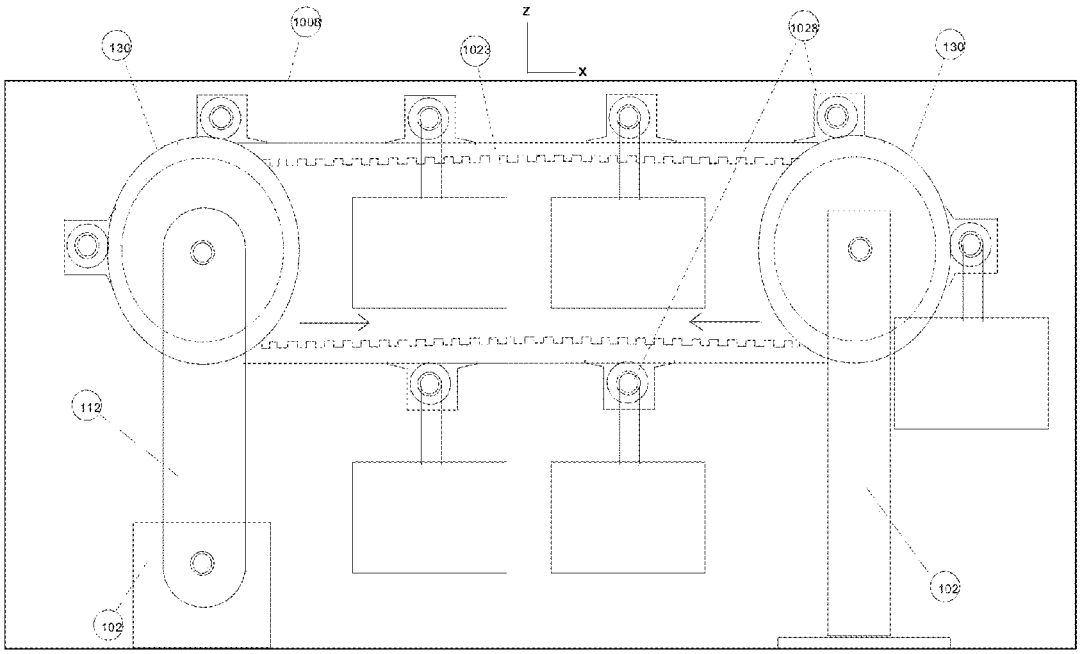

FIG. 14—illustrates Z-X view of PVC (1008) layout configured with non-motorized conveyor timing belt assembly (1023) with embedded carrier support bearing assemblies (1023) aligned for horizontal indexing.

Remaining elements are labeled same as on FIG. 9 and FIG. 13.

Figure 15:
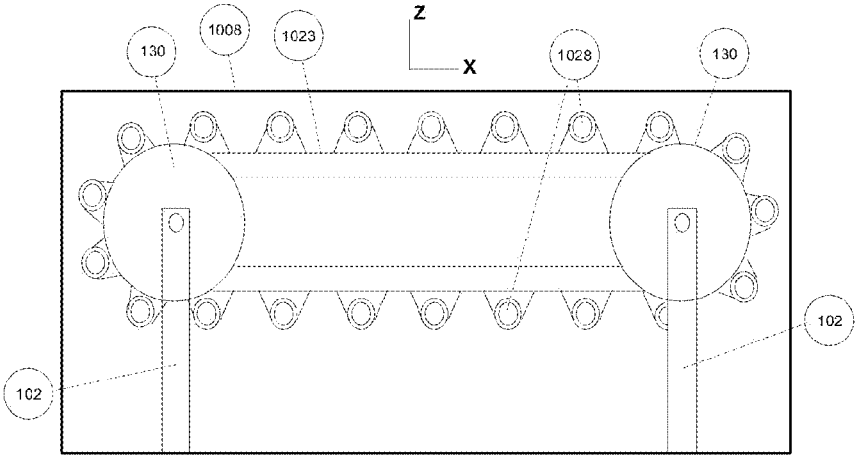

FIG. 15—illustrates Z-X diagram of PVC (1008) with non-motorized conveyor timing belt assembly (1023) with embedded carrier support bearing assemblies (1028) aligned for horizontal indexing. Figure elements are labeled same as on FIG. 14.

Figure 16:
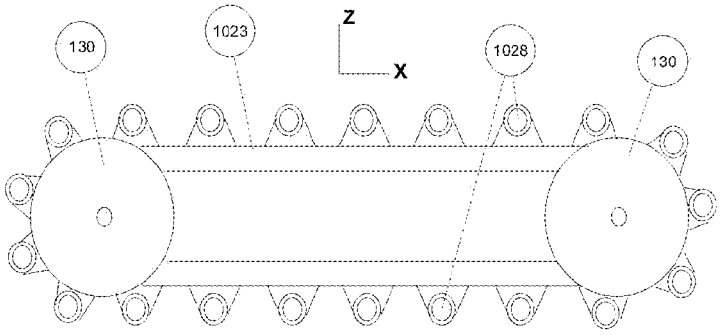

FIG. 16—illustrates Z-X diagram view of conveyor timing belt assembly (1023) configured with embedded carrier support bearing assemblies (1028) horizontal indexing. Figure elements labeled same as on FIG. 14.

Figure 17:
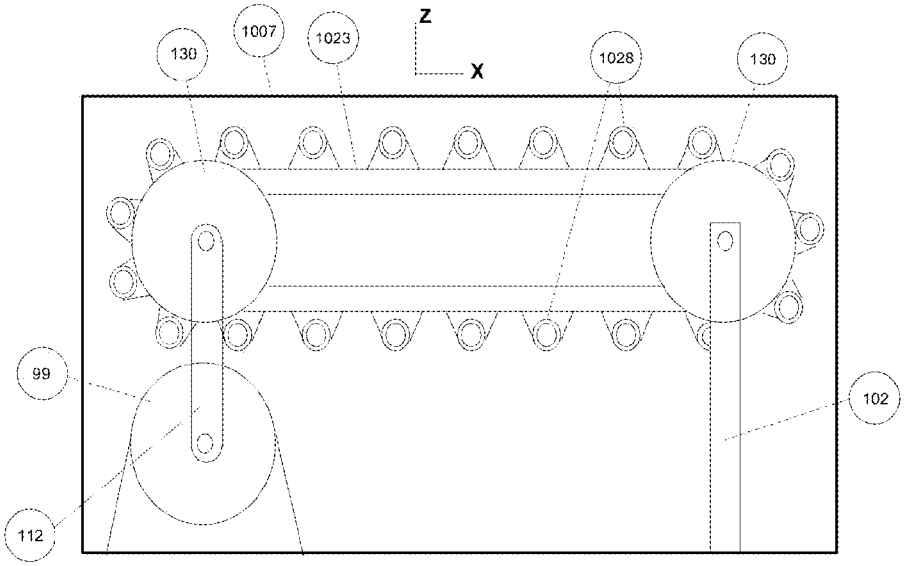

FIG. 17—illustrates Z-X diagram of PVC (1007) configured with motorized conveyor timing belt assembly (1023) with embedded carrier support bearing assemblies (1028) aligned for horizontal indexing. Figure elements are labeled same as on FIG. 13.

Figure 18:
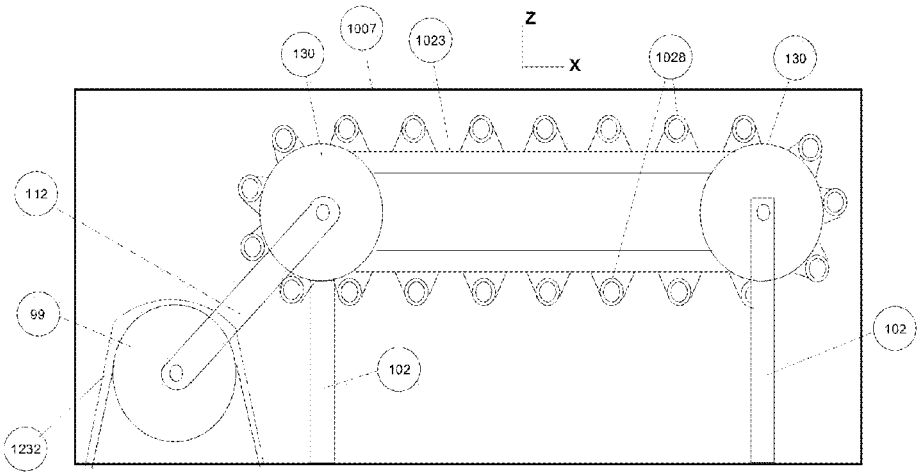

FIG. 18—illustrates Z-X diagram view of Portable Vending Cartridge (PVC) (1007) configured with thermally insulated section (1232) to contain motor assembly (99). Figure elements are labeled as follows:

99—Conveyor drive motor assembly, which is moved to the side away from the Conveyor (1023) with Carriers (not shown), and thermally insulated within section (1232) from Carriers and other components

1232—Section, which is used to thermally isolate the motor assembly (99) from the section where Carriers (not shown for simplicity) with medications inside must be maintained at specification temperatures, including low and high temperatures. This section can be also used to isolate the noise coming out from the motor components. Other components, as required per their specifications, will be also thermally isolated.

Remaining elements are labeled same as on FIG. 17.

Figure 19:
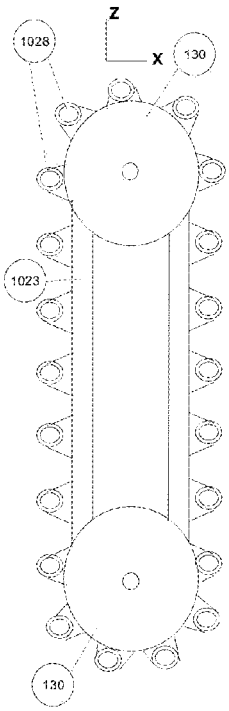

FIG. 19—illustrates Z-X diagram view of conveyor timing belt assembly (1023) configured with embedded carrier support bearing assemblies for vertical indexing. Figure elements are labeled same as on FIG. 16.

Figure 20:
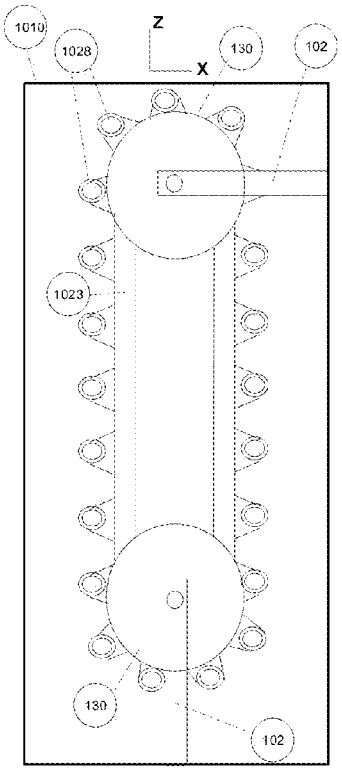

FIG. 20—illustrates Z-X diagram view of Portable Vending Cartridge (1010) configured with non-motorized conveyor timing belt assembly (1023) with embedded carrier support bearing assemblies (1028) aligned for vertical indexing. Figure elements are labeled same as on FIG. 19.

Figure 21:
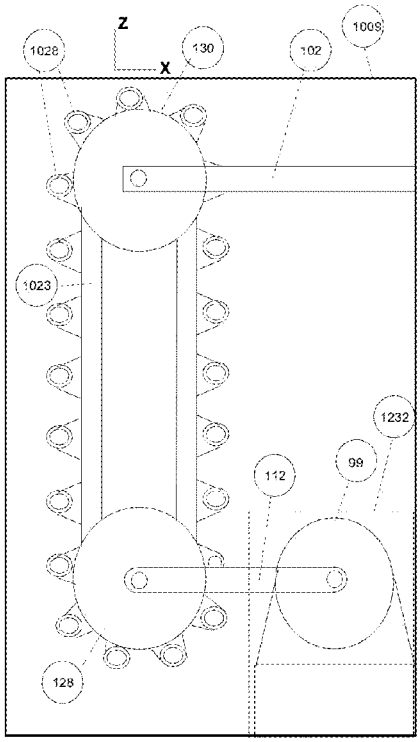

FIG. 21—illustrates Z-X diagram view of Portable Vending Cartridge (1009) configured with thermally insulated motorized section (1232) from the conveyor timing belt assembly (1023) with embedded carrier support bearing assemblies aligned for vertical indexing. Figure elements are labeled as follows:

1232—Section, which is used to thermally isolate the motor assembly (99) from the section where Carriers (not shown for simplicity) with medications inside must be maintained at specification temperatures, including low and high temperatures. This section can be also used to isolate the noise coming out from the motor components. Other components, as required per their specifications, will be also thermally isolated.

Remaining elements are labeled same as on FIG. 20.

Figure 22:
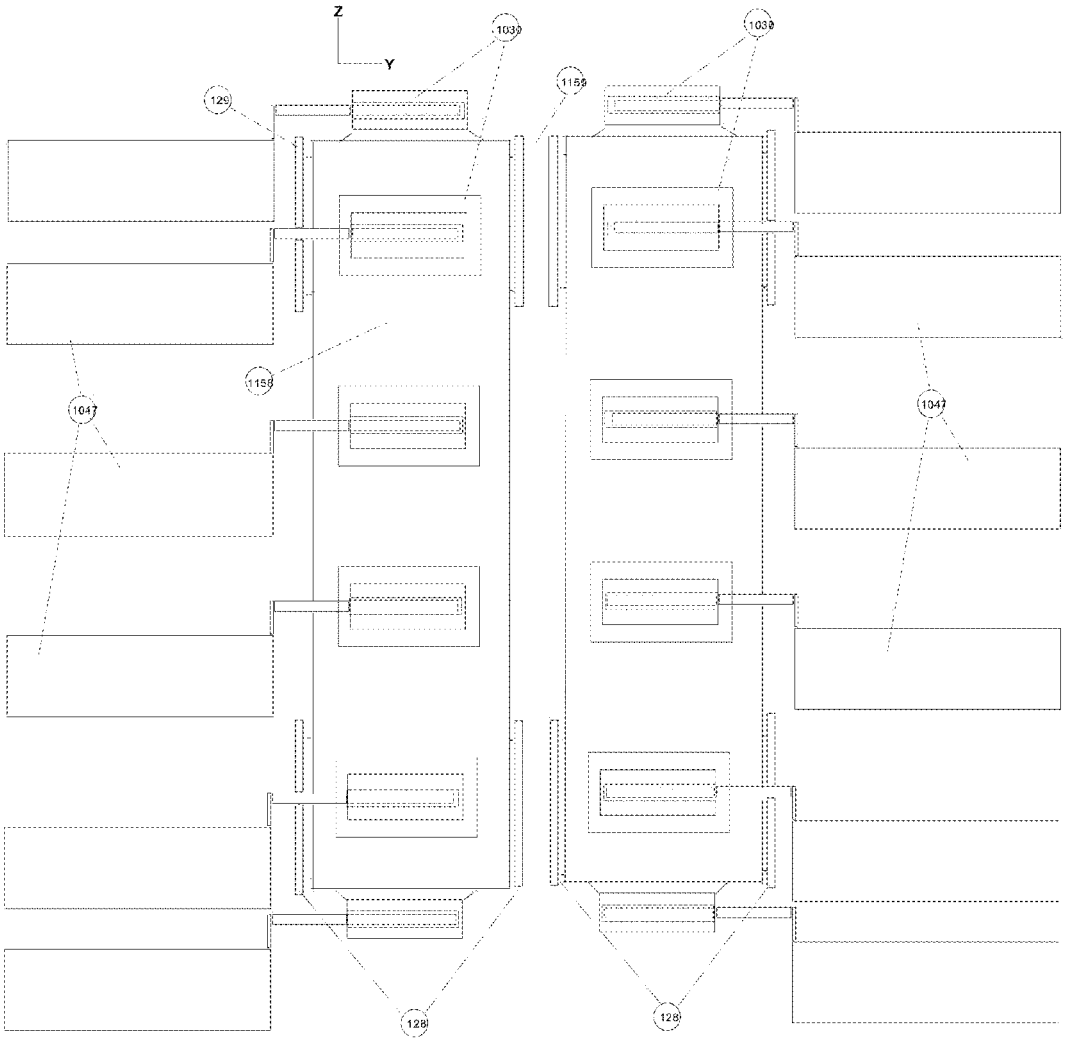

FIG. 22—illustrates Z-Y view of dual motorized conveyor timing belt assembly (1158) configured with embedded closed type carrier support bearing assemblies (1030) without side guide rollers aligned for vertical indexing in support of a dual track. Figure elements are labeled as follows:

60—Carriers suspended from the Carrier Support Bearing assemblies (1030)

128—Support drive pulley for Timing Belt Conveyor (1158)

129—Support idle pulley for Timing Belt Conveyor (1158)

1047—Carrier assemblies with only one shaft supported from embedded bearing assemblies (1030) of the conveyor belt assembly (1158). These Carriers are configured for handling light weight items

1159—Space in-between conveyor assemblies available for providing required additional components, including: drive motor, supports brackets for conveyors, etc.

Figure 23:
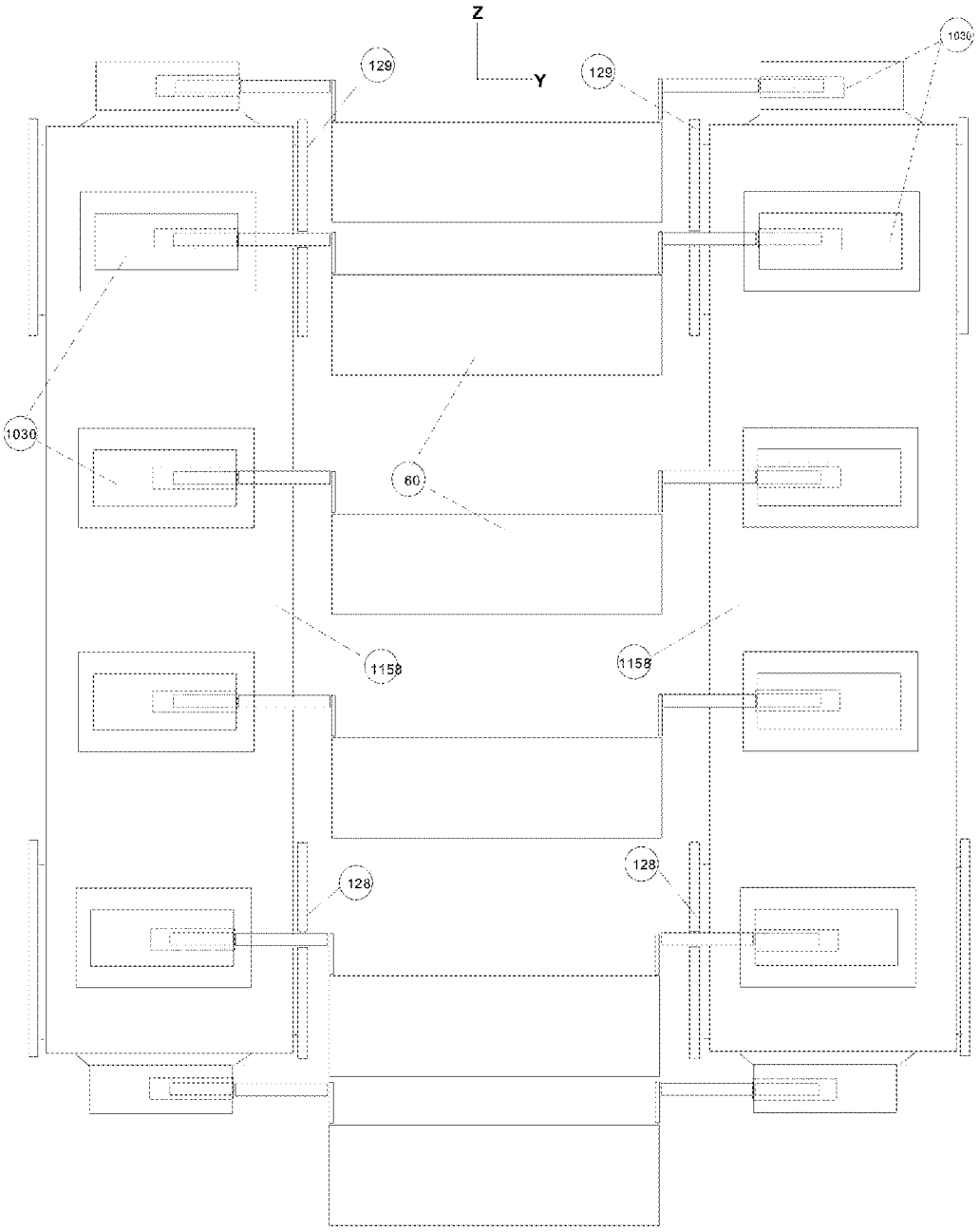

FIG. 23—illustrates Z-Y view of motorized synchronized dual conveyor single track timing belt assemblies (1158) configured with embedded closed type carrier support bearing assemblies (1030 aligned for vertical indexing in support of single track. Figure elements are labeled as follows:

60—Carrier assemblies with support shaft from each side, inserted into embedded bearing assemblies (1030) of the conveyor belt assemblies (1158). Remaining elements are labeled same as on FIG. 22.

Figure 24:
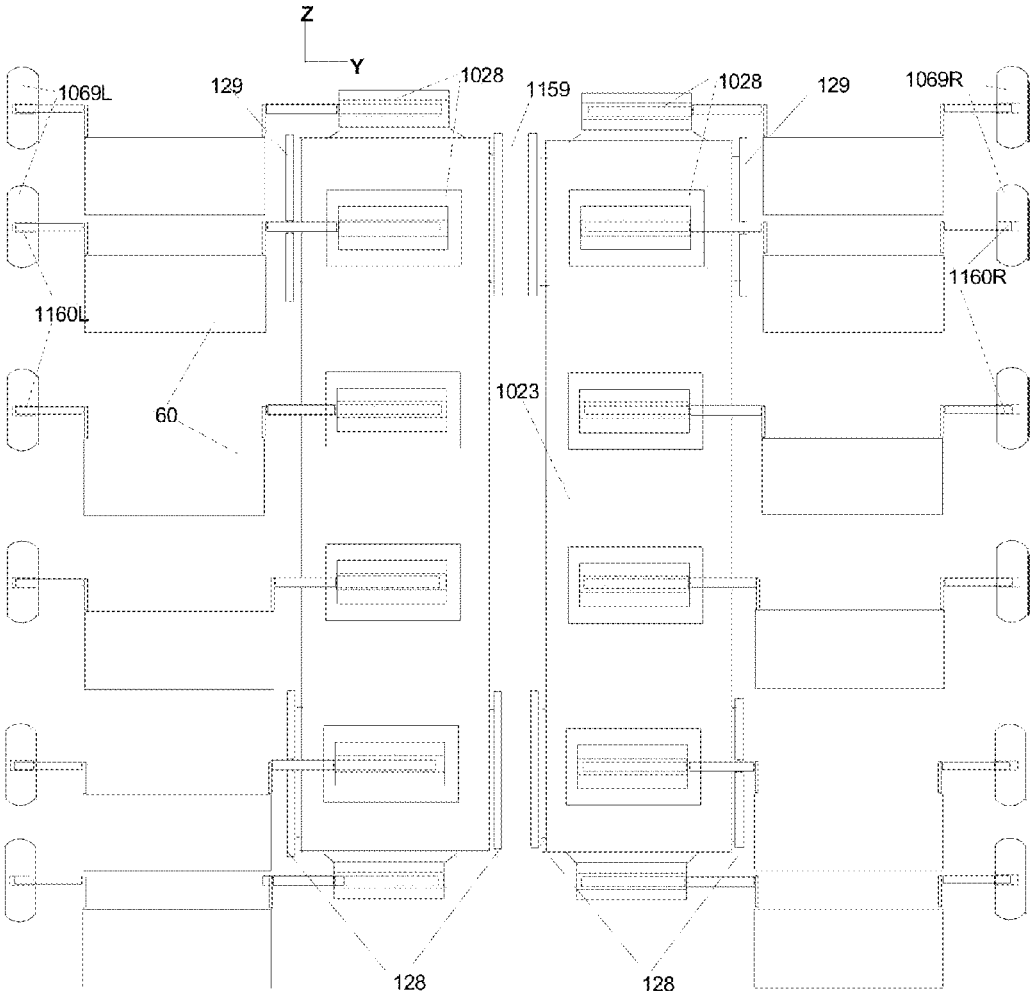

FIG. 24—illustrates Z-Y view of motorized synchronized dual conveyor timing belt assemblies (1158) configured with embedded carrier support bearing assemblies (1028) with side guide roller assembly (1069) aligned for vertical indexing in support of dual track. Figure elements are labeled as follows:

60—Carrier assemblies with support shaft (1160) inserted into roller (1069) on one side and with support shaft from the other side inserted into embedded bearing assemblies (1028) of the conveyor belt assemblies (1023). Remaining elements are labeled same as on FIG. 22.

Figure 25:
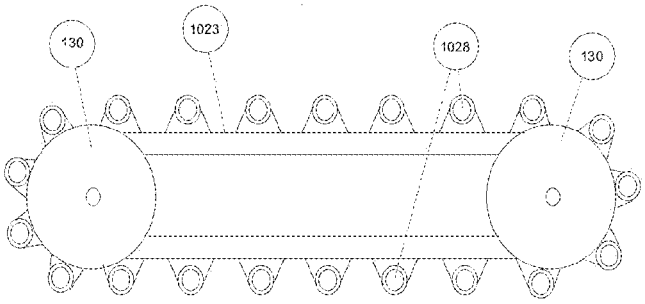

FIG. 25—illustrates Z-X diagram of conveyor timing belt assembly (1023) configured with embedded carrier support bearing assemblies (1028) aligned for horizontal indexing, and supported by two pulleys (130).

Figure 26:
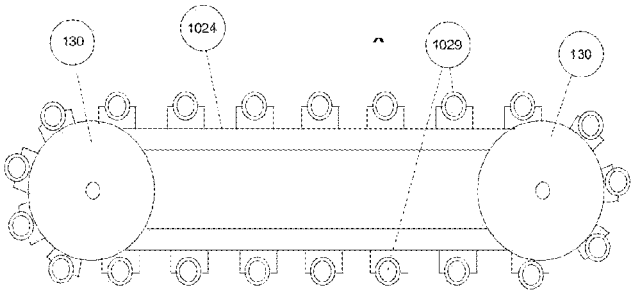

FIG. 26—illustrates Z-X diagram of conveyor timing belt assembly (1024) configured with insertable carrier support bearing assemblies (1029) aligned for horizontal indexing, and supported by two pulleys (130).

Figure 27:
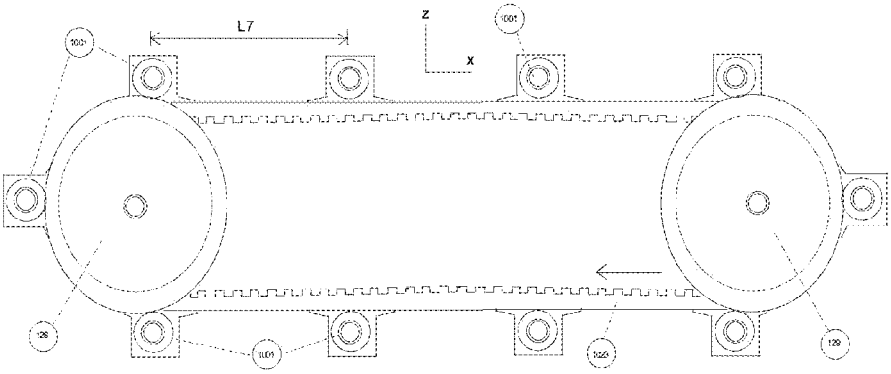

FIG. 27—illustrates Z-X diagram of conveyor timing belt assembly (1023) with embedded carrier support bearing assemblies (1001) aligned for horizontal indexing, and supported by one drive pulley (128) and one idle pulley (129). Index between carriers (not shown for simplicity) is indicated by L7.

Figure 28:
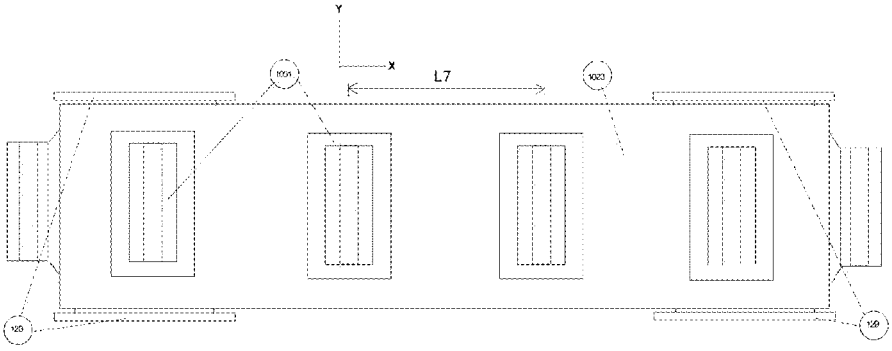

FIG. 28—illustrates X-Y diagram of conveyor timing belt assembly (1023) shown on FIG. 27.

Figure 29:
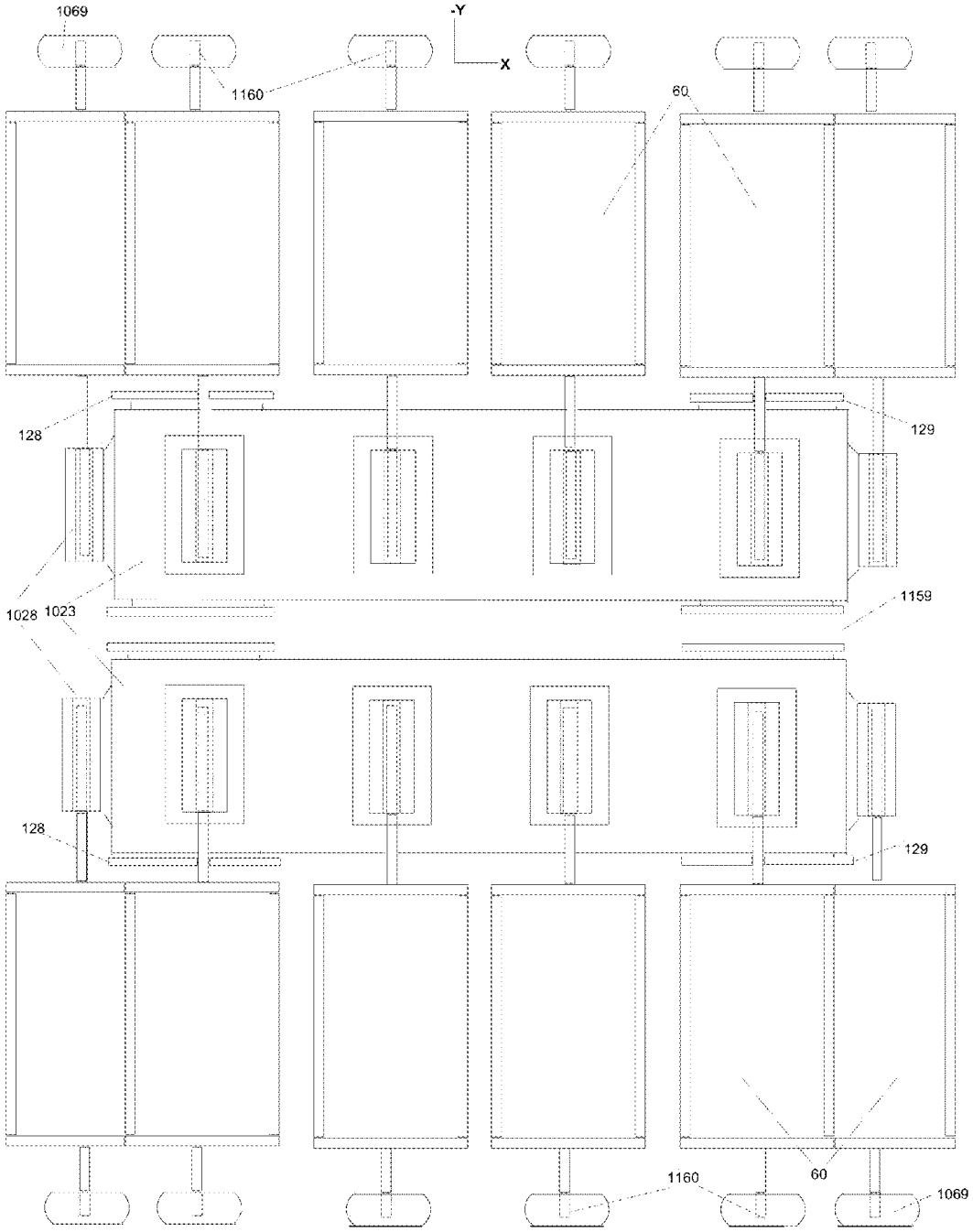

FIG. 29—illustrates Z-Y view of motorized conveyor timing belt assemblies (1023) configured with embedded carrier support bearing assemblies (1028) with side guide rollers (1069) aligned for horizontal indexing in support of a dual track. For simplicity—guiding rails for rollers (1069) are not shown. Figure elements are labeled as follows:

60—Carrier assemblies configured with support shaft from each side, with the shaft on one side supported from embedded bearing assemblies (1028) of the conveyor belt assemblies (1023), and the shaft (1160) from the opposite side of the carries (60) supported from the bearing embedded into the roller (1069).

128—Support drive pulley for Timing Belt Conveyor (1023)

129—Support idle pulley for Timing Belt Conveyor (1023)

1159—Space in-between conveyor assemblies available for providing required additional components, including: drive motor, supports brackets for conveyors, etc.

Figure 30:
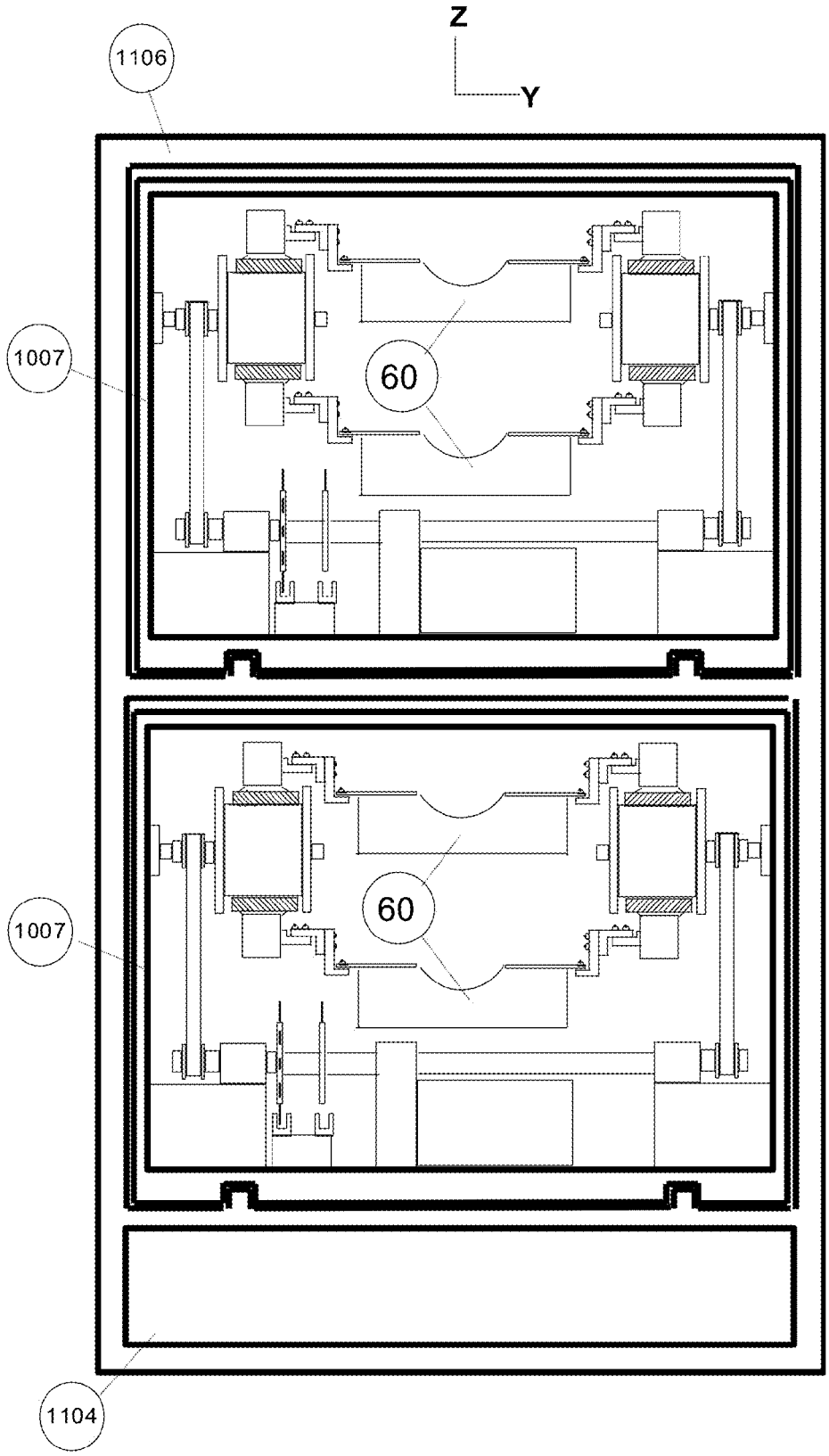

FIG. 30—illustrates Z-Y view of AVM (1106) configured with two sections, each configured with installed PVC (1007). AVM units, such as (1106), can be configured with variety of features described in this application. AVM dimensions are configured to support required or selected number and type of PVC's, plus all required standard and optional components or features: controller interface; loading/unloading of PVC's; power distribution and control section; environmentally controlled section. AVM layout is configured in support of: required or selected PVC modules; mating with respective PVC modules; support of PVC's type (horizontal index, vertical index, combination of both). Supporting PVC layouts: bottom-up; side-by-side; or combination of both. Support of Provider and Customer functions, including: interface electronics; handling of dispensed Containers; single independent or multiple synchronized indexing of conveyor(s) inside each PVC; single independent or multiple synchronized dispensing of Containers from each PVC for required service rate. Exterior panelizing for required functionality and esthetics. Mating with insertion and removal of PVCs; round edges for safety. Support for automated: loading and unloading of Containers in/from selected PVC's; packing dispensed Containers. For portable applications, AVM can be configured to have access only from one side—Customer, for loading/unloading PVC in/out of AVM, as well as for receiving dispensed medications. Example: AVM-80, which can have a swing-door facing the Customer with keyed access, allowing Customer to load/unload PVC when door is open, and then receive dispensed medications when door is closed and locked. AVM materials are configured to meet strength requirements in support of: all components mounted inside; minimize overall weight of AVM; longevity requirements. Selection can include: plastic, metal or combination of both. AVM type is configured for indoor mount or outdoors, and based on capacity requirements. Standard and optional components: central control or distributed controls (multiple controllers); interface electronics within AVM to controllers outside (interface wired, wireless); power supply; battery; user interface; sensors; environmental controls. AVM is configured to provide required interface for PVC, including: support of various PVC inter-lockable slide-able insertion methods from most convenient side of AVM: back, front, top, bottom, left, right. Mechanical and electrical plug-able features: slide, channels, groves, interface connectors. AVM configurations can include any combination of static conveyors and PVC units installed inside. Static conveyors can be configured for vertical index along the perimeter of AVM, while PVC's are loaded inside the sections surrounded by the static conveyors. This significantly improves utilization of space and rate of service, by providing an ability to dispense items from various pick-up pockets at selected sides of AVM to several independent customers ay once. AVM user interface is configured for each application, and can include verification of identification parameters entered directly via controller interface or indirectly via electronic identification devices, which include the one described by the applicant in the provisional application No. 61,404,475 "Apparatus for analyzing and controlling object behavior, item transactions, using a card with embedded mechanical, electronic and barcode identifications" on file with the UPSTO. AVM diagnostics are configured for each application, and include: illuminated signage; status lights such as LED, audio, which are described by the applicant in the non-provisional application No. 12,221,337 "Low-cost Illumination Device" in-progress of being issued a patent by the USPTO; status of safety sensors; environmental sensors. AVM controls are configured to include: operation of each PVC installed; operation of each static conveyor installed; interface to other controllers; user interfaces (provider, customer); self-diagnostics; sensors (action, environment, safety); environment control devices; actuators in support of all operations; interface to LAN wired, wireless, internet. AVM Control Algorithm is based on control software residing inside AVM controller, which is configured per ADVSP Configuration Parameters, and will assist other ADVSP controllers to ensure most optimum utilization of available resources to achieve the highest quality and productivity. Examples: selected PVC's inside AVM can be controlled to execute a specific process control operation over items stored inside PVC's, while other PVC's can be used for dispensing items to authorized customers; start of conveyors inside each PVC will be executed with a small delay to minimize power pick demands; dispensing of items out of any PVC can take place when there is no conveyor motion at any PVC inside AVM—to minimize vibrations. Figure elements are labeled as follows:

1104—Available space inside AVM (1106) which can be used for installation of components such as:

Controllers, PSU, LAN interfaces, USB interfaces, environmental controllers, etc.

Figure 31:
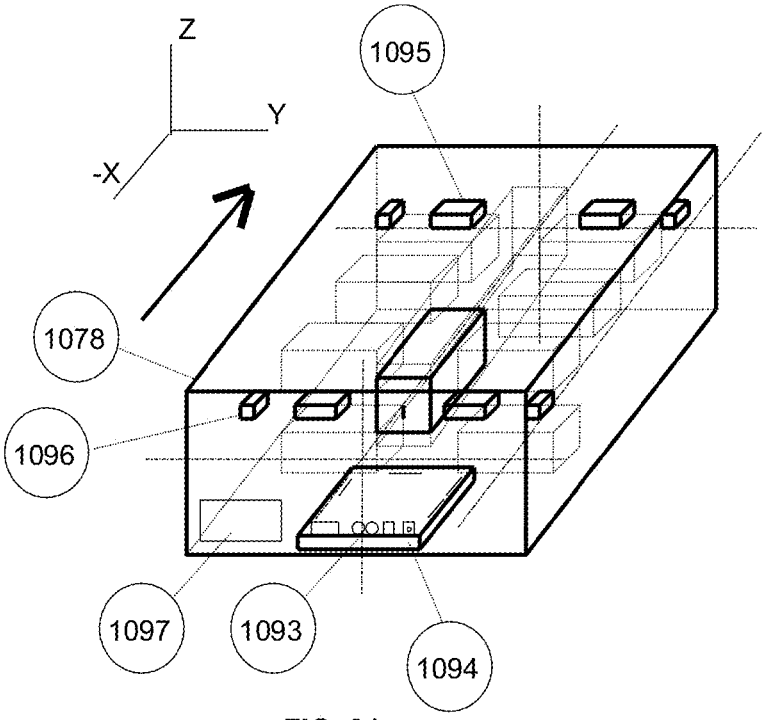

FIG. 31—illustrates X-Y-Z view of PVC (1078) such as PVC-40 (total carrier capacity is equal 40) configured with motorized conveyor timing belt assemblies (1023) shown on FIG. 29. Figure elements labeled as follows:

1093—Diagnostics, user interface components—located on the Controller PC-board 1094

1094—Controller PC board configured to contain required control and interface electronics, including: non-volatile memory, battery, etc. Controller will perform control functions, including: monitor if security panels are installed; monitor sensors reporting environment inside PVC, temperature, humidity, etc.; control other devices installed in the PVC—conveyor, barcode reader, etc.; interface via LAN to other controllers; user diagnostics and interface. Rechargeable battery will be charged via USB port of the PVC Controller, when the USB port of the PVC Controller is connected to USB port of the ADVS Host Controller or AVM Controller.

1095—Barcode reading device

1096—Sensor for detecting position of the Conveyor (1023) inside (1078)

1097—Barcode label with information related to PVC (1078)

Figure 32:
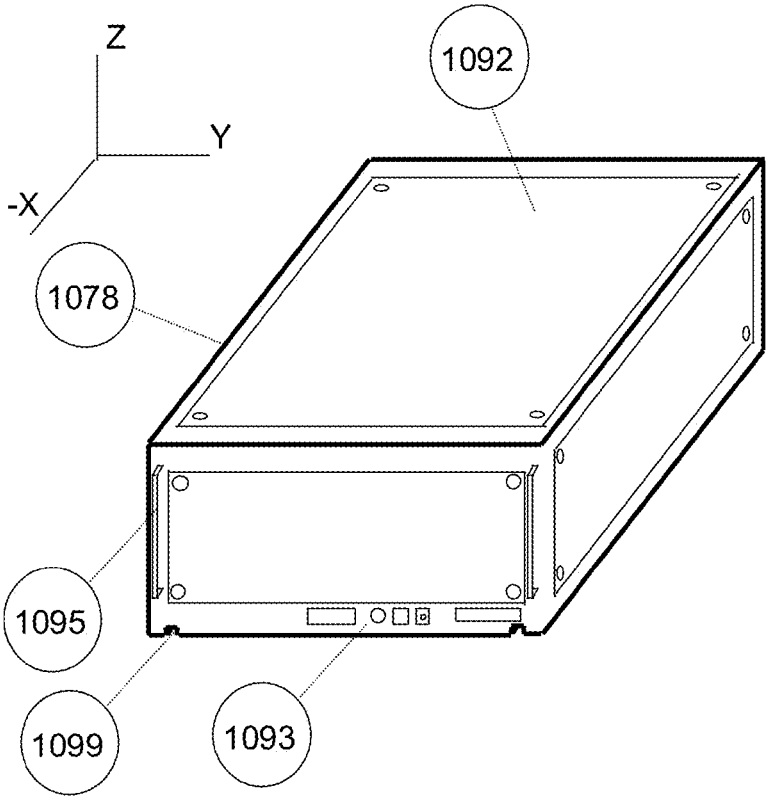

FIG. 32—illustrates X-Y-Z view of assembled PVC (1078), such as PVC-40 shown on FIG. 31, configured with installed cover panels (1092). Figure elements are labeled as follows:

1099—Alignment slot for PVC (1078) to match with respective alignment channel inside AVM Remaining components are labeled same as on FIG. 31

Figure 33:
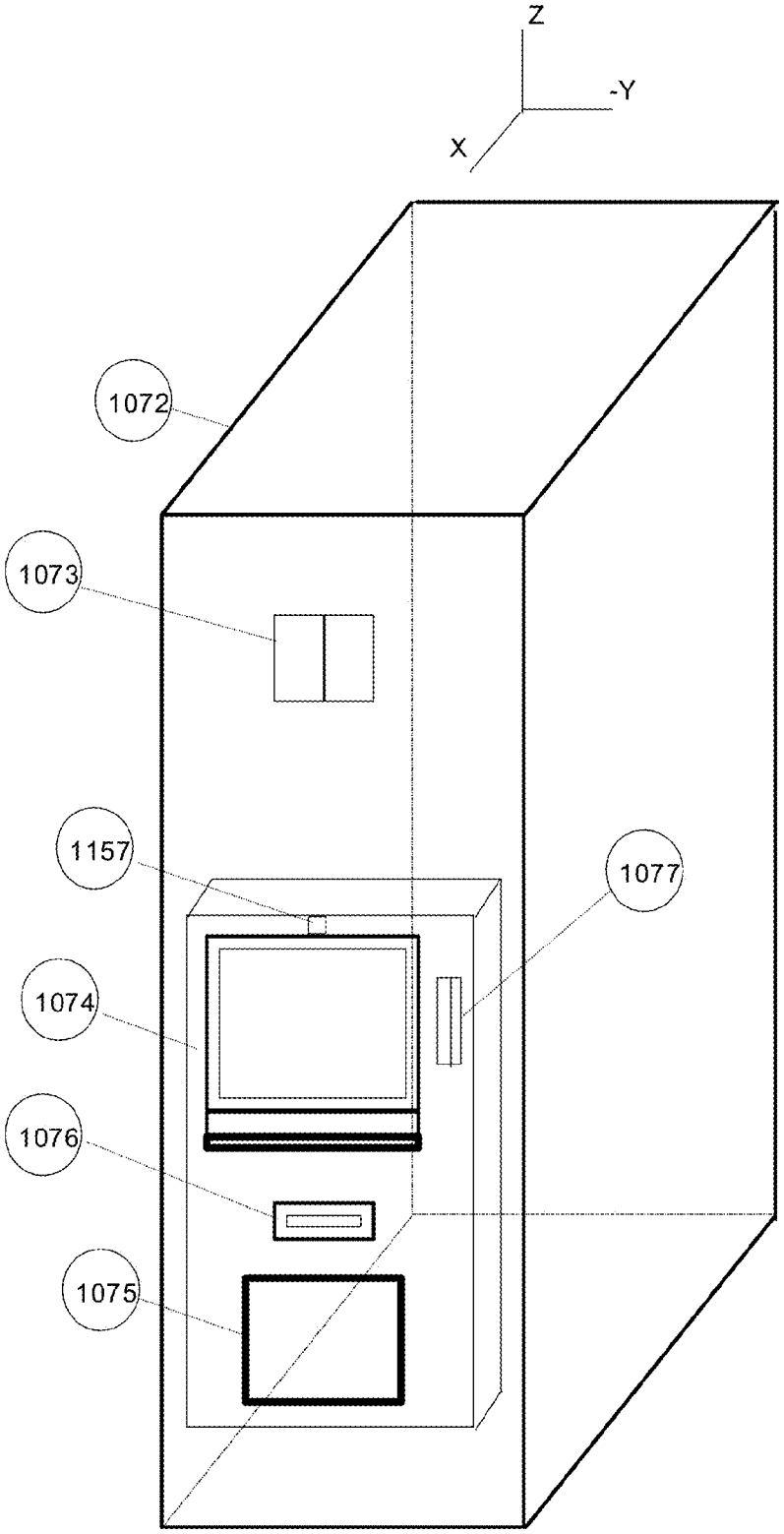

FIG. 33—illustrates X-Y-Z Customer view of assembled AVM (1072), such as AVM-200 (total carrier capacity is equal 200). Figure elements are labeled as follows:

1073—AVM status and identification component, such as back-light LED signage.

1074—Customer interface panel, which can be configured based on variety of computer accessories, such as: touch-screen LCD, LCD display, keypad or keyboard, etc.

1075—Dispensed item pick-up bin

1076—Printer print-out window

1077—Payment processing/authorization device, such as MCR, MSR, etc.

1157—Security camera

Figure 34:
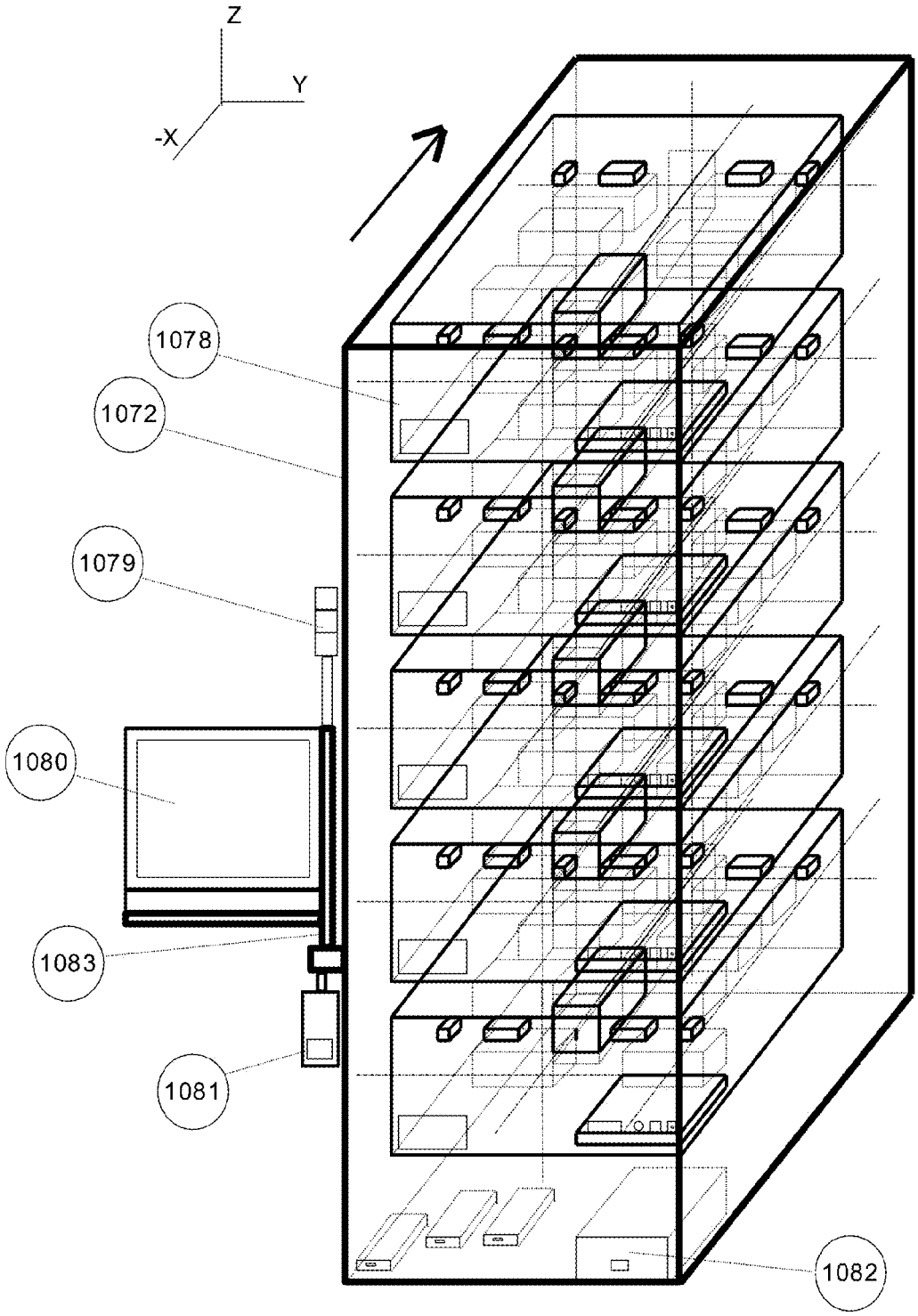

FIG. 34—illustrates X-Y-Z Provider view of assembly details of AVM (1072), such as AVM-200, which is configured to accept qty. 5 of PVC's, such as PVC-40. Variety of ADVSP configurations including complete real-time, independent of operator, closed loop control of all process steps by controller. 100% guaranteed quality of prescription medications is accomplished initially by using ADVSP Controller and components:

a) Once prescription is entered by Provider, ADVSP Controller will identify: respective container to store the prescription based on medication specifications (solid or liquid, temperature, humidity, unit weight, total weight) (size, weight, capacity); and calculate the expected combined weight of the container with correct amount of medication inside selected container b) Provider will follow directions from ADVSP Controller and will select appropriate container for storing medications c) Provider using ADVSP components will measure weight and size of the container with filled prescription medication, and ADVSP Controller will perform initial validation if these parameters to match the respective specification, and will record the validated information under prescription barcode label code, attached to the container with medications Then, while within ADVSP, each container with medication inside, will be periodically inspected for verification of: weight, size of the container to match the barcode label on the container. ADVSP components, such as Portable Vending Cartridges (PVC), Automatic Vending Modules (AVM) will have:

1) Barcode readers, configured to be located at required inspection points, including: entry, transfer in-between sub-assemblies, prior-to-dispense (final verification);

2) Weight measuring scales, which can be configured to measure the weight of: each container individually, conveyor assembly with carriers, transfer sub-assemblies;

3) Size measuring devices (optical, etc.), which can be configured to measure the size of: each container as it passes check points along the conveyor assembly, at transfer points in-between sub-assemblies.

The ADVSP Controller objective is to monitor specifications parameters of the container with medications per information stored by ADVSP Controller based on barcode label attached to the container, and ensure it is maintained within specifications prior to dispensing to authorized Customer. The containers, which failed inspection, will be rejected by ADVSP Controller, and as configured by Provider—will be dispensed directly back to the Provider. AVM can be configuration to dispense containers to authorized Customer on one end and in-parallel simultaneously dispense containers to Provider on the opposite end. Loading of items into carriers inside each PVC can be accomplished remotely at a centralized pharmacy location, and then loaded PVC transported to destination pharmacy or kiosk to be inserted into respective AVM. Loading of items into carriers inside each PVC can be also accomplished on-site by an operator from the Provider side when an empty carrier is located in position accessible by Provider. Figure elements are labeled as follows:

1078—PVC. As shown—qty. 5 of PVC's (such as PVC-40) are installed into AVM (1072) to create AVM-200

1079—Status indicator for AVM-200

1080—Provider interface controller for AVM-200

1081—Barcode scanner device

1082—PSU component for AVM-200, which is configured to power all electronics inside AVM-200

Figure 35:
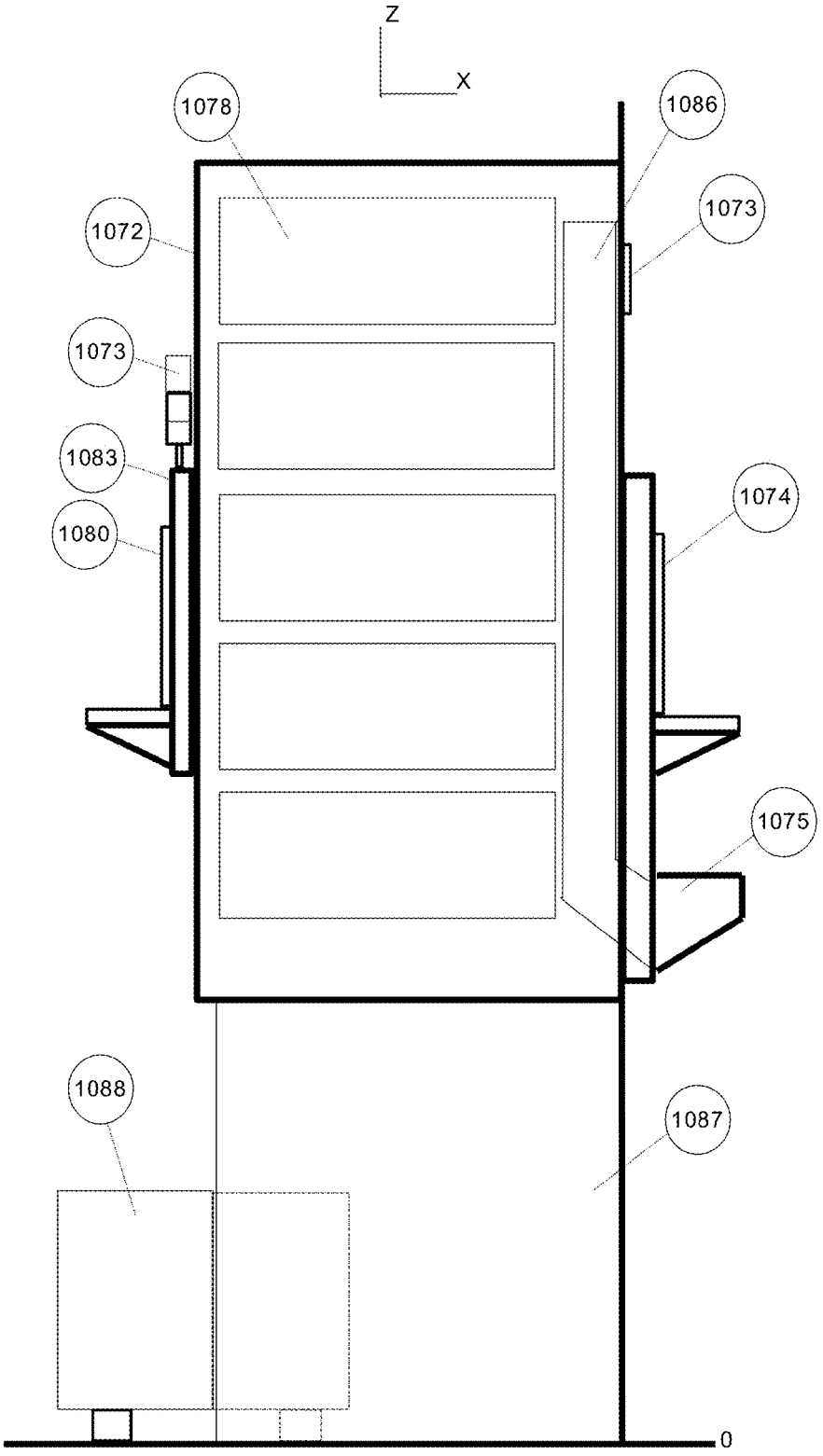

1083—Mounting platform which can be configured to rotate around Z-axis to allow access to AVM-200 from the Provider side FIG. 35—illustrates Z-X view of assembled AVM (1072), such as AVM-200, shown on FIG. 34, which is installed on a pedestal or platform (1087). Figure elements are labeled as follows:

1074—User interface controller, Customer side

1075—Item pick-up bin

1086—Item dispensing and delivering tunnel. Items dispensed from each PVC-40 inside AVM-200 are entering the tunnel and then roll down to the pick-up bin (1075)

1087—Adjustable vertically mounting platform for AVM (1072)

1088—Pull-out, or roll-out stand to assist Provider in convenient accessing PVC-40 installed inside AVM-200

Remaining elements are labeled same as on FIG. 34

Figure 36:
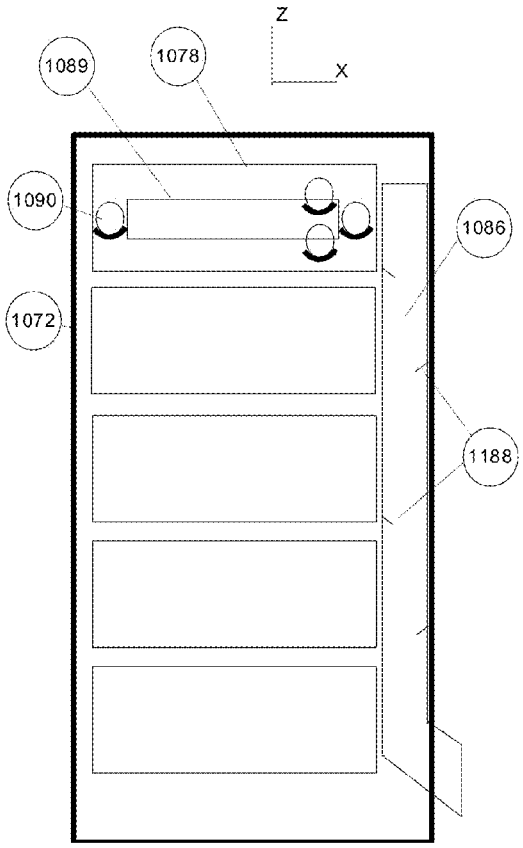

FIG. 36—illustrates Z-X diagram view of position of some of carriers inside AVM (1072), such as AVM-200, shown on FIG. 34. Loading of items into carriers inside each PVC can be accomplished remotely at a centralized pharmacy location, and then loaded PVC transported to destination pharmacy or kiosk to be inserted into respective AVM. Loading of items into carriers inside each PVC can be also accomplished on-site by an operator from the Provider side when a carrier is located in position (1090). As shown, the indexing of Conveyor (1089) inside each PVC (1078) can be configured to simultaneously align one loaded carrier on the Customer side for unloading, and one loaded or empty carrier on the opposite Provider side (position 1090) for either unloading of the item from the carrier, or placing an item into the empty carrier. Figure elements are labeled as follows:

1089—Conveyor configured as a dual synchronized timing Belt assemblies, dual track, support wheels.

Remaining elements labeled same as on FIG. 34

Figure 37:
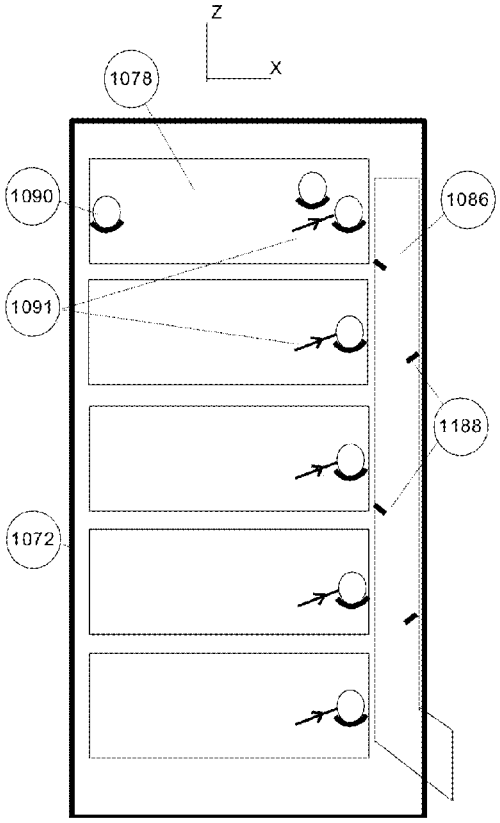

FIG. 37—illustrates Z-X diagram view of position of some of carriers inside AVM (1072), such as AVM-200, shown on FIG. 34, and illustrates one of methods of forcing an item in position (1090) out of a carrier in the unloading position, toward the dispensing tunnel (1086). Figure elements are labeled as follows:

1091—Actuator (solenoid), which when commanded by Controller (not shown) of the AVM (1072) will extend its plunger and engage with item (1090) and force the item (1090) out of a carrier holding the item in the unloading position, toward the dispensing tunnel (1086), which will allow the item to roll-down along the tunnel toward the item pick-up window (1075)

1088—Inserts inside the tunnel (1086) which are configured to control and reduce the speed of items rolling down the tunnel, to prevent impact on items and their content inside.

Remaining elements are labeled same as on FIG. 34

Figure 38:
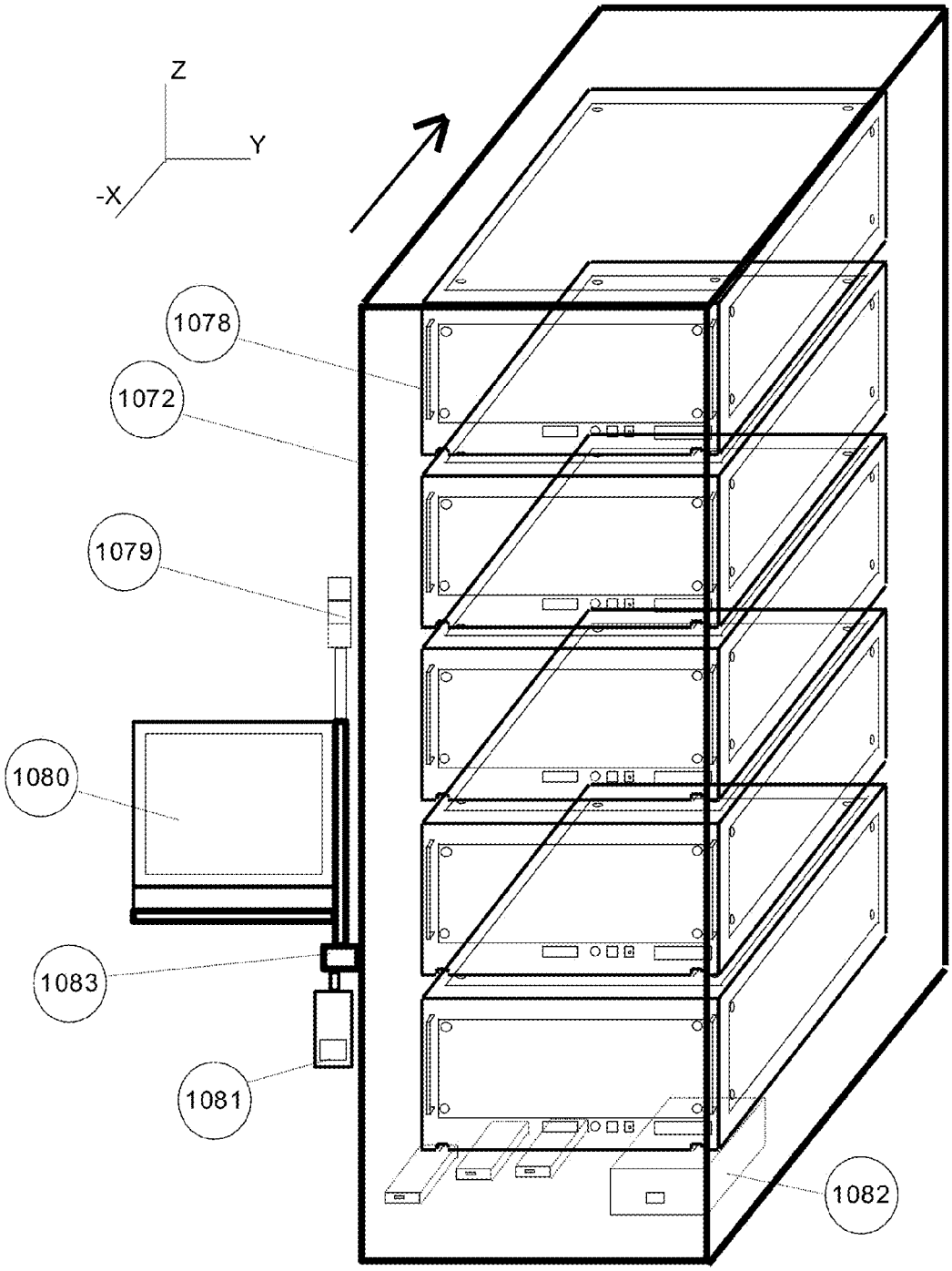

FIG. 38—illustrates X-Y-Z Provider view of assembled AVM (1072), such as AVM-200 shown on FIG. 34, which is configured to accept qty. 5 of PVC-40 (1078). Each PVC-40 shown with all safety panels installed. Prior to operation, at least front and back safety panels are removed. As needed, top and side panels can be removed. Respective panels are removed before PVC (1078) is inserted into the mating slot of AVM (1072). Figure elements are labeled same as on FIG. 34

Figure 39:
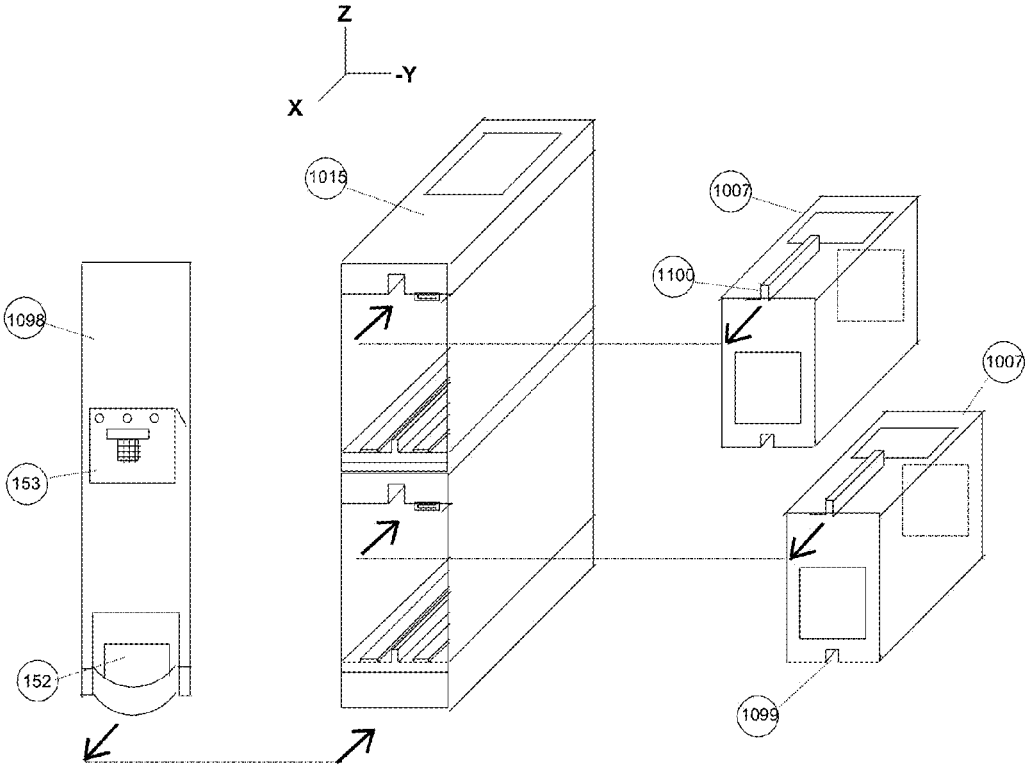

FIG. 39—illustrates X-Y-Z example of assembly details of inserting two PVC units, such as PVC (1007) into mating slots of an outer enclosure component (1015) of AVM. Figure elements are labeled as follows:

152—Dispensed items pick-up bin

153—Operator control interface panel configured similar to ATM type interfaces

1007—Portable Vending Cartridge (PVC) with synchronized dual belt single track motorized conveyor timing belt assembly with embedded open type carrier support bearing assemblies aligned for horizontal indexing

1015—Outer enclosure, as part of an Automatic Vending Module (AVM) configured to accept two PVC (1007)

1098—Cover panel with user interface (153) and item pick-up bin (152)

1099—Alignment slot of PVC (1007) to match with respective alignment channel (1100) inside AVM (1015)

1100—Alignment channel of PVC (1007) to mate with respective alignment groove (1099) of the AVM (1015)

Figure 40:
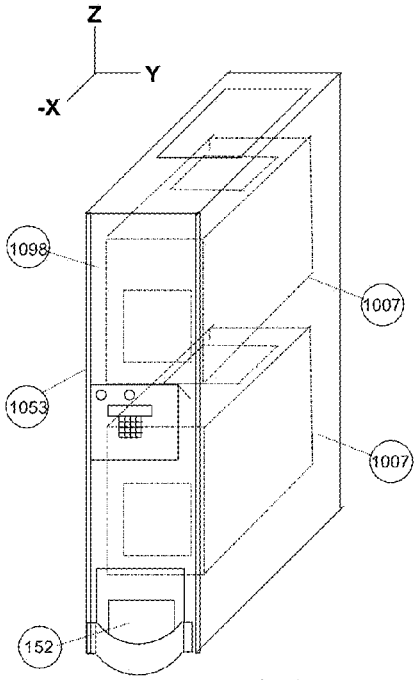

FIG. 40—illustrates X-Y-Z example of AVM (1053) assembled with slide-able two PVC (1007) units inside, as shown on FIG. 39. Remaining elements are labeled same as on FIG. 39

Figure 41:
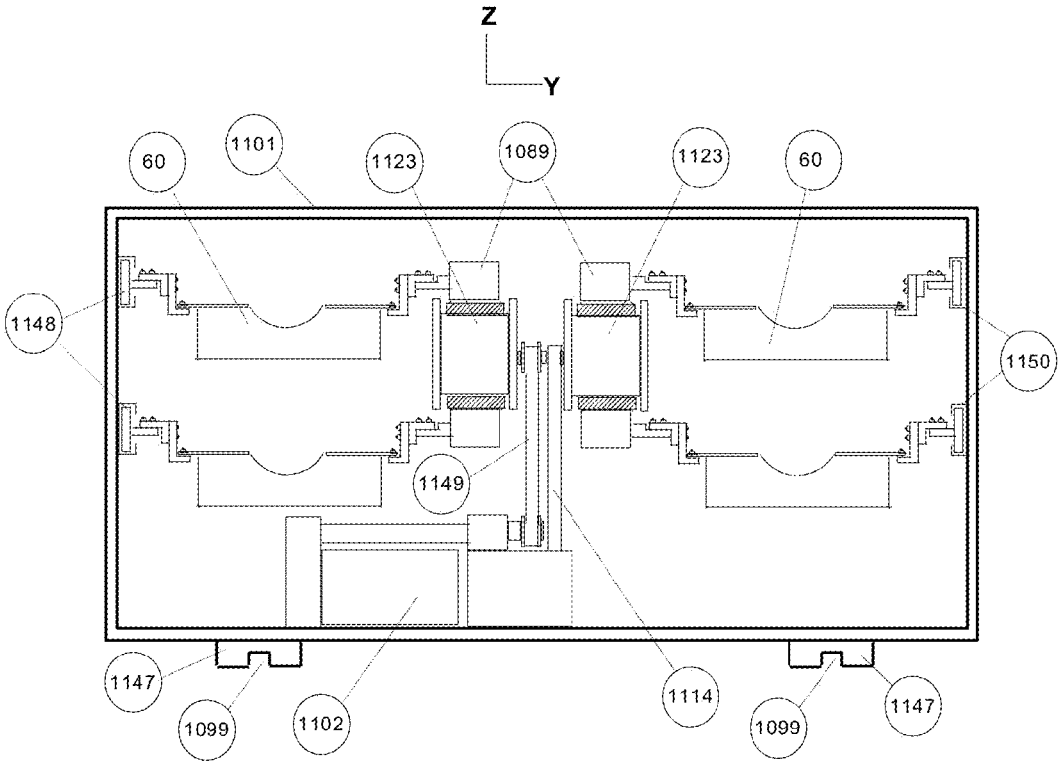

FIG. 41—illustrates Z-Y view of PVC (1101) configured with horizontal dual synchronized conveyor assembly (1123), which is configured for indexing carriers (60) in two synchronized parallel tracks with support wheels (1148) on each side of the Carrier, configured to ride along the Guiding Rails (1150). Figure elements are labeled as follows:

60—Carrier assemblies with support from one side from embedded bearing assemblies (1089) of the conveyor belt assemblies (1123), and from the other side by bearings of the wheels (1148) rolling along the guiding rails (1150).

1149—Drive belt of the main drive (1102) to the shaft of the Dual synchronized Timing Belt assemblies (1123)

1114—Conveyor support bracket

1099—Alignment slot for PVC (1101) configured to match with respective alignment channel inside an AVM

1147—Alignment channel with the alignment slot (1099) attached to PVC (1101)

1102—Motor drive assembly for controlling dual synchronized conveyor assemblies (1123)

Figure 42:
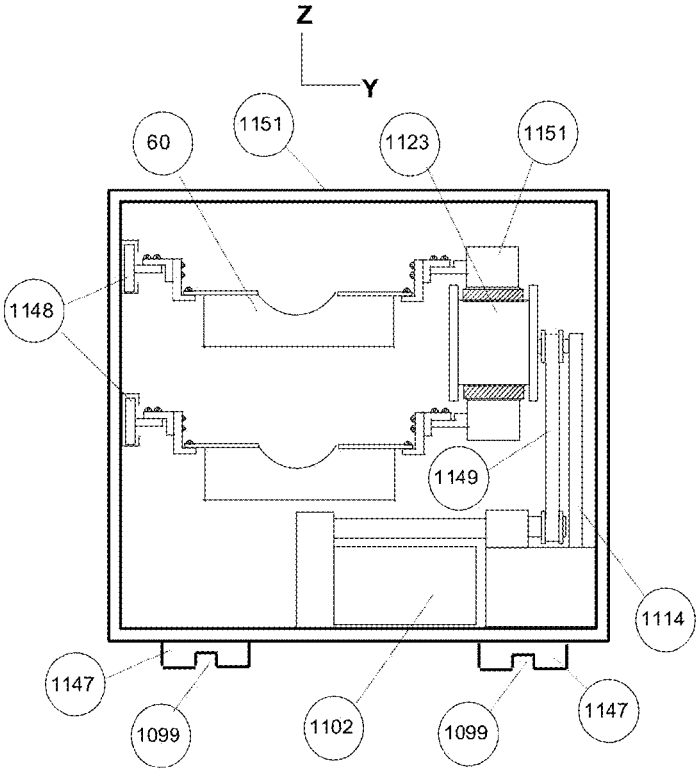

FIG. 42—illustrates Z-Y view of PVC (1151) configured with horizontal conveyor assembly (1123) for indexing carriers (60) in a single track. Remaining elements are labeled same as on FIG. 41

Figure 43:
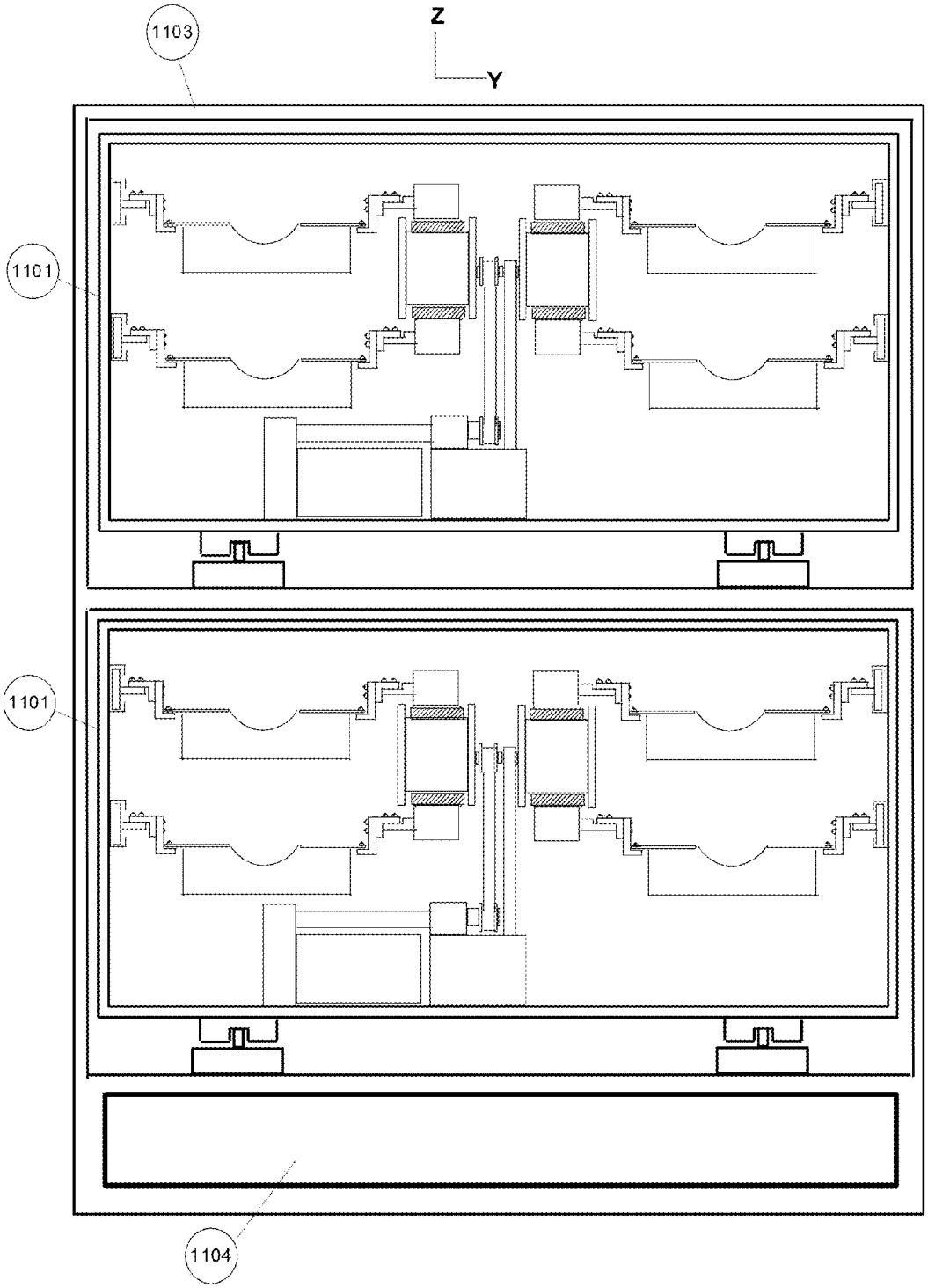

FIG. 43—illustrates Z-Y view of AVM (1103) configured with two PVC (1101) described on FIG. 41. Each PVC (1101) is slideably inserted into respective slot of AVM (1103). Figure elements are labeled as follows:

1104—Available space inside AVM (1103) which can be used for installation of components such as:

Controllers, PSU, LAN interfaces, USB interfaces, environmental controllers, etc.

Figure 44:
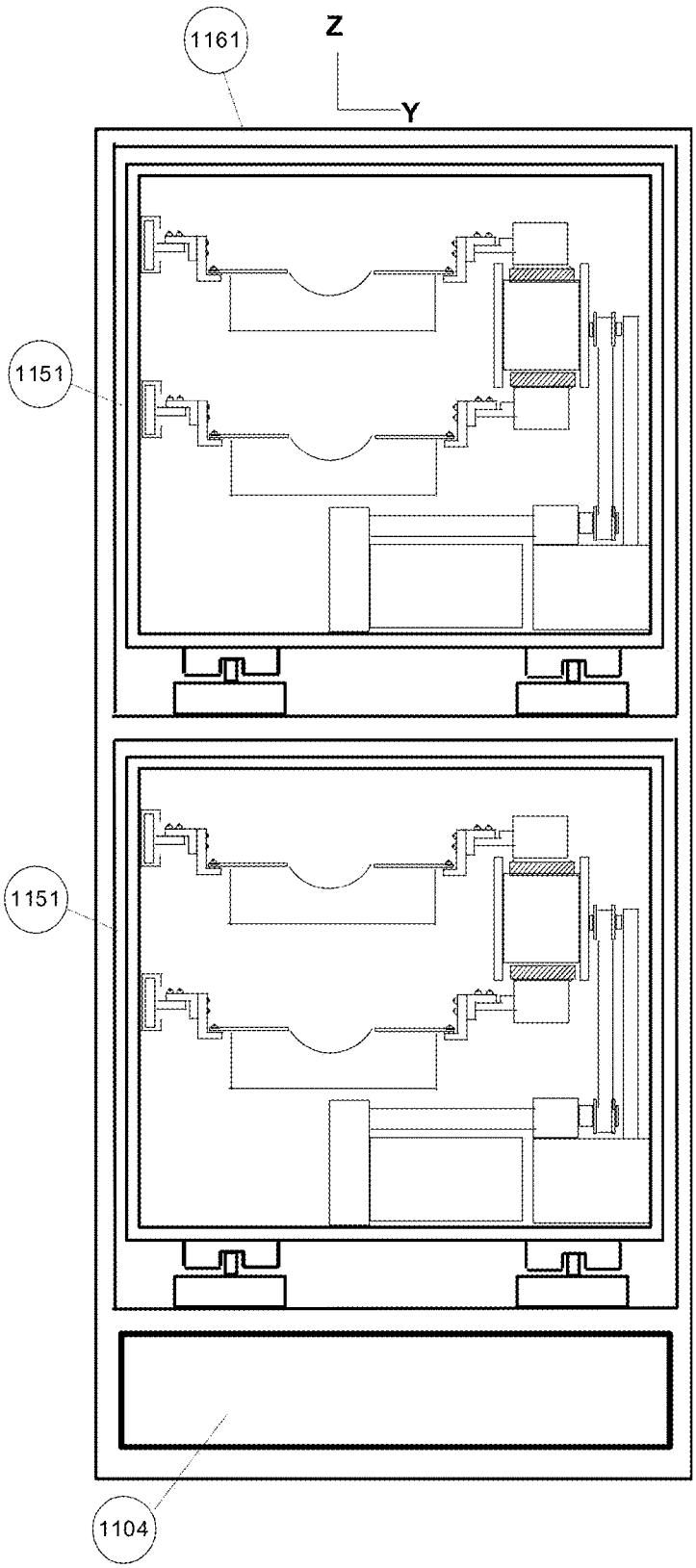

FIG. 44—illustrates Z-Y view of AVM (1161) configured with two PVC (1151) described on FIG. 42. Each PVC (1151) is slideably inserted into respective slot of AVM (1161). Figure elements same as on FIG. 42.

Figure 45:
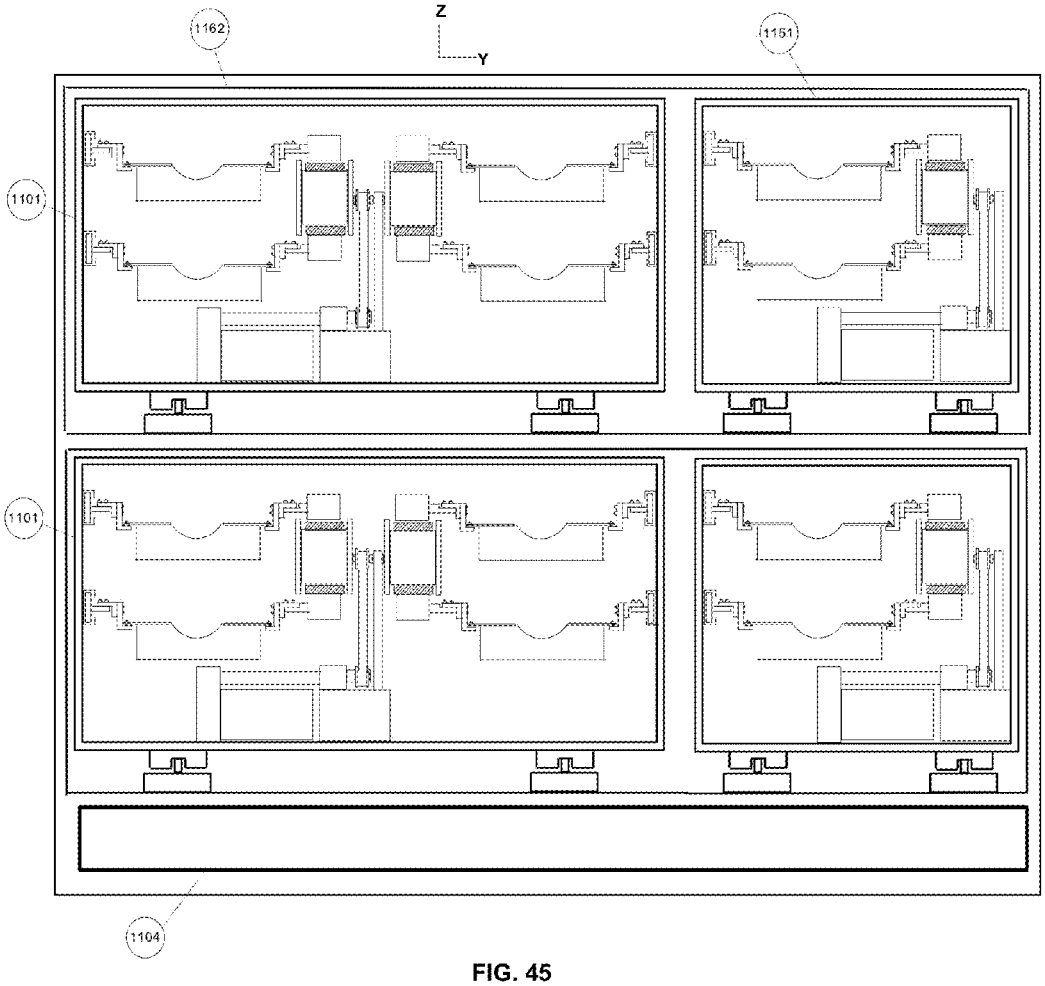

FIG. 45—illustrates Z-Y view of AVM (1162) configured with two PVC (1101) described on FIG. 41 and two PVC (1151) described on FIG. 42. Each PVC is slideably inserted into respective mating slot of AVM (1162). Configuration will allow AVM (1162) to achieve simultaneous dispensing rates of up to 6 items from Provider side and 6 items from Customer side. Figure elements same as on FIG. 41 and FIG. 42.

Figure 46:
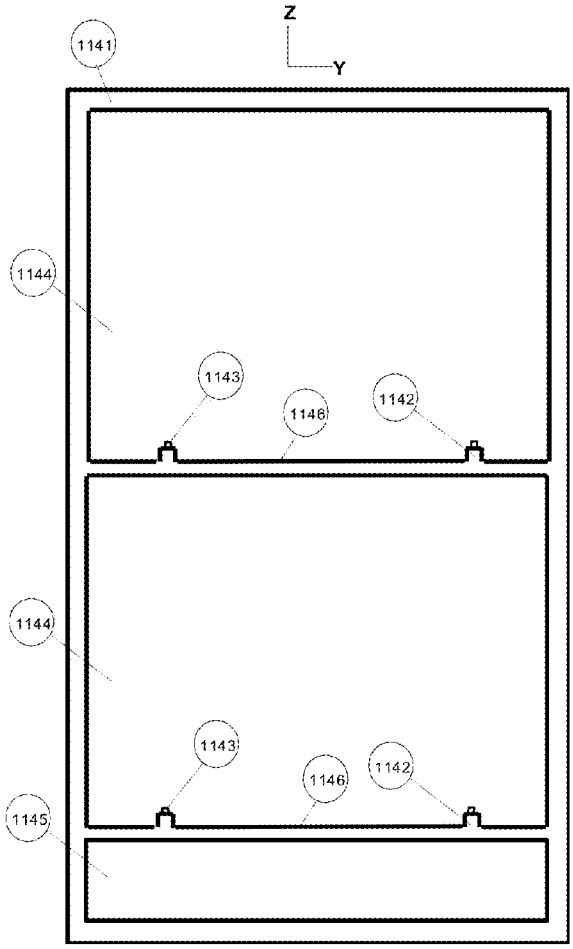

FIG. 46—illustrates Z-Y view of an empty AVM (1141) configured with two slots to accept two PVC units. Figure elements are labeled as follows:

1142—Guiding channels with embedded or insertable rollers (1143), configured to mate with respective grooves of a PVC being installed into AVM (1141).

1144—Section of AVM (1141) configured to accept mating PVC

1145—Section of AVM (1141), which can be used for other components: Controllers, PSU, LAN interfaces, USB interfaces, environmental controllers, etc.

Figure 47:
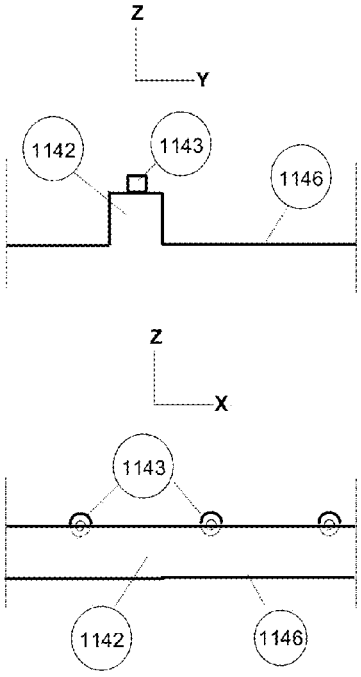

1146—Inner base of section (1144), which is used as support for inserted PVC units FIG. 47—illustrates details of the guiding channels (1142) with embedded or insertable rollers (1143) installed from support base (1146), configured to mate with respective alignment grooves of PVC during installation.

Figure 48:
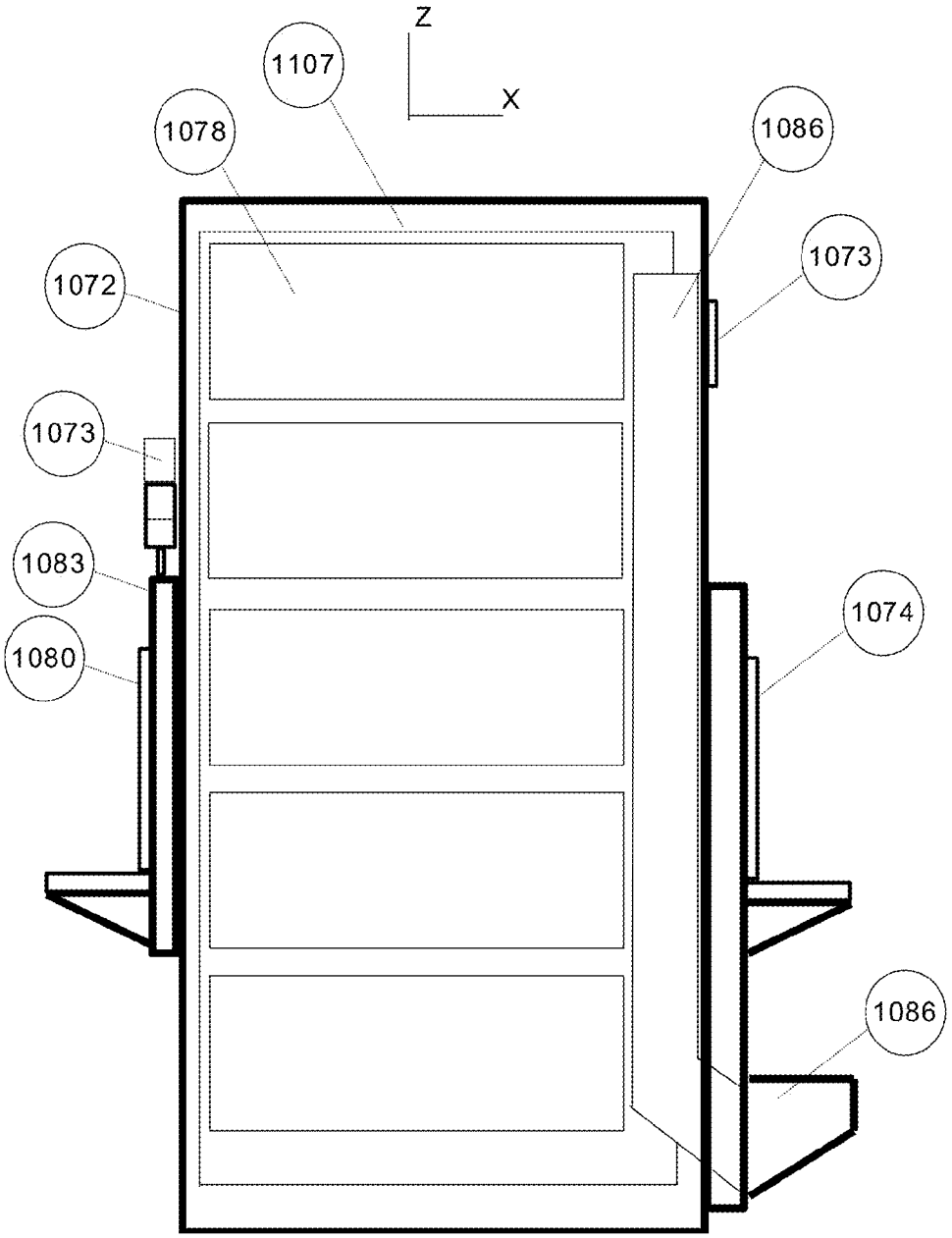

FIG. 48—illustrates Z-X view of assembled AVM (1072), such as AVM-200, shown on FIG. 35. Figure elements are labeled same as on FIG. 35

Figure 49:
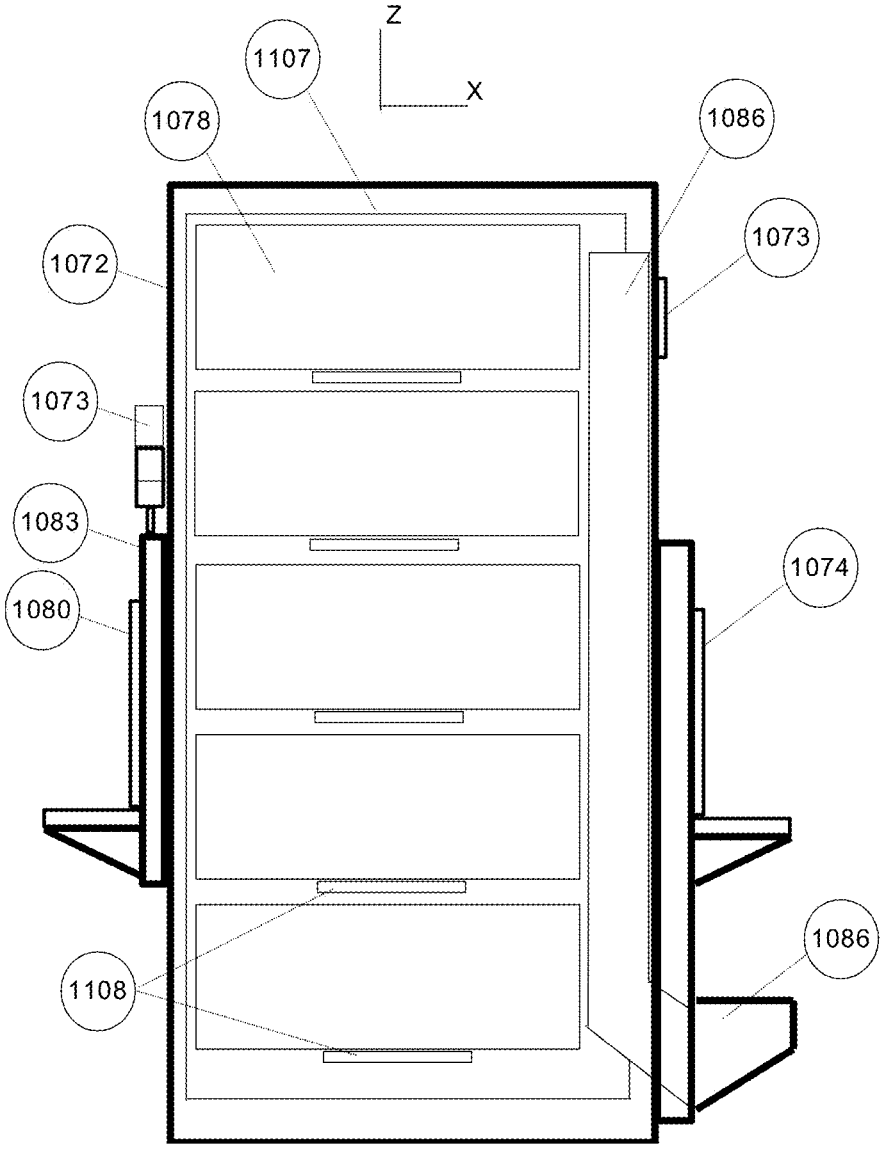

FIG. 49—illustrates Z-X view of assembled AVM (1072), such as AVM-200, shown on FIG. 35, configured with scale components (1108), which are connected to Controller for real-time measurements of the weight of each PVC (1078) installed inside AVM (1072). Loading of items into each PVC (1078) inside AVM (1072), or unloading of items from PVC (1078), will be verified by controller in real-time by monitoring the respective scales and detecting change in weight. The Controller based on item identification, such as barcode label, will obtain the item expected weight from the non-volatile memory, and compare to detected change in weight. If the change in weight is within predefined tolerances, and was expected, then the controller can make the item available for dispensing to Customer. If the change in weight is unexpected, Controller in real-time will execute pre-configured correction actions, as part of apparatus configurations parameters. Correction action can be configured to include: informing Provider via available interfaces (audio/visual/electronic) of PVC with violation in weight; returning items back to Provider. Remaining elements are labeled same as on FIG. 48

Figure 50:
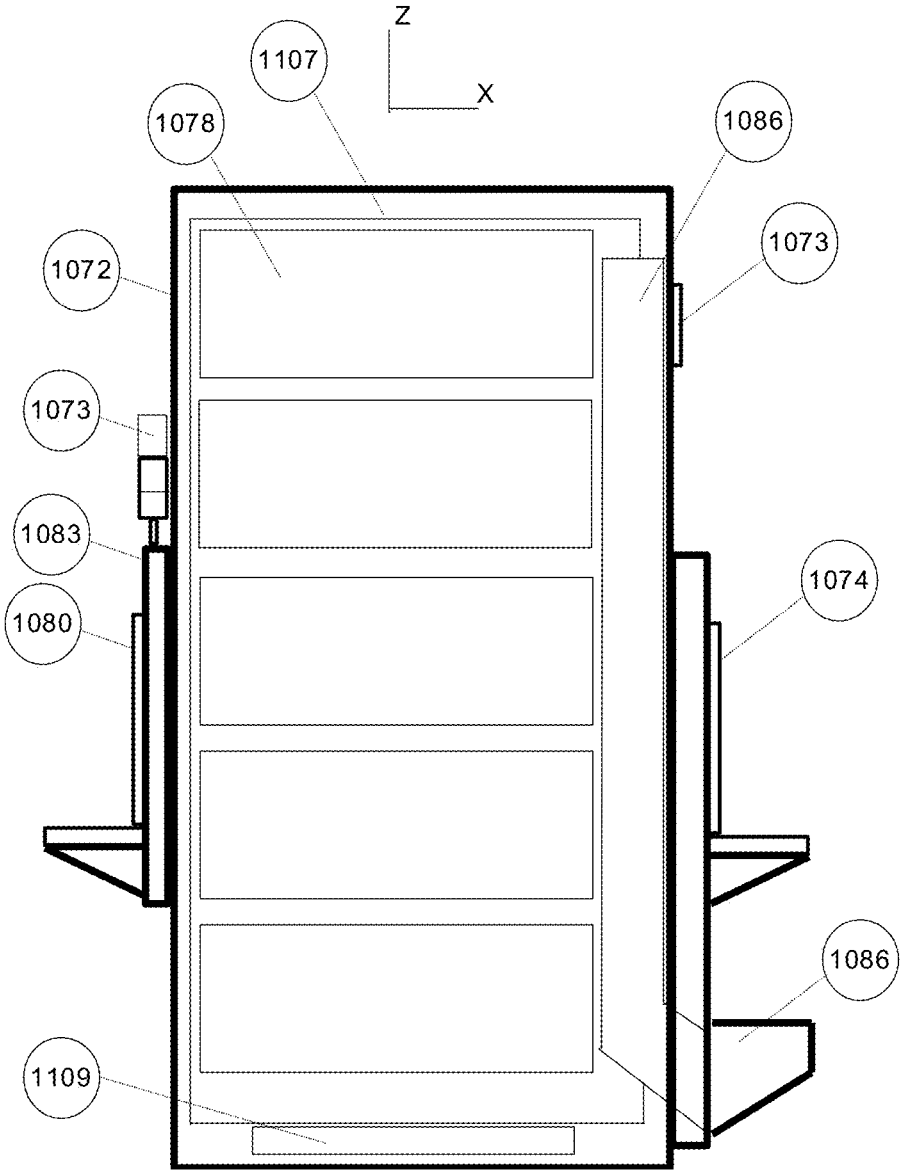

FIG. 50—illustrates Z-X view of assembled AVM (1072), such as AVM-200, shown on FIG. 35, configured with one scale component (1109), which is connected to Controller for real-time measurements of the weight of all PVC (1078) installed inside AVM (1072). Loading of items into AVM, or unloading of items from AVM will be verified by controller in real-time by monitoring the scale (1109) and detecting change in weight. The Controller based on item identification, such as barcode label, will obtain item expected weight from the non-volatile memory, and compare to detected change in weight. If the change in weight is within predefined tolerances, and was expected, then the controller can make the item available for dispensing to Customer. If the change in weight is unexpected, Controller in real-time will execute pre-configured correction actions, as part of apparatus configurations parameters. Correction action can be configured to include: informing Provider via available interfaces (audio/visual/electronic) of PVC with violation in weight; returning items back to Provider. Remaining elements are labeled same as on FIG. 48

Figure 51:
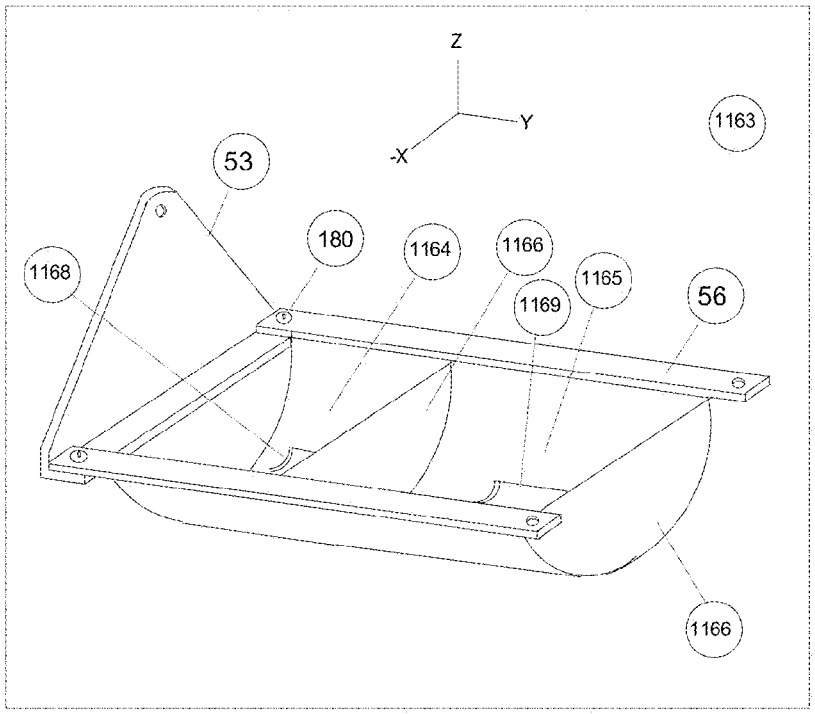

FIG. 51—illustrates X-Y-Z view of section of a carrier (1163) configured as a dual pocket with openings in the bottom of each pocket to allow unloading mechanism to engage with respective item inside a pocket and forced it out, as part of dispensing. Figure elements are labeled as follows:

53—Part of carrier support assembly (only one shown for simplicity)

56—One of Carrier holding assembly platforms, which can be used for placing barcode label(s). Barcode label can contain information related to Carrier.

180—One of mounting screws for securing position of Carrier holding plate

1164—Pocket #1 of the carrier used for holding and transporting item of respective size and shape

1165—Pocket #2 of the carrier used for holding and transporting item of respective size and shape

1166—Carrier pocket side wall

1168—Opening in the base of Pocket #1 to allow unloading mechanism to engage with item inside pocket #1 and force it out, as needed, for dispensing

Figure 52:
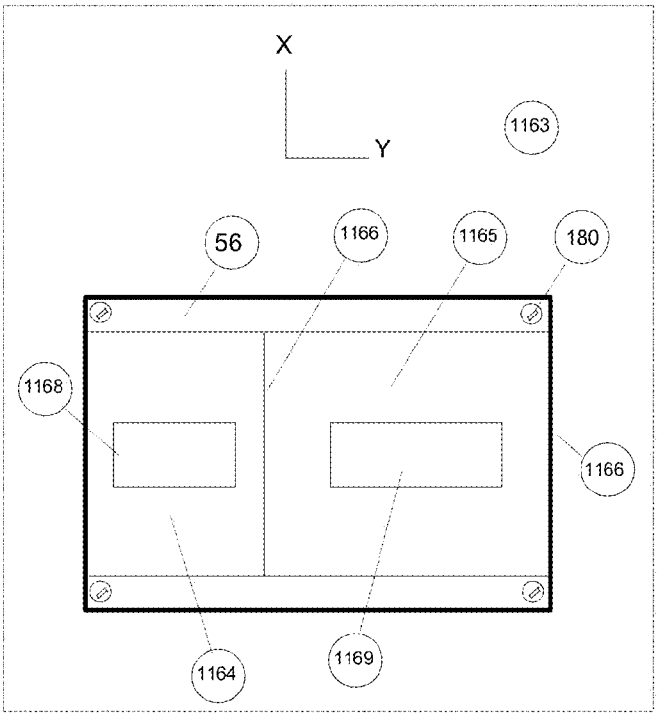

1169—Opening in the base of Pocket #2 to allow unloading mechanism to engage with item inside pocket #2 and force it out, as needed, for dispensing FIG. 52—illustrates X-Y view section of a carrier (1163) shown on FIG. 51. Elements labeled same as FIG. 51

Figure 53:
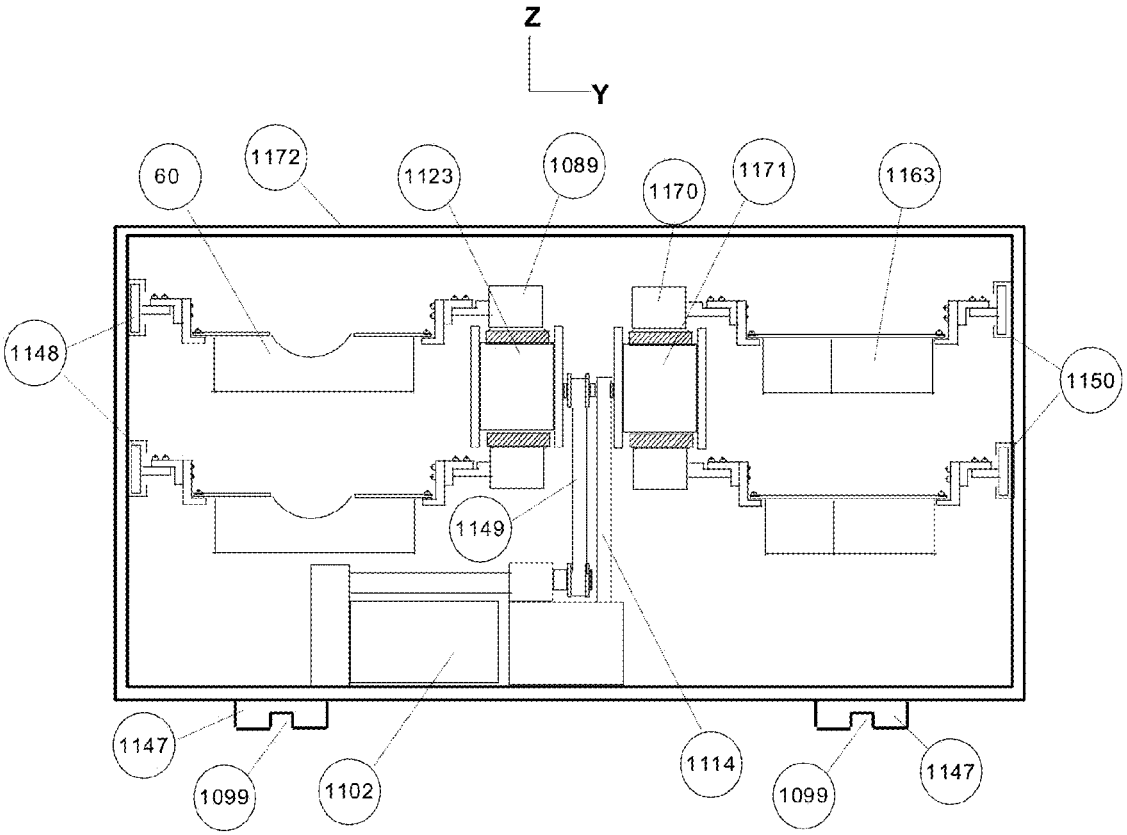

FIG. 53—illustrates Z-Y view of a PVC (1172) configured to contain dual synchronized conveyors (1123, 1171) with single pocket (60) in one track and dual pocket (1163) carriers in the second track, supported by respective rollers (1148) riding along the guiding rails (1150). Figure elements are labeled as follows:

1099—Alignment slot for PVC (1172) to match with respective alignment channel inside AVM

1102—Conveyor drive assembly

1114—Conveyor drive assembly support bracket

1147—Alignment channel with the alignment slot (1099) attached to PVC (1172)

1149—Conveyor drive assembly main drive belt

Figure 54:
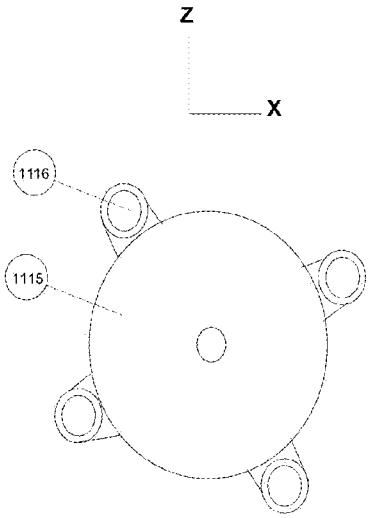

FIG. 54—illustrates Z-X view of a conveyor configured with 4 embedded bearings (1116) driven and supported by a single pulley (1115). This configuration can be used for small scale implementations, to reduce size and costs of the PVC and AVM units.

Figure 55:
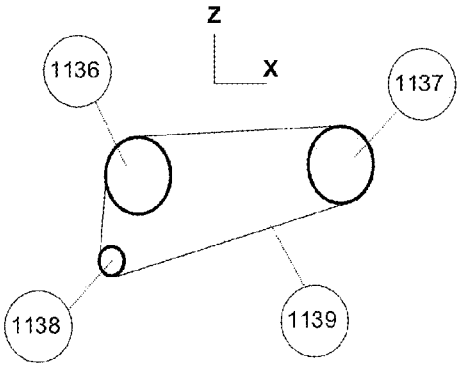

FIG. 55—illustrates Z-X view of conveyor (1139) configured with supports by three pulleys (1136, 1137, 1138). Pulleys are configured to achieve: required supports of the conveyor; required path for carriers, including locations where items can be inspected, loaded, and unloaded.

Figure 56:
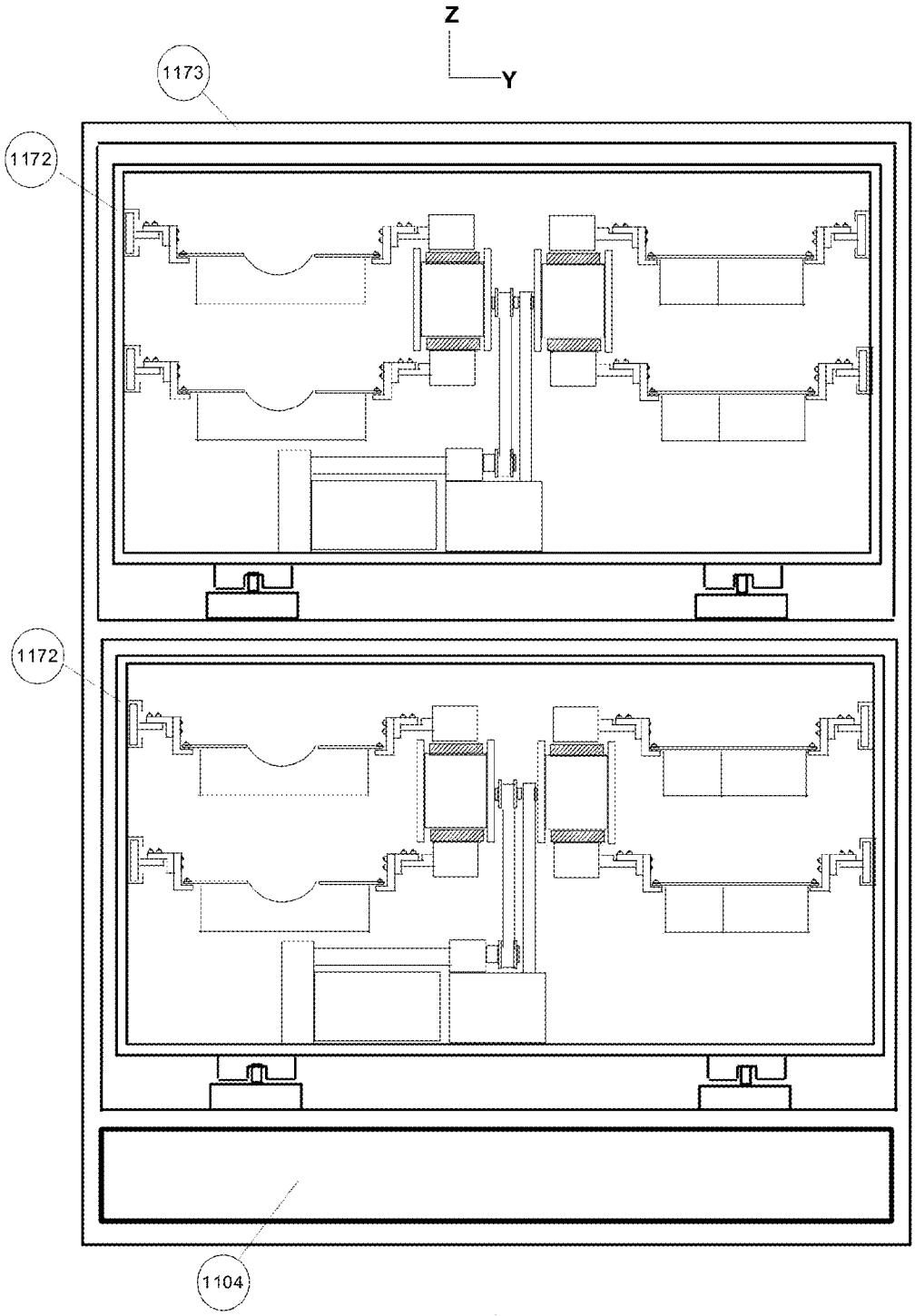

FIG. 56—illustrates Z-Y view of a AVM (1173) configured to contain two PVC (1172), with space (1104) inside AVM (1173) which can be used for installation of components such as: Controllers, PSU, LAN interfaces, USB interfaces, environmental controllers, etc. The AVM (1173) can be configured as a portable version of AVM for applications configured for serving patients or individuals at designated locations, including: residence, patient rooms at medical facility.

Figure 57:
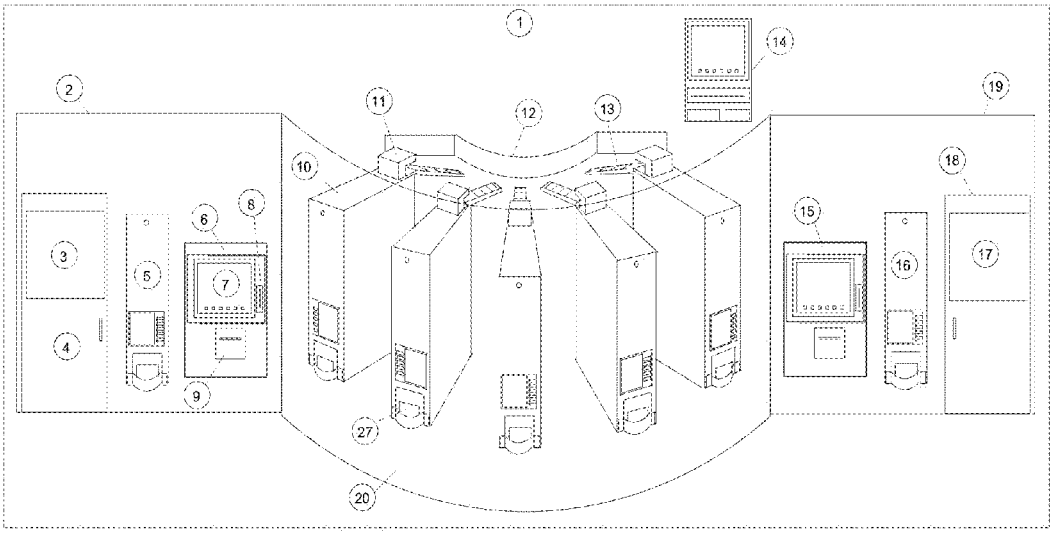

FIG. 57—ADVSP configuration (1) as half-star layout, with service on each side. For simplicity, to view details, the half-star partition or wall (20), is shown as transparent. ADVSP can offer Clear-View security from Provider side only, allowing Provider to observe activities taken place from Customers end, and then promptly take appropriate action to assist Customer or correct a problem, as needed. In addition, only front of Module can be exposed to Customer, while side and rear panels of both Inner and Outer Enclosures can be Clear-View type. This configuration can allow Provider to periodically observe and/or inspect in real-time activities within Modules, and promptly correct a potential problem, as needed. Configuration allows Provider to use Automatic Item Feeding assembly (13) and Automatic Item Loading assembly (11) for convenient Item loading and additional Item buffering capacity. The illustrated ADVSP can be configured to handle 1400 items (ADVSP-1400), which can include: prescription medications, non-prescription medications, combination of both. The ADVSP-1400 will provide. Table below illustrates some of the features of ADSP-1400.

TABLE 4

| | |
|---|---|
| Number of AVM total | 7 |
| AVM Capacity - Number of Prescription Medications | 200 |
| ADVSP-1400 Total Capacity - Number of Prescription Medications | 1400 |
| Capacity for Prescriptions (STATIC) processed at REFILL CENTER | 1000 |
| Capacity of Prescriptions (DYNAMIC) processed on-site | 400 |
| Number of CUSTOMER support stand-alone interfaces | 2 |
| MAX service rate of CUSTOMERS at once | 7 |
| Service Rate per CUSTOMER (number of Prescriptions per second) | 2 |

Figure 58:
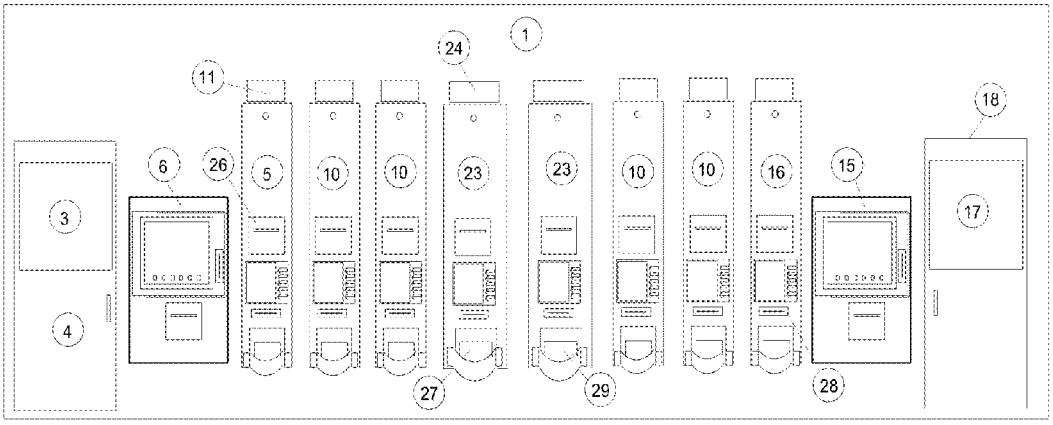

Figure elements are labeled as follows:

2—ADVSP left partition wall
3—Customer service window, left side
4—Provider access door, left side
5—Dynamic Module, left side
6—Station Computer #1, which can be used for initial processing of Customer's ID card, etc.
7—Station Computer #1 touch-screen monitor
8—Station Computer #1 card reader, which can accept ID cards, ATM/credit cards
9—Station Computer #1 printer
10—Module, which can be used for General or Assigned vending (card reader not shown)
11—Automatic Item Loading/Unloading assembly
12—Area behind Modules, which can be used for Provider working bench/area
13—Automatic Item Feeding assembly
14—ADVSP Host Computer
15—Station Computer #2, which can be used for initial processing of Customer's ID card, etc.
16—Dynamic Module, right side
17—Customer service window, right side
18—Provider access door, right side
19—ADVSP right partition wall
27—Item Pick-up Bin, Customer side FIG. 58—ADVSP configuration in-line, one Station layout, which for example can be configured as ADVSP-1600. Automatic Feeding and Automatic Loading of Items, shown on FIG. 57, can be added in support of on-site processing of prescription medications. All dispensed medications will comply to "100% factory-sealed QUALITY. For simplicity—privacy walls, separating each AVM, are not shown.

TABLE 5

| | |
|---|---|
| Number of AVM total | 8 |
| AVM Capacity - Number of Prescription Medications | 200 |
| ADVSP-1600 Total Capacity - Number of Prescription Medications | 1600 |
| MAX Service Rate - number of Customers served at once | 8 |
| Service Rate per CUSTOMER (number of Prescriptions per second) | 2 |

Figure 59:
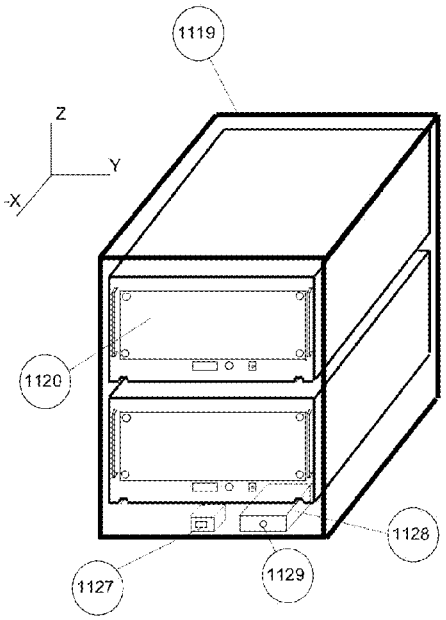

Figure elements are labeled as follows:

1,3-6,10,11,15-18,27—are labeled same as on FIG. 57
23—Module large size configured for automatic loading of items via (24) Automatic Item Loading component
26—Thermal printer, or equivalent
28—Module card reader, which can accept ID cards, ATM/credit cards
29—Large Item Pick-up Bin, Customer side FIG. 59—illustrates X-Y-Z view of assembly details of AVM portable (1119), such as AVM-80, configured with two PVC (1120), such as PVC-40. The AVM (1119) is further configured for installations as a personalized version of AVM dedicated to a patient at a medical facility, or a customer situated at home or care facility. For illustration purposes the front door is not shown, and the side panels are shown as being seeing through. Portable version of AVM, or portable kiosk, configured with ADVSP components for individual use. The AVM can be configured as table mount, or as a floor mount. PVC modules (1120) configured to have carriers with specified amounts of medication. Each carrier cab be configured to contain specific dosage of medication. Controller of AVM (1119) is configured to execute patient specific algorithm, as part of ADVSP configuration parameters, which will include dispensing designated amount of pills or liquid medications at specified events, and required date and time. Pills can be stored in small plastic bags, while liquid medication—in one-time use containers. All medications are retained inside AVM within respective specifications, including environment. AVM portable (1119) can be controlled locally (via PC or Controller), manually (by operator), or remotely, with appropriate authorization via conventional security and safety identification methods. AVM portable can be configured with user interface, including announcement function implemented via visual (LCD. LED, etc.), and/or sound (music, message, etc.), and/or vibration effects. AVM portable can be configured locally and/or remotely for proper date/time distribution/dispensing of required dosage(s). AVM portable can be monitored (status, inventory, history of dispenses, environment, etc.) by local and/or remote controllers. and/or remote controller, such as PC. Interface can be hardwired, such as serial USB port, or wireless, including Internet. Controller can be configured to connect to external devices and sensors, which are configured to provide the Controller with status information about the patient, including: temperature, blood pressure. Controller can be configured to execute patient specific algorithm specified by an authorized provider, such as patient's physician, which is stored in non-volatile memory, as part of apparatus configuration parameters. The algorithm can instruct the Controller to compare the current status of the patient with the preset range of values, and depending on results of the comparison, direct the Controller to dispense corresponding amount of medication to be administered to the patient by the patient or authorized provider. The carriers inside AVM (1119) portable can be configured to contain single or multiple combination of medications, with single or multiple dosages of each medication. Based on patient specific algorithm, Controller will dispense accurately required dosage of medication, down to a fraction of a pill. The patient algorithm can be configured to direct the Controller to execute calculations and analysis of the patient history, including: recorded statuses of the patient, patient reaction to previously dispensed and administered dosages of medications, date/time of dispensing medications. AVM (1119) portable floor mount can be configured with PVC's with carrier conveyor aligned for vertical indexing. The patient specific algorithm can be configured to direct Controller to execute the algorithm in real-time without operator assistance, and inform the operator or provider when specific conditions are detected by Controller. The Controller will notify the provider or patient when medication is dispensed, and will require the patient or provider to administer the medication, and record the date/time it was completed, including medications type and amount. Figure elements are labeled as follows:

1120—PVC, which can contain components configured per specific requirements in terms of: capacity, size, weight, packaging of medications (such as container bottle, plastic bag, paper bag, etc.), environment, etc.
1127—Serial interface (USB, etc.) to a local controller

1129—Power input connector for Power supply unit (1128) inside AVM

Figure 60:
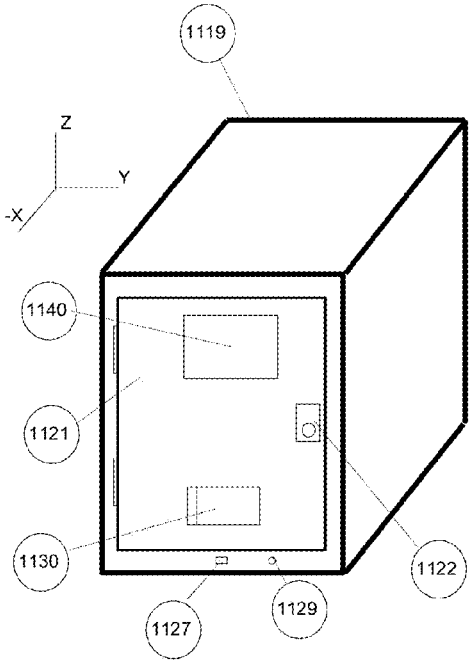

FIG. 60—illustrates X-Y-Z view of assembled AVM (1119) shown on FIG. 59.

Figure elements labeled as follows:

1121—Access door for AVM (1119), which can be configured to operate via key-lock mechanism (1122). Additional devices for proper identification of the operator can be added to provide required level of security.

1130—Dispensed Item(s) pick-up bin

1140—User interface, such as: touch-screen monitor connected to controller of the (1119)

Remaining elements are labeled same as on FIG. 59

Figure 61:
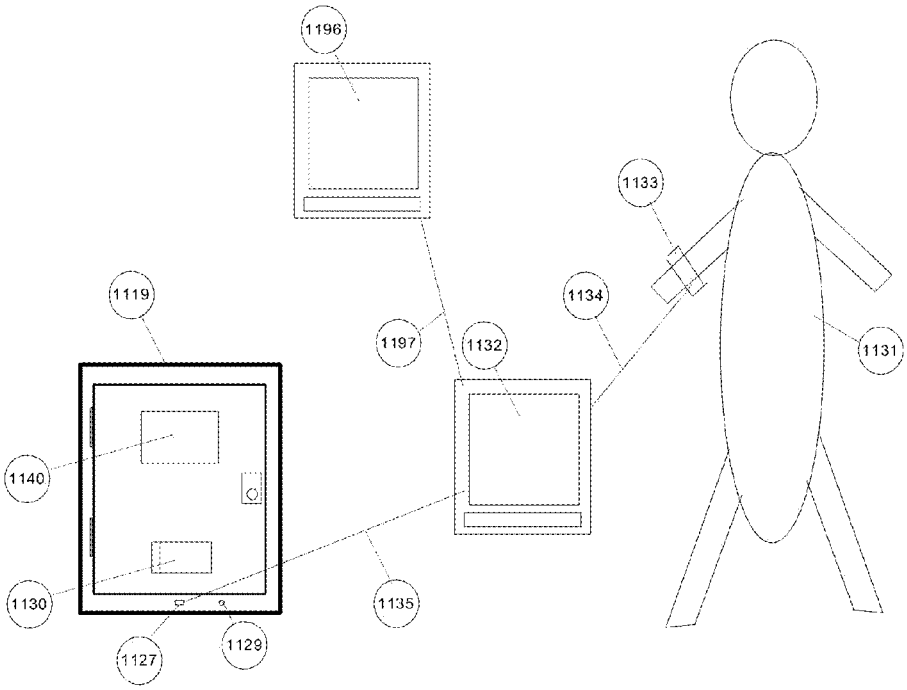

FIG. 61—illustrates a portable AVM (1119), described on FIG. 59, which is configured to interface with controller (1132) via network (1135). Controller (1132) is connected to sensors represented by (1133), which are attached to a patient (1131) to monitor specific parameter, including: temperature, blood pressure, sweetness, etc. Based on pre-programmed criteria and control algorithm provided by an authorized Provider (physician for example) stored in the Controller non-volatile memory, which can include: time schedule for periodic measurements; required dispensing dosage per measured data, the Controller (1132) will execute in real-time with or without operator assistance, required measurements based on data from sensors, and controller (1132) will, with or without operator assistance, with or without assistance of other controllers (1196) via network (1197), will execute in real-time commands to control AVM (1119), including: dispensing required medications; dispensing medication of required dosage; informing patient of dispensed medication being ready for pick-up from the bin (1130). Controller can be configured locally and/or remotely via controllers (1196) connected via network (1197). The entire process, including monitoring sensors, dispense schedules—can be controlled locally by controller (1132) and/or remotely by other controllers (1196) via network (1197). The described application of ADVSP components—illustrates the ability of ADVSP to operate as a stand-alone closed loop real-time control system, with support from HOST controllers, as needed. The control algorithm can ensure the right medication and the right amount is verified with the HOST controllers (1132, 1196), as needed, and then in real-time dispensed by AVM (1119) to a patient (1131) based on patient condition reported by sensors (1133). The operation and controls can be executed by ADVSP controllers with or without operator assistance. The criteria and control algorithm defined by authorized person, such as physician, and stored in the non-volatile memory of the ADVSP Controller, can be based on comprehensive closed-loop controls, allowing the Controller to execute in real-time with or without operator assistance a step-by-step monitoring of condition of the patient, and dispensing required medications based on: current status of the patient; and analyzed by Controller stored history of the patient responses to previously dispensed medications; resulting in ADVSP configuration as a closed-loop self-tuning control system, with an objective to make required real-time adjustments, such as: sampling rate; medication dispense amount and schedule, with an objective to achieve the most stable pre-defined acceptable condition of the patient at all times. Simplified example of criteria and control algorithm entered by an authorized physician, will consist of the following control steps:

1) Every hour measure and record/store patient temperature

2) Calculate average temperature based on last 4 readings, and record/store average 3) If current temperature above pre-defined limit #1—notify authorized person (text message, local alarm), otherwise, if current temperature above pre-defined limit #2, and average temperature calculated in step (2) above pre-defined limit #3, and the time elapsed from the last dispense is over pre-defined time limit #1—dispense medication in dosage amount #1, notify patient of dispensed medication; and record/store transaction.

Figure 62:
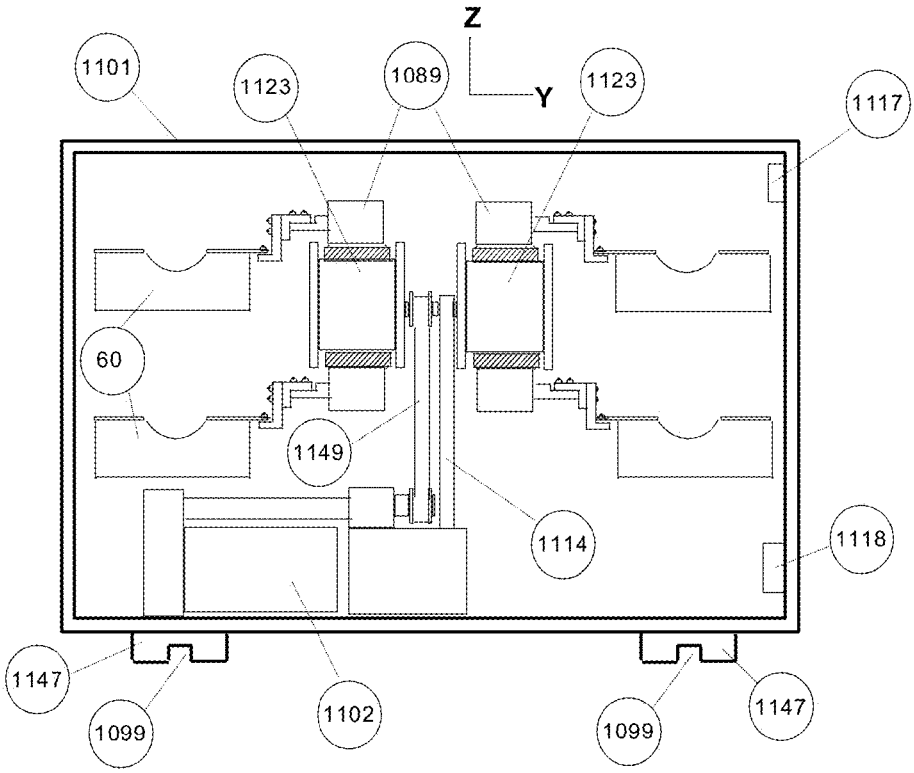

FIG. 62—illustrates Z-Y view of a PVC (1101) configured to contain dual synchronized conveyors (1123) with single pocket (60), which is supported from one side only. Environmental sensors (1117, 1118) which can be configured to be used by controller to monitor environment inside PVC (1101). Remaining elements are labeled same as on FIG. 53

Figure 63:
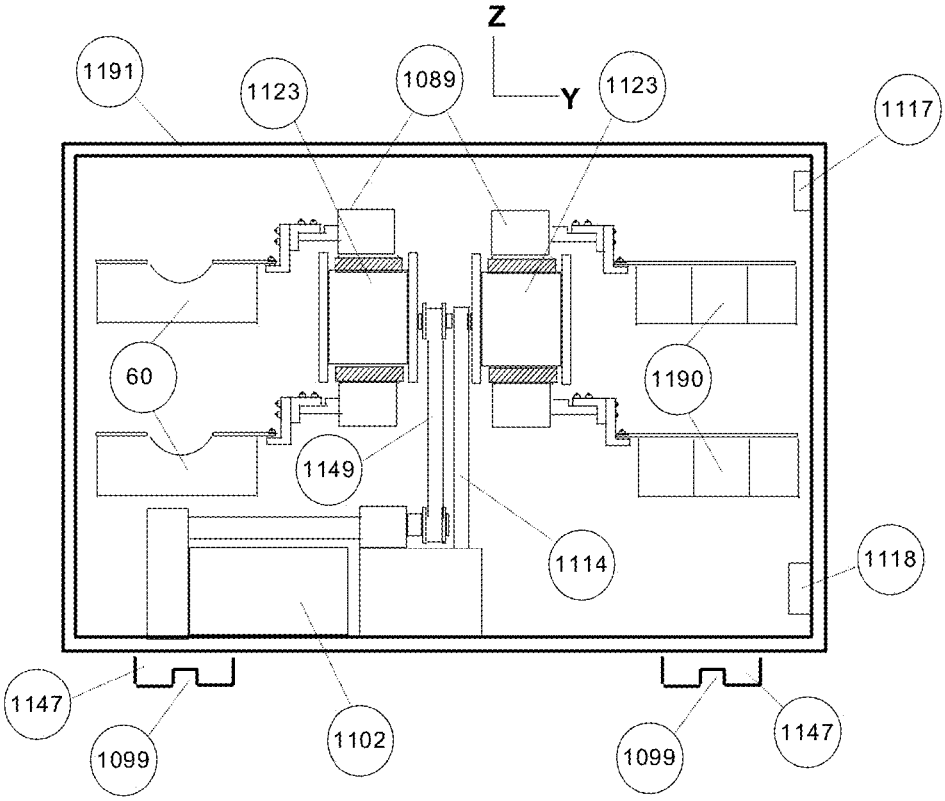

FIG. 63—illustrates Z-Y view of a PVC (1191) configured to contain dual synchronized conveyors (1123) with single pocket carriers (60) in track #1 and three pocket carriers (1190) in track #2. All carriers are configured to be supported from one side only. Environmental sensors (1117, 1118) which can be configured to be used by controller to monitor and control the environment inside PVC (1190). Carriers (1190) illustrate principal of a multi-pocket configuration, which will allow to configure each pocket within the carrier to hold required dosage of medication down to a smallest amounts, including: single pill or even fraction of the pill which is stored inside packaging, such as a plastic bag, and then dispensed by Controller, as requested, to an authorized Customer. The medications can be dispensed under closed-loop controls, as described under FIG. 61.

Remaining elements are labeled same as on FIG. 53

Figure 64:
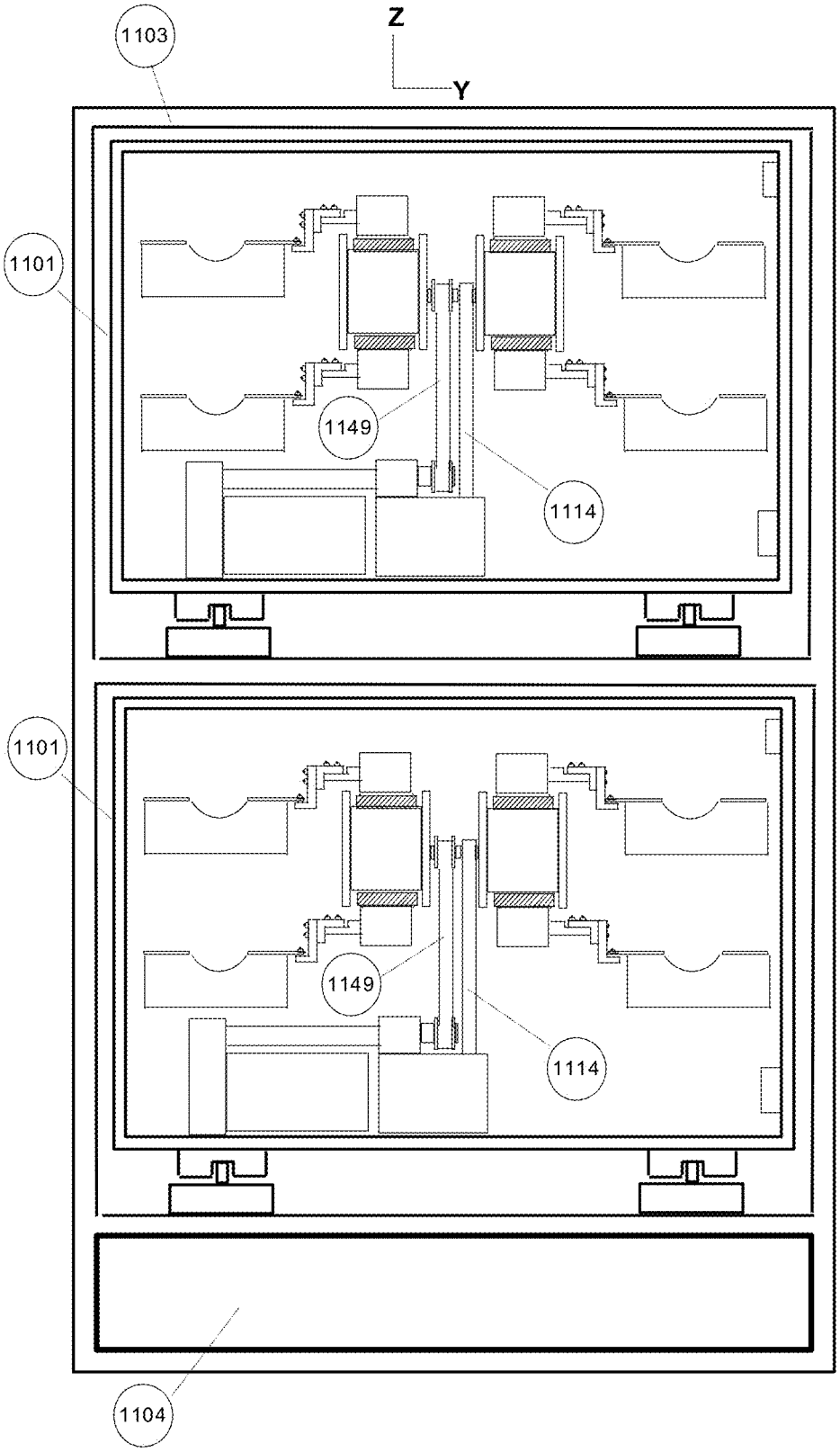

FIG. 64—illustrates Z-Y view of AVM (1103) configured with two PVC (1101) installed inside, with space (1104) inside AVM (1136) which can be used for installation of components such as: Controllers, PSU, LAN interfaces, USB interfaces, environmental controllers, etc. Configuration will allow AVM to achieve simultaneous dispensing rates of up to 4 items from Provider side and 4 items from Customer side.

Figure 65:
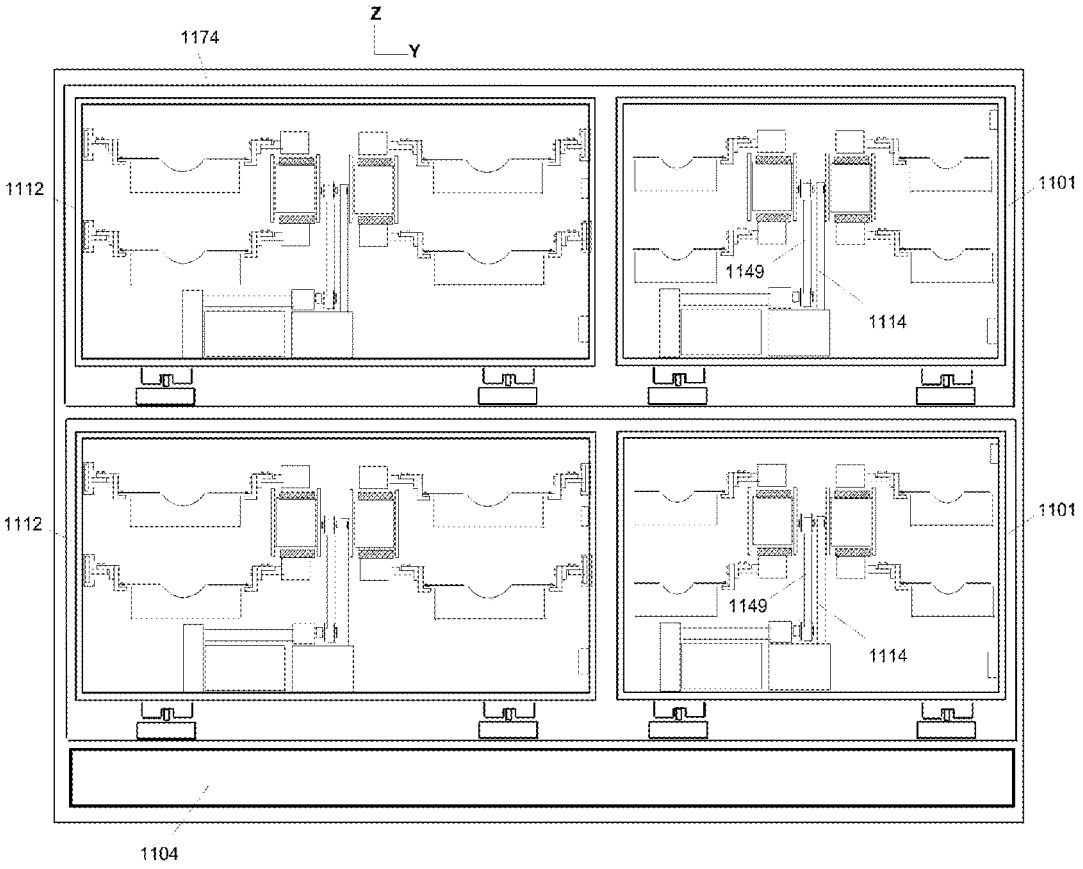

FIG. 65—illustrates Z-Y view of AVM (1174) configured with two PVC (1101) and two PVC (1112) installed inside, with space (1104) inside AVM (1136) which can be used for installation of components such as: Controllers, PSU, LAN interfaces, USB interfaces, environmental controllers. Configuration will allow AVM to achieve simultaneous dispensing rates of up to 16 items from Provider side and 16 items from Customer side.

Figure 66:
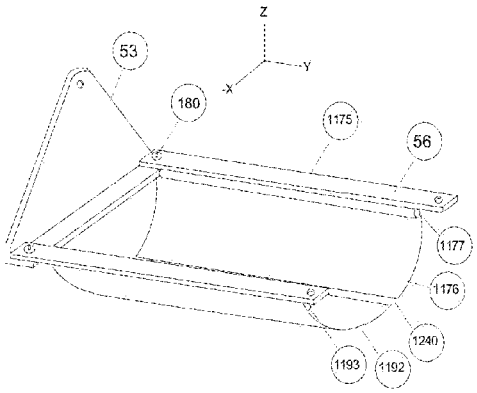

FIG. 66—illustrates X-Y-Z view of section of a carrier (1175) which is configured as a single pocket with the base split in two independent sections (1176) and (1192). The area where each section is engaging with the other section (1240), such as shape and distance in-between, can be configured to provide a reliable exit of item from the pocket when a vertical force is applied to the item. Figure elements are labeled as follows:

53—Part of carrier support assembly (only one shown for simplicity)

56—One of Carrier holding assembly platforms, which can be used for placing barcode label(s). Barcode label can contain information related to Carrier.

180—One of mounting screws for securing position of Carrier holding plate

1176—Section #1 of the carrier pocket, supported from the spring-loaded shaft (1177)

1192—Section #2 of the carrier pocket, supported from the spring-loaded shaft (1193)

Figure 67:
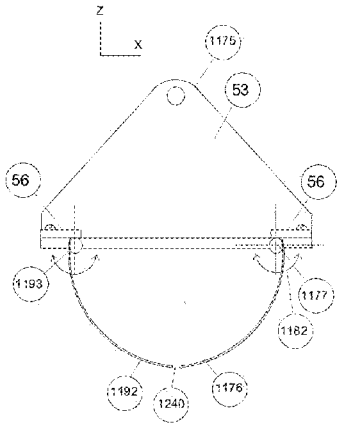

FIG. 67—illustrates Z-X view of section of a carrier (1175) shown on FIG. 66, with (1182) illustrating swing-about direction of each carrier base sections (1192) and (1176) about the axis of its respective shafts (1193) and (1177). Remaining elements are labeled same as on FIG. 66

Figure 68:
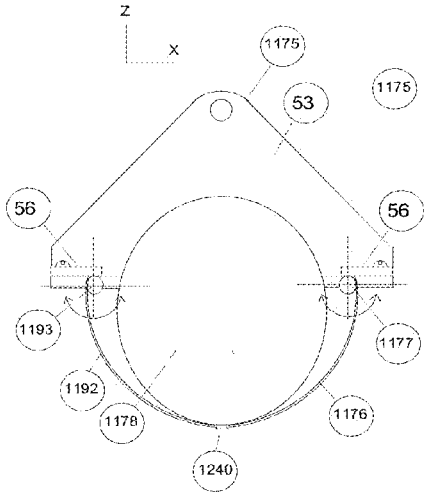

FIG. 68—illustrates Z-X view of section of a carrier (1175) shown on FIG. 66 with an item (1178) inside the carrier pocket. Elements are labeled same as on FIG. 66

Figure 69:
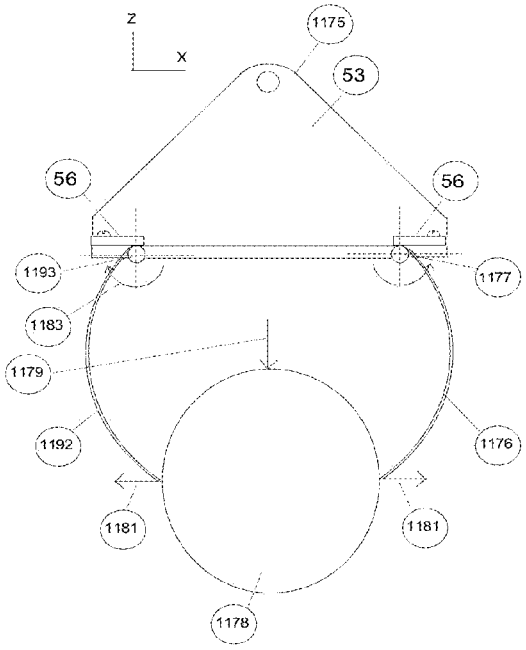

FIG. 69—illustrates Z-X view of section of a carrier (1175) shown on FIG. 68. Under the force (1179) applied to the item (1178) the carrier pocket sections (1192) and (1176) will swing about the axis of their respective shafts (1193) and (1177), and will split or move apart in direction (1181), extending the distance between them, and as result, allowing item (1178) to slide down further away from its original position inside the carrier (1175). The force (1179) can be generated by an actuator (solenoid), which is when energized by Controller—will extend its plunger and engage with the item (1178). Remaining elements are labeled same as on FIG. 66

Figure 70:
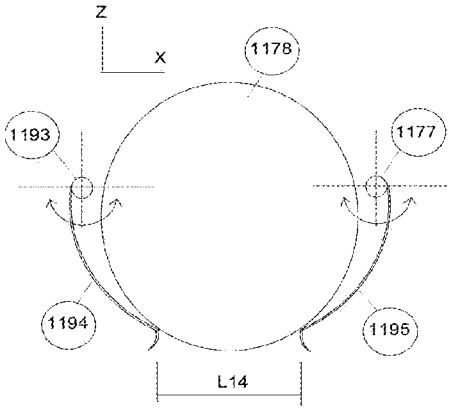

FIG. 70—illustrates Z-X view of carrier pocket sections (1194) and (1195) which are configured, including shape and distance (L14) in-between, to assist the item (1178) in exiting the pocket. In this configuration, amount of force required to further separate apart pocket sections (1192) and (1195) to force the item (1178) to fall through the opening, would be significantly lower. Remaining elements are labeled same as on FIG. 66

Figure 71:
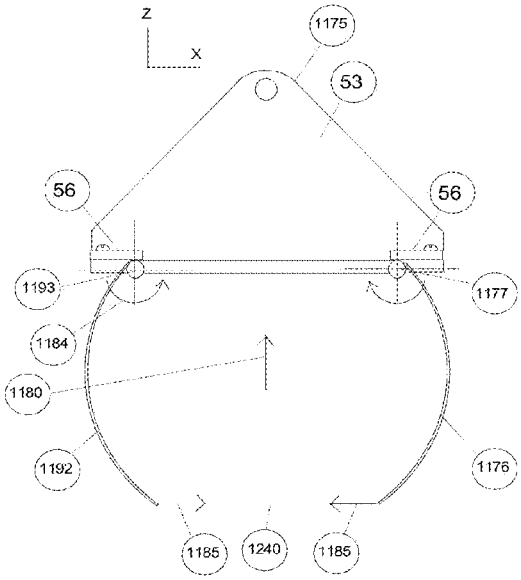

FIG. 71—illustrates Z-X view of carrier (1175) shown on FIG. 69 after the item exited, allowing spring-loaded shafts (1193) and (1177) to move back the respective pocket sections (1192) and (1176) in direction (1185), decreasing the gap (124), and allowing a new item to be loaded and to remain inside the pocket. When item exits the carrier pocket, which is detected by Controller via sensor (not shown for simplicity), Controller will direct the actuator to retract back in direction (1180). Remaining elements labeled same as on FIG. 66

Figure 72:
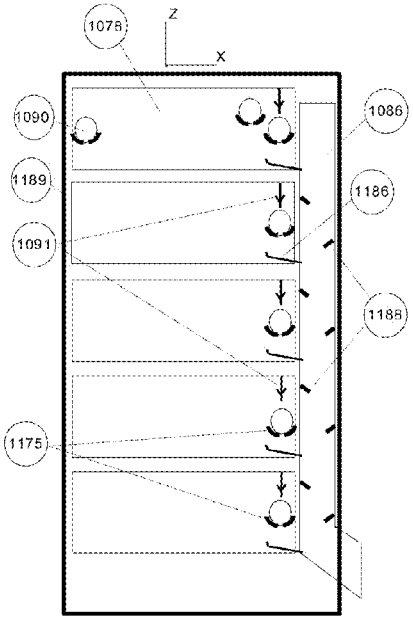

FIG. 72—illustrates Z-X view of AVM (1189) configured with five PVC (1078) inside. For simplicity, only 3 carriers with split-bottom pockets (1175) with item (1090) inside are shown for each PVC. Configuration supports unloading of items from carriers at designated index locations using an actuator (not shown), which under direction of Controller, will apply a vertical force (1091) to items inside carriers, forcing the item to move down and split-open the pocket, and then slide through onto the platform (1186), guiding the item under items own weight to roll toward and enter the tunnel (1086). Sensors (not shown) will be configured and placed along the path, and allow Controller to monitor location of items. Figure elements are labeled as follows:

1086—Dispensed item catching and delivery tunnel configured with built-in item protection components (1188) configured to slow down the down-fall of items inside the tunnel. Dispensed items are directed by the tunnel (1086) toward an item pick-up bin, not shown.

1186—Section or platform of tunnel (1086) configured to catch item dispensed from a carrier located above the platform, and guide the item toward the down-fall section of the tunnel (1086).

1091—Driver mechanism, such as solenoid, which when activated will move its actuator (plunger) toward the item (1090) and apply force to push the item out of its carrier pocket. After Controller detect that the item (1090) exited the carrier, Controller will de-activate the actuator and return it to its original retracted position.

Figure 73:
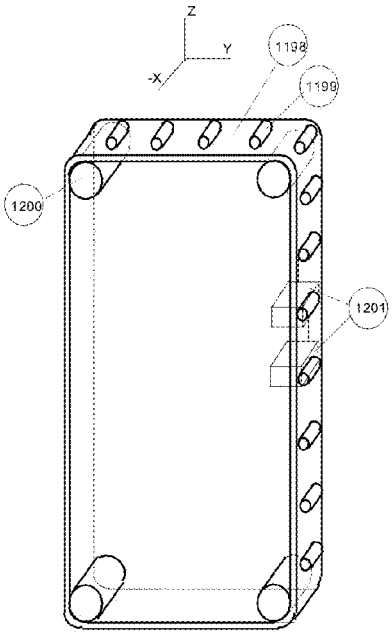

FIG. 73—illustrates X-Y-Z view of a conveyor (1198) configured with embedded or insertable carrier support bearing assemblies (1199). Conveyor (1198) is configured to be driven and supported by four pulleys (1200) guiding conveyor along a predefined path consisting of horizontal and vertical sections. For simplicity—only two carriers (1201) are shown. The side of the carriers (1201) opposite to the carrier conveyor (1198), depending on size and weight of carrier, and depending on item inside carrier, can be configured with or without supports, such as rollers riding along the guiding rails (not shown for simplicity).

Figure 74:
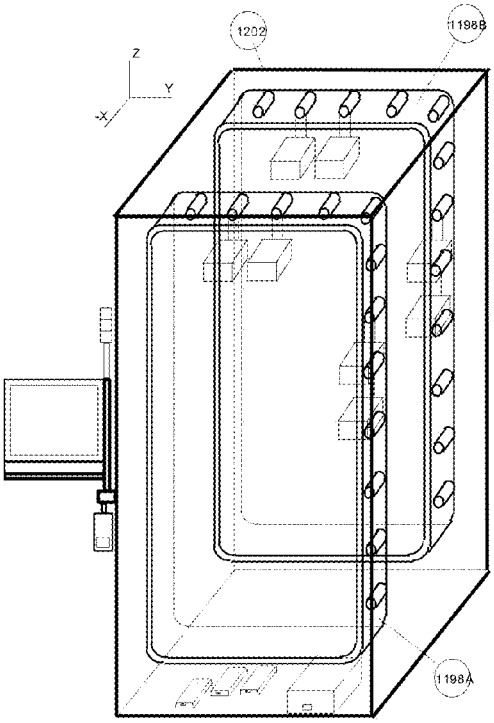

FIG. 74—illustrates X-Y-Z view of AVM (1202) configured with installed two conveyors (1198A) and (1198B) described on FIG. 73. In this configuration of AVM, conveyors (1198) are considered stationary.

Figure 75:
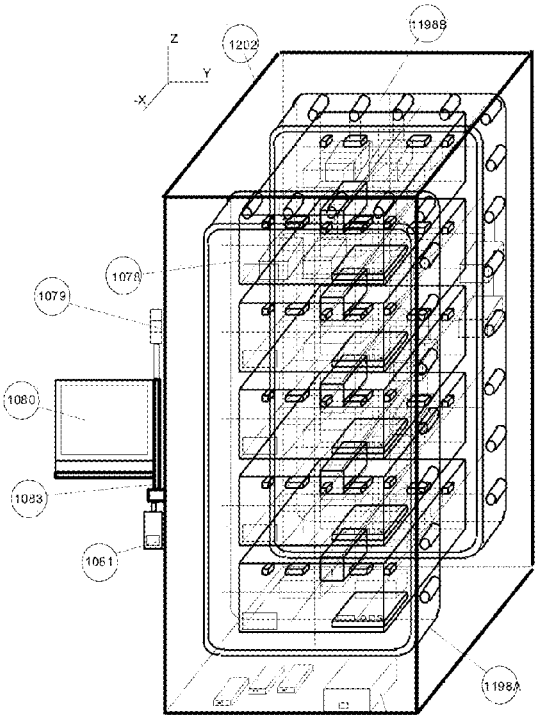

FIG. 75—illustrates X-Y-Z detailed view of AVM (1202) configured with installed two conveyors (1198A, 1198B) described on FIG. 74, and is further configured with five slideably inserted PVC (1078) described on FIG. 31. In this configuration of AVM, conveyors (1198) are considered stationary. The configuration of AVM (1202) supports dispensing of items from each PVC (1078) and each stationary conveyor (1198), and arrangement of the item pick-up bins can be configured to serve three customers at once, with a rate of dispensing of items to each customer as high as 10 items at once. This configuration can be used to dispense non-prescription items from carriers of the stationary conveyors (1198A, 1198B), and prescription medications from slideably inserted PVC (1078). Operation of all components inside AVM (1202), including: user interface (Provider, Customer), conveyor operation, actuators to load and unload items, control devices maintaining environment, barcode scanners, position sensors, inspection devices (not shown for simplicity)—are coordinated and synchronized in real-time, with or without operator assistance, by Controller of the AVM (1202) based on control algorithm and preset configuration parameters stored in non-volatile memory. Controls can be configured to include interface with other Controllers located within or outside AVM (1202). Controller will maintain all items, such as medications, within specification parameters, and will dispense to authorized Customers only medications with 100% compliance to quality parameters defined by configuration parameters. Remaining components labeled same as on FIG. 33, FIG. 34.

Figure 76:
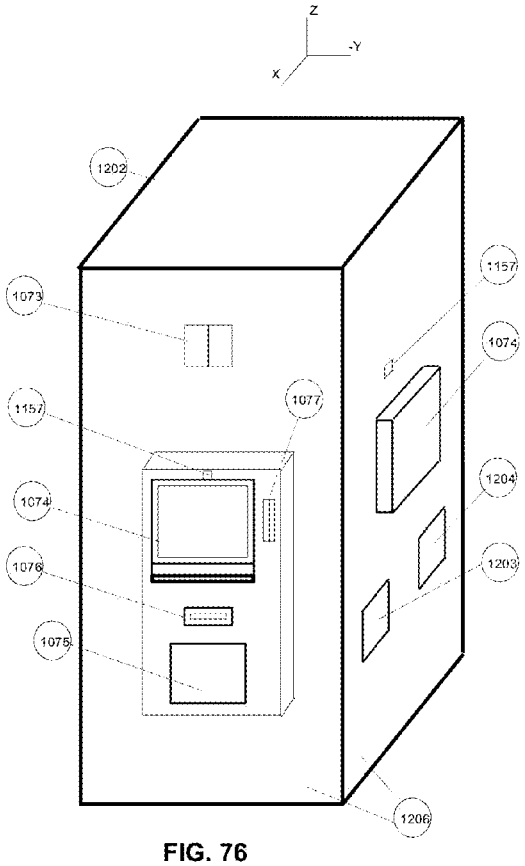

FIG. 76—illustrates X-Y-Z assembled view of AVM (1202), as described by FIG. 75, as seen by Customer, which is configured to have access to the front and the right sides of the AVM. Configuration of AVM (1202) will support serving up to three Customers at once, through designated pick-up bins (1075, 1203, 1204). Only sides of the AVM intended for serving the Customer can be exposed to Customer, while the other sides—can be hidden behind a wall, and accessible by Provider only. Figure elements are labeled same as follows:

1075—Pick-up bin, Customer side, to pick-up dispensed items from PVC (1078) inside AVM (1202). The maximum rate of dispensing is 10 items at once

1203—Dispensed item pick-up bin, Customer side, to pick-up dispensed items from conveyor (1198A)

1204—Dispensed item pick-up bin, Customer side, to pick-up dispensed items from conveyor (1198B)

1206—Sides of AVM (1202) accessible by Customer

Remaining components are labeled same as on FIG. 33 and FIG. 34

Figure 77:
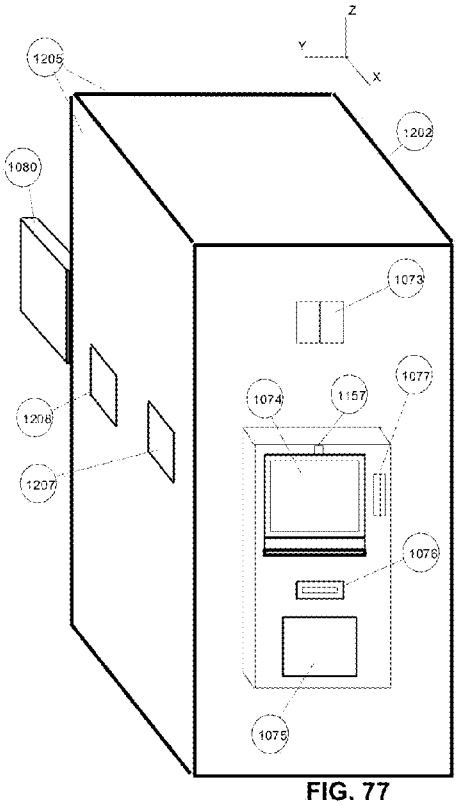

FIG. 77—illustrates X-Y-Z assembled view of AVM (1202), as described by FIG. 76, with section of AVM (1202) as seen by Provider, configured with access for Provider to the left and the back sides of the AVM. The layout can be configured with AVM left and back sides (1205) located behind a wall or a structure, which can be a part of a pharmacy office, or stand-alone kiosk service location. In this case—the left and back panels of the AVM (1202) can be removed allowing the Provider full access to inner components for service, loading and unloading of items, etc. Figure elements are labeled same as follows:

1207—Provider service window configured for loading items into carriers supported by conveyor (1198A), or for picking up items dispensed by conveyor (1198A)

1208—Provider service window configured for loading items into carriers supported by conveyor (1198B), or picking up items dispensed by conveyor (1198B)

1205—Sides of AVM (1202) accessible by Provider

Remaining components are labeled same as on FIG. 33 and FIG. 34

Figure 78:
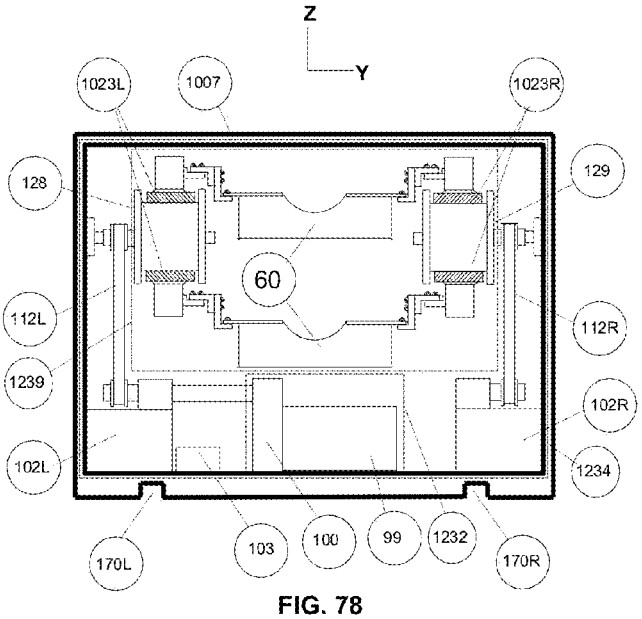

FIG. 78—illustrates Z-Y view of (1007) Portable Vending Cartridge (PVC) configured with synchronized dual belt conveyor single track. Conveyor drive assembly (99, 100) is thermally isolated and/or insulated from the carriers (60), as indicated by insulation layer (1232). In addition, carriers of the conveyor are further insulated by thermal layer (1239). This PVC can operate and maintain medications inside all carriers at refrigerator temperatures. Remaining elements are labeled same as on FIG. 12

Figure 79:
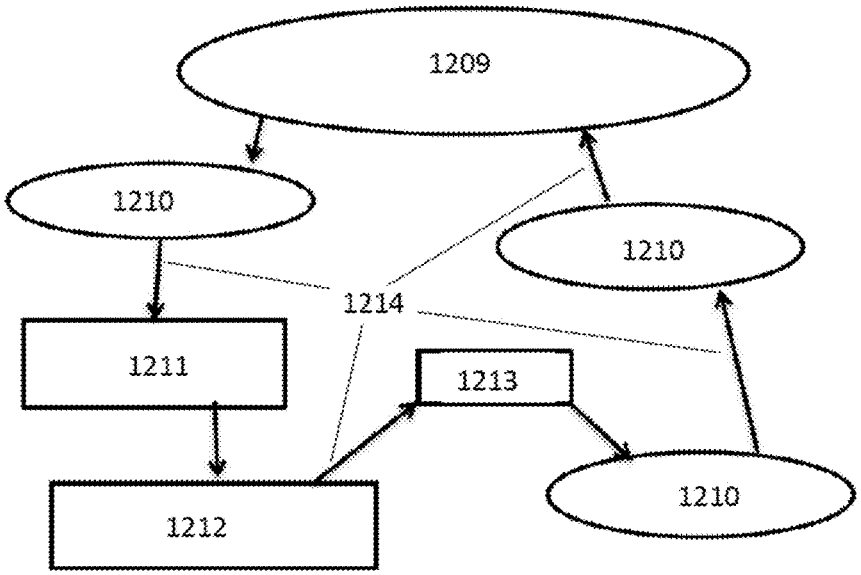

FIG. 79—illustrates a diagram of ADVSP configuration consisting of the following major components: ADVSP Central Refill Center (1209), ADVSP Pharmacy locations (1210), ADVSP Stand-alone kiosk (1211), ADVSP portable kiosk at a patient residence (1212), ADVSP portable kiosk at a patient room at a medical facility (1213). The illustrated ADVSP configuration will support a number of processes, including distribution of: raw materials; prescribed medications; non-prescribed medications; support equipment; etc. between various business units located along selected distribution route, as indicated by (1214). This is an example of optimization of pharmacy operations using automatic distributed vending system. ADVSP automation technology, which can be configured to significantly improve efficiency and quality of operations of various business, including—Pharmacy. ADVSP consist of automation friendly intelligent devices, which can be configured into a variety of automation solutions depending on business objectives. In the example—ADVSP is illustrated for applications in the Pharmaceutical industry. As with any business dealing with health matters, QUALITY of service is the key to success. ADVSP not only ensures QUALITY of all process steps, but also proves its compliance by providing detailed logs of information in respect to each processed prescription from point of origination to point of dispensing to CUSTOMER. ADVSP is the only technology that will be able to provide in-writing the routing and the environmental information for each prescription throughout all process steps. These valuable data will assure CUSTOMERS that from the point of origination to the point of dispensing to CUSTOMER, prescribed medication had remained within the required specifications parameters to retain its best QUALITY. ADVSP basic tracking mechanism is based on information contained on barcode labels, which are applied to: containers with prescription medication; ADVSP devices; and selected components inside ADVSP devices. Each device, such as: PVC (Portable Vending Cartridge)—examples illustrated on FIG. 32. AVM (Automatic Vending Module)—example illustrated on FIG. 33—will have a barcode label. Selected components inside PVC (carriers, conveyor, etc.) will also have barcode labels. Inside PVC and AVM a number of barcode reading devices are installed for each track to monitor important process statuses, such as: location of each container inside a carrier; location of container with carrier inside PVC or AVM; verification of container prior to dispensing to CUSTOMER. In addition to barcode labels, other tracking technologies, such as RFID—can be applied at the device level. For example, RFID can be attached to PVC and allow to track in real-time location of PVC with a number of completed prescriptions inside, as needed. Utilization of barcode labels and optional RFID will allow ADVSP controllers to implement real-time Inventory Management System (IMS), which will track and manage available ADVSP resources, and optimize their utilization to provide the best service to CUSTOMERS within set performance criteria. QUALITY, as it is considered in this example—includes all key aspects of business operations with an ultimate objective of providing the best product to consumers utilizing the most efficient and consistent processes. In this example, all process steps executed by ADVSP are monitored by ADVSP Automatic In-process Quality Assurance System, which includes ADVSP components such as: non-volatile controllers, sensors, environmental control devices, quality inspection devices, etc. All process steps executed by ADVSP are governed and monitored by respective QUALITY assurance procedures established by Provider, which are stored in non-volatile memory as ADVSP configuration parameters, and include: control algorithm, quality parameters. In this example—ADVSP is described for a very important process of the Pharmaceutical industry, which consists of providing prescription medications to consumers within respective industry regulation requirements. Refill prescription medications—represent a significant portion of business for the Pharmaceutical industry. Refill prescription medications—represent relatively stable process and is potentially very profitable part of the overall business. Stable processes are suitable for automation, which can provide substantial benefits, including—improvements in quality of service; expanding business market share; and maintaining competitive profit margins. ADVSP is the solution for the Pharmaceutical industry. There is no Pharmacy in the World outside ADVSP described in this application which can claim the refill prescriptions are guaranteed 100% to retain "Factory Sealed Quality", while providing the most effective service to consumers. There is no business in the World, outside technology of ADVSP that can achieve "100% Factory Sealed Quality" and remain profit compatible with businesses employing ADVSP. Even businesses, which are engaged in delivering individual prescriptions by regular mail, besides significant costs and risks, are not capable of ensuring in-writing that each prescription from the point of origination to the point of destination is maintained within required ambient environment. ADVSP, depending on business present size and objectives, can be configured to provide ultimate business-specific cost effective and efficient automation tools, which will not only meet business initial objectives, but will also provide foundation for a more aggressive strategy to expand business market share and increase profits. ADVSP by its definition and design principals—is a technology that not only recognizes the challenges Pharmaceutical industry is facing today, but also establishes a foundation and a clear path to meet business future needs and challenges.

Figure 80:
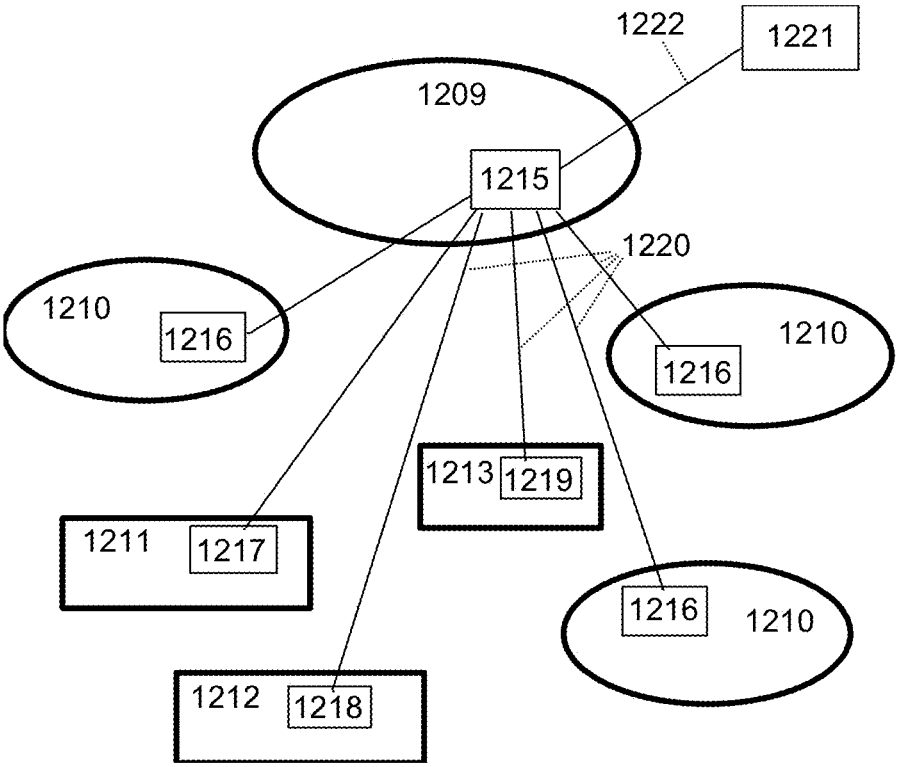
Figure 81:
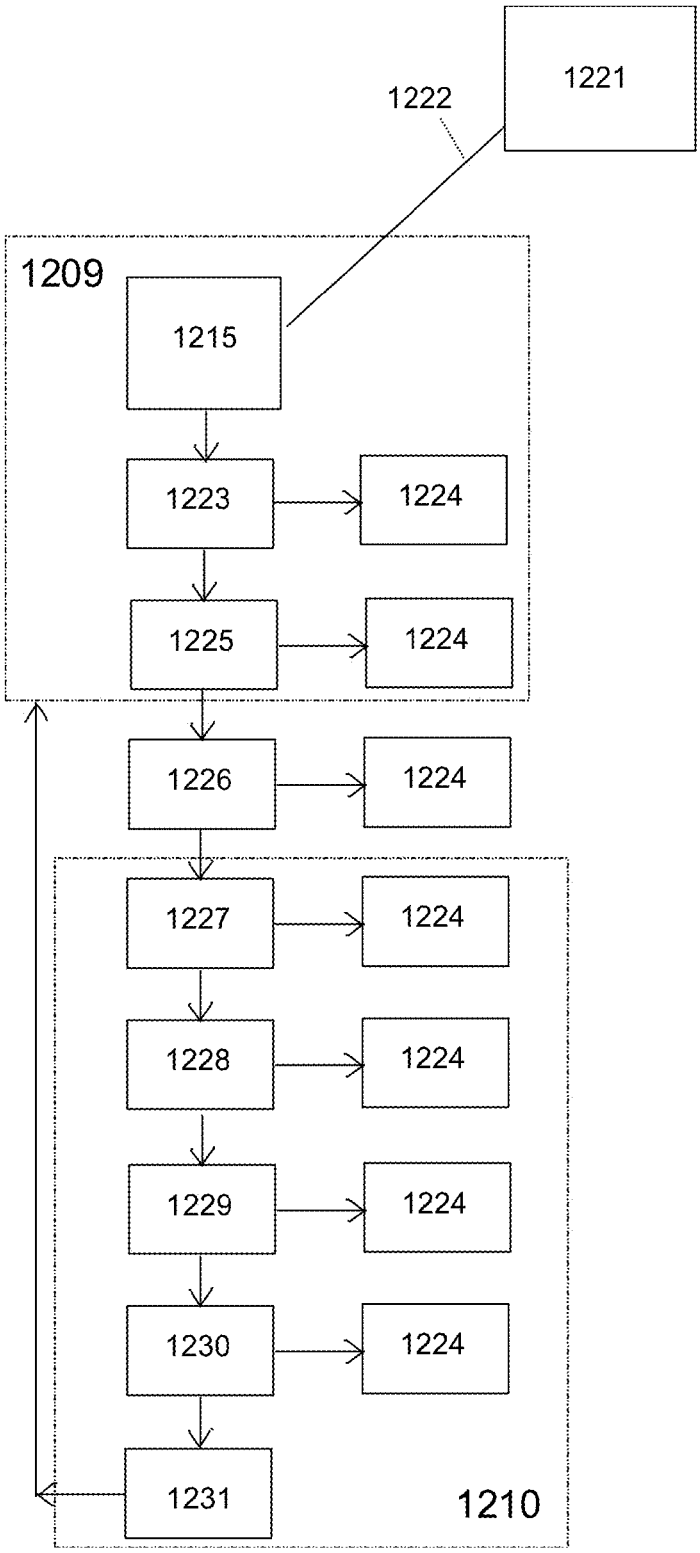

FIG. 80—illustrates a diagram of ADVSP LAN configuration of controllers in support of all processes described on FIG. 79 and on the next FIG. 81. Figure elements are labeled same as follows:

1215—Controller configured as HOST for the ADVSP Central Refill Center (1209)

1216—Controller configured as HOST for the ADVSP Pharmacy location (1210)

1217—Controller configured for ADVSP Stand-alone kiosk (1211)

1218—Controller configured for ADVSP portable kiosk at a patient residence (1212)

1219—Controller configured for ADVSP portable kiosk at a patient room at a medical facility (1213)

1220—LAN for ADVSP described on FIG. 80

1221—Remote controller configured as HOST for the ADVSP described on FIG. 80

1222—Network interface between HOST (1215) of the ADVSP Central Refill Center (1209) and remote controller (1221). Remaining elements are labeled same as on FIG. 80

FIG. 81—illustrates a diagram of selected processes of ADVSP described on FIG. 79. In this example—ADVSP is configured for a medium size Pharmaceutical COMPANY, an existing business or a start-up company, with an objective to improve efficiency of the Refill Prescription Processes to gain market share and increase profits. ADVSP configured to include Prescription Refill Distribution Centers (1209), or REFILL CENTER for simplicity, where the vast majority of refill prescriptions is processed for a business. The REFILL CENTER (1209) can be part of business for such large companies as Wal-Mart, Kroger, Costco, etc., serving Pharmacy locations within the business and Pharmacies outside the business under contract. The REFILL CENTER (1209) can be also established as an independent business serving all companies, small to large, under contract. The REFILL CENTER besides processing refill prescriptions, can also be configured to serve filled prescriptions directly to CUSTOMERS, including deliveries by mail. The REFILL CENTER can be configured to process over-the-counter medications in automation friendly containers, which can be distributed and dispensed using ADVSP technology. The REFILL CENTER, as the main and possibly the only center of processing refill prescriptions for a business, is staffed with the most qualified personnel, which is supported by the most effective technologies, including ADVSP, to achieve superior QUALITY of all processes. REFILL CENTER ensures the best security, safety and quality of raw materials, including adequate protection of dangerous and potentially health-hazard materials. REFILL CENTER ensures the most effective inventory management of all materials and technologies, in support of all real-time processes involved in producing the best quality refill prescriptions at the most competitive costs. ADVSP, coupled together with IT technology employed by the COMPANY, will ensure that each refill prescription is properly processed, and from the point of its origination at REFILL CENTER—will remain in a sealed CONTAINER within environmental specifications defined specifically for the type of medication, all the way—until the CONTAINER with medication is received by an authorized CUSTOMER. At REFILL CENTER—sealed CONTAINERS are loaded into ADVSP Portable Vending Cartridges (PVC). The loading process can be automated using ADVSP components to attain processing rates of up to one CONTAINER per second. ADVSP Controllers can be configured to execute controls based on predefined configuration parameters stored in non-volatile memory. Controllers will ensure each PVC is loaded with CONTAINERS based on criteria to achieve the most optimum distribution of CONTAINERS to designated locations, and for the most effective service of CONTAINER(s) at the designated location to authorized CUSTOMER. PVC in this example are configured to contain Dual track Synchronized Conveyor System (DSCS), supported by controller and conveyor drive components. PVC capacity of 40 CONTAINERS can be selected to optimize its size, weight and required throughput. PVC's (empty or loaded), due to their size and weight—are not lifted by individuals. Instead, ADVSP support components such as portable PVC racks, are used for storing, as well as transporting PVC's in-between Automatic Vending Modules. As result, PVC's capacity can be increased, as needed. The DSCS will maintain each CONTAINER in essentially stable condition during the entire time the CONTAINER is present inside PVC, including during DSCS frequent indexing motions and stops, those maintaining the integrity of the prescription, such as the ones consisting of solid pills, inside CONTAINER at all times. The DSCS configuration allows Controller to align two CONTAINERS at one end (CUSTOMER) and two CONTAINERS at the opposite end (PROVIDER) for simultaneous dispensing at both ends, as needed. ADVSP Controllers equipped with non-volatile monitoring system, will ensure QUALITY of CONTAINERS with medications at all stages, including distribution of CONTAINERS from REFILL CENTER to designated location such as: Pharmacy, medical facility, standalone ADVSP Vending Modules (AVM) at care facilities, etc. At the destination, PVC's are unloaded from delivery trucks, and are installed into ADVSP Vending Modules (AVM). The entire process is assisted by respective ADVSP loading/unloading components, with the ADVSP Controller directing the process sequence. In the example, AVM are configured to accept five PVC's, for a total AVM capacity of 200 CONTAINERS. AVM can be configured for indoor operation, or for outdoors. The AVM side facing CUSTOMER is configured to provide user-friendly interface, which depending on COMPANY requirements can consist of a touch-pad computer and other devices to complete required transactions. The AVM side facing PROVIDER (Pharmacy for example) is configured to provide user-friendly interface, which depending on COMPANY requirements can consist of a touch-pad computer and other devices to allow PROVIDER to monitor and control operation of AVM. Controllers within ADVSP, in order to execute required real-time process controls, are interconnected via LAN. Controller of each AVM will provide sufficient power and coordination for simultaneous use of PVC's installed inside. This will allow service rates of up to 10 CONTAINERS being dispensed to an authorized CUSTOMER within few seconds. The layout of AVM units for a specific configuration indoors and outdoors is selected to allow simultaneous service of CONTAINERS with prescription medications to respective authorized CUSTOMERS at each AVM, achieving outstanding service rates, while maintaining "Factory Sealed Quality" at very competitive prices for consumers. In respect to costs—ADVSP is expected to outperform any existing technology not only in superior performance. Businesses employing ADVSP will achieve ultimate objective of any business by providing consumers with the best product, the best service, and the lowest price. NOTE: The entire process is controlled and monitored by ADVSP Process Control Computers (APCC), which direct all process priorities and establish process flow to achieve the most optimum performance of the entire ADVSP to provide best service to Customers at designated locations at lowest costs. In addition, each process step is monitored and verified by Automatic In-process Quality Assurance System. ADVSP technology is the only cost effective solution to ensure "100% Factory Sealed Quality", which can be proven in-writing by providing logs with routing and environmental time based information via print-out reports for each prescription drug delivered to CUSTOMER. The log can contain such information as: origination date, routing schedule, environmental data—temperature (max, min), humidity (max, min), medication weight, container size, etc.

FIG. 81 illustrates configuration of ADVSP in support of the following process steps:

Step 1: Process Refill Prescription

Process (1215)—refill prescriptions are received at the REFILL CENTER (1209) by Controller (1215) directly from the company data base stored on HOST (1221) via interface (1222). This process is driven by HOST (1221) and can be based on established schedule. Only at the REFILL CENTER (1209), and only authorized personnel—has access to sensitive CUSTOMER information. At REFILL CENTER (1209)—raw materials are stored in secured, safe and environmentally controlled locations, and their inventory levels maintained by Controllers per current demands.

Process (1223)—at the REFILL CENTER (1209) prescriptions, based on information provided by controller (1215) are filled by experienced pharmacist using latest technology for accuracy and quality control. Each CONTAINER is selected based on Controller optimizing the type and size of CONTAINER for specific medication to be stored inside CONTAINER. CONTAINER with prescription medication is sealed, and its parameters such as: barcode label information, weight, size—are verified by Controller via respective ADVSP components. Containers with processed prescriptions are identified by barcode label, containing important data about the prescription, destination, CUSTOMER, date, etc. Upon completion of (1223)—respective LOG for container with prescription medication is created, and stored in non-volatile memory. The process of updating the LOG is indicated by (1224). The LOG at this point can include the following information: originator of order—name, location, date; recipient of order: name, location expected, date expected; order number; prescription process: location, date, name, medication description, dosage, customer name, expiration date; destination: location, date, time; prescription prepared: date, time, location, operator; medication specifications: weight, temperature min/max, humidity min/max; etc.

Process (1225)—based on destination and CUSTOMER orders at the destination—Containers with prescribed medications are loaded into Portable Vending Cartridges (PVC), such as the one illustrated on FIG. 31 via Automatic Loading System (ALS), including PVC Portable Racks. ALS can use Automatic Vending Modules (AVM), such as the one illustrated in FIG. 33 installed on a portable rack, where empty PVC's are inserted and then loaded with required items (medications). ADVSP configuration parameters stored in non-volatile memory will include loading algorithm of items (medications) into PVC, including optimization of available tracks and carriers inside PVC to ensure medications for each customer are located inside PVC in close proximity to allow dispensing of these medications, when requested at the point of destination (pharmacy, kiosk, etc.)—at the maximum rate of dispensing which can be achieved. Each PVC for example can be configured to hold 40 Containers, advanced via parallel dual track conveyor system. Environment inside PVC and access to Containers inside is continuously monitored by PVC Controller non-volatile monitoring control system, such as the one illustrated on FIG. 62. PVC's with Containers of prescription medications are removed from ALS, and loaded into delivery trucks equipped with AVM modules and shelves to secure each PVC during delivery, or stored inside REFILL CENTER for scheduled delivery. PVC Controllers contain non-volatile electronics operated under battery power, which are continuously performing self-diagnostics in respect to security and environment surrounding the CONTAINERS with prescribed medication stored inside PVC. Security self-diagnostics include monitoring of access gates to the interior of PVC, while environmental diagnostics—include monitoring of the environment surrounding CONTAINERS. If any abnormal condition detected, it is recorded by the PVC Controller in a non-volatile memory. PVC on the front panel can be configured to provide user interface with a "self-diagnostics" button, or switch, which is when activated—will enable "status" LED also located on the front panel to indicate via pre-defined time-based blinking sequence the status of the PVC, including results of "self-diagnostics". PVC can be configured to include electronics for monitoring the humidity inside, which will enable PVC Controller to record the log of humidity levels (max/min). Upon completion of process step (1225) the LOG created at step (1223) is updated by log update process (1024) to include the following information: security status—ok; environment—ok; PVC identification.

Step 2: Delivery of Processed Prescriptions

Process step (1226). Delivery trucks (not shown on FIG. 80 for simplicity) can be configured with environmentally controlled chambers. As illustrated on FIG. 80-*primarily* during off-hours, when traffic is at minimum, delivery trucks transport Portable Vending Cartridges (PVC's) to their destinations at ADVSP pharmacies (1210) located along the route (1214), stand-alone ADVSP pharmacy kiosk (1211), ADVSP pharmacy portable kiosk (1212), Customer designated locations (1213), including: residence, patient rooms, etc. ADVSP delivery trucks can be configured with Controllers for managing: inventory of raw materials, other supplies. An example of a routing path for delivery trucks is shown by (1214). As shown, loaded PVC units with prescription medications filled at (1209) and destined for ADVSP pharmacy (1210) are transported inside AVM units to destination—ADVSP pharmacy (1210). Upon completion of process step (1225) the LOG created at step (1223) is updated by log update process (1024) to include the following information: delivery: date, time, location; AVM ID and AVM section ID where PVC with prescription is installed. Process step (1227). Upon arrival at the destination—ADVSP pharmacy (1210), PVC's visually inspected for their integrity. Non-volatile security diagnostics inside PVC are verified by PROVIDER to ensure the content is safe and was maintained in the specified environment. Inspected PVC's are removed from the truck via ADVSP portable racks and then delivered to respective Automatic Vending Module. The allocation of PVC's, and the order of loading of each PVC into a given Automatic Vending Module (AVM) is controlled by ADVSP Process Control Computers, and quality of each medication is verified for compliance to respective quality parameters defined by configuration parameters stored in non-volatile memory. As shown in the example Drawings (FIG. 35), each AVM will hold 5 PVC's, for a total capacity of 200 Containers with prescribed medication for each Vending Module. Previously used (empty) PVC's, as needed, are loaded into delivery truck for re-use at the REFILL CENTER. ADVSP supports intelligent real-time inventory management control, with Controllers efficiently monitoring and re-allocating items within ADVSP. Example: CONTAINERS can be automatically unloaded and/or manually removed from nearly empty PVC, and then loaded automatically and/or manually to partially loaded PVC, for most efficient utilization of PVC's, and available space inside them. During transportation, PVC electronics are operated in "low power mode" under battery power, and periodically perform self-diagnostics in respect to security and environment surrounding the CONTAINERS with prescribed medication stored inside PVC. Security self-diagnostics include monitoring of access gates to the interior of PVC, while environmental diagnostics—include monitoring of the environment surrounding CONTAINERS. Upon completion of process step (1227) the LOG is updated by log update process (1024) to include the following information: security status—ok; environment—ok; delivered—date, time, location. Other materials, such as raw materials, support equipment—can be also delivered from (1209) to (1210), as needed.

Step 3: Sustaining of Processed Prescriptions

Process step (1228)—at the ADVSP pharmacy (1210) inventory of each Automatic Vending Module is monitored by Controllers, and availability of refilled prescriptions at each location is stored in the central data base at (1209). Each PVC can be configured with synchronized dual belt dual track synchronized conveyor system (DSCS), including the configuration capable to present 2 Containers on each side (4 total) for simultaneous unloading or vending out of CONTAINERS stored inside carriers. The designs of the DSCS will ensure that each CONTAINER is maintained in essentially stable condition inside its carrier during the entire time the CONTAINER is present inside PVC, including during DSCS frequent indexing motions and stops, those maintaining the integrity of the prescription, which contains solid pills of a specified dosage based on the pill volume. In the example—Controller of Vending Module can advance Containers inside each PVC independent of other PVC's inside the Vending Module. Vending Module controller will optimize power utilization, and allow parallel operation of each PVC to achieve the highest throughput while minimizing power demands. Each Vending Module can be configured to dispense 2 Containers with prescription medication to a CUSTOMER at a rate of 2 Containers in less than 5 seconds. Environment inside each Automatic Vending Module (AVM), as well as access to content inside—is continuously monitored by Controller non-volatile diagnostics. Any deviation from specified requirements is reported by Controller, and corrective controls, as defined by configuration parameters, can be promptly executed directly by Controller without operator assistance. While inside AVM, each PVC Controller will continuously perform self-diagnostics in respect to security and environment surrounding the CONTAINERS with medication located inside PVC. Security self-diagnostics include monitoring of access to selected gates to the interior of PVC, while environmental diagnostics—include monitoring of the environment surrounding CONTAINERS inside PVC. If any abnormal condition detected, it is recorded, and promptly reported by PVC Controller to AVM Controller. AVM configuration can include temperature control and humidity control of the environment inside AVM, based on information provided by PVC Controllers. Upon completion of process step (1228) the LOG is updated by log update process (1024) to include the following information: security status—ok; environment—ok; location; status: ready for pick-up.

Step 4: Vending of Processed Prescriptions

Process step (1229)—CUSTOMER has several options to obtain medication(s). In the example at ADVSP Pharmacy (1210)—a CUSTOMER can be notified by pharmacy personnel or ADVSP controller by phone, and/or email that a prescription(s) is ready at location specified by CUSTOMER. Upon arrival, CUSTOMER will be required to provide security identification information at the Host Terminal, such as the one illustrated on FIGS. 1, 2. Upon completion of process step (1229) the LOG is updated by log update process (1024) to include the following information: security status—ok; environment—ok; AVM: number, location; status: ready for pick-up; customer—notified, pick-up date.

Process step (1230)—as soon as the first ID of a CUSTOMER has been verified by Computer, if the respective PVC containing prescribed medication for the CUSTOMER is not occupied by servicing another CUSTOMER, then it will be instructed by the Host Terminal to begin to advance respective Containers toward CUSTOMER side of the Vending Module, in preparation for dispensing to CUSTOMER. This is an exceptional feature of technology implemented by ADVSP to sustain parallel processing in order to achieve the most effective service to Customers. Upon completion of all security identifications, the CUSTOMER will be directed by the Host Terminal to proceed to a Vending Module for pick-up of medication(s). At the Vending Module, the CUSTOMER will be required to verify some of the identification at the Controller of the Vending Module. Upon successful verification, the Customer will be instructed to select available prescription medications for pick-up. Once CUSTOMER request is verified and paid for, ADVSP will dispense respective medications to CUSTOMER at once. Upon completion of process step (1230) the LOG is updated by log update process (1024) to include the following information: security status—ok; environment—ok; AVM: number, location; customer verification: ID #1, ID #2, . . . ; medication ID; pick-up—date, time. The log can be formatted to fit within required printer limitations, and at the bottom of the log —phrase "100% Factory Sealed Quality" as assurance. In addition, when requested by CUSTOMER, a log for each prescription will be printed out and deposited into the bag with medication. Instructions on how to use medications can be obtained by CUSTOMER as print-outs at either: the Host Terminal of (1209), the Vending Module terminal, or obtained from the Service Window.

Process Step (1231)—empty PVC units, as available, and other materials, equipment—are picked up from ADVSP pharmacy (1210) and delivered to ADVSP central (1209), as needed. Provider, as needed, can configure ADVSP controllers to direct the process of re-allocation of items between PVC units, so that partially empty PVC can be emptied out completely, by moving its remaining items to other PVC's with available carriers, and emptied PVC returned to Refill center (1209) for re-use. In the example—each Vending Module will contain security bags or packaging for vended medications. CUSTOMER will be instructed before leaving the ADVSP pharmacy or a stand-alone ADVSP pharmacy kiosk—to inspect each vended CONTAINER with prescribed medication to ensure the seal is not tempered with. In summary, the ADVSP technology not only ensured the most pleasant service, but also provides each CUSTOMER with prescribed medications, guaranteeing that each medication retained "100% factory-sealed QUALITY". The ADVSP layouts are configured to support centralized processing via REFILL CENTER (1209). In addition, ADVSP can be configured to support also local in-store dynamic processing of prescription medications, utilizing state-of-the-art ADVSP technologies. In the example (FIG. 1), ADVSP-1200 can be configured with four Automatic Vending Modules AVM-200 (units 2, 3, 4, 5) allocated for centralized processing via REFILL CENTER, and two AVM (units 1, 6) allocated for in-store dynamic processing of prescription medications. In addition, AVM (unit 6) can be configured to operate and contain medications inside at refrigeration temperatures. As result, the ADVSP-1200 shown on FIG. 1 can be configured to support directly 800 prescriptions filled at REFILL CENTER, and additional 400 on-site. In addition, there can be other loaded PVC's on-site available for extra capacity and utilization per real-time demand. ADVSP also supports utilization of all AVM-200 units for a combination of centralized and local in-store processing of prescription medications. As needed, all AVM-200 units can be effectively used for either centralized or local in-store processing of prescription and non-prescription medications. In the example illustrated by Drawings (FIG. 1), ADVSP is supported by two Host Terminals (6, 15), one on each side, for convenience. There is also a Service Window (21) for direct customer service by a pharmacist on-site, as needed. In the example—each AVM is configured with user-friendly interface for CUSTOMER (ATM type), and process friendly interface for PROVIDER (Pharmacist), which is behind "the curtain". Both interfaces are selected by business, from a variety of interfaces supported by ADVSP, to provide the most pleasant experience for CUSTOMERS and most rewarding experience for PROVIDERS (Pharmacy). One of available SEQUENCES for serving CUSTOMERS is described below. The entire sequence of process steps is regulated by business HOST computer, such as (1215), which can be located at (1209), and which is in direct communications with respective ADVSP computers to sustain comprehensive real-time CONTROL of all events, with an objective to meet a set of operating criteria, including ADVSP implemented in-process AQAS to ensure "100% factory-sealed QUALITY" of any and all prescriptions delivered to CUSTOMER. PVC units are loaded with prescription medications at REFILL CENTER (1209), servicing the area where the specific Pharmacy is located. Processing of prescriptions at REFILL CENTER is based on information provided to REFILL CENTER by business HOST computer. AVM units can be configured to be used at the ADVSP central location for loading PVC's with items. Loading of each PVC can be configured to be based on specific CUSTOMER information, including: location, number of active prescriptions, service date/time, etc. with an objective to sustain the most effective and efficient processing at all operational locations, including dispensing. Loading algorithm of items (medications) into PVC can be configured to include optimization of available tracks and carriers to ensure medications for each customer are located inside PVC in close proximity to allow dispensing of these medications, when requested at the point of destination (pharmacy, kiosk, etc.)—the maximum rate of dispensing can be achieved. PVC's depending on schedule can be fully or partially loaded. Each PVC can be configured to have a specific barcode information label, which can include: PVC weight, capacity, destination (Pharmacy). Loaded PVC's are transported to Pharmacy, which is informed of the ETA. At the Pharmacy, ADVSP CONTROLLER based on real-time Inventory Management System (IMS) will determine which AVM units are most suitable for accepting PVC's, and will instruct the operator at the Pharmacy to prepare AVMs for loading. Preparation of AVM for loading is performed by on-site operator under direction of ADVSP CONTROLLER, and may include: removing empty PVC's; re-allocating some prescriptions from nearly empty PVC to another PVC with open slots inside the same AVM or available AVM; when loaded PVC arrives, their integrity and label information is verified by CONTROLLER. Adjustments are made, as needed, based on results; as directed by CONTROLLER, respective empty PVC's are replaced with loaded PVC's in each designated AVM unit; the IMS is updated, and respective CUSTOMERS are informed (phone, email) that their prescription is ready for pick-up. Empty PVC's are transported back to REFILL CENTER (1209) for re-use. Upon arrival to the Pharmacy, CUSTOMER will approach available HOST Terminal and provide required information. Level of security in verification of CUSTOMERS selected by business is supported by ADVSP. As soon as the first ID of the CUSTOMER is verified at the HOST terminal, respective AVM if available, will begin advancing respective PVC with CUSTOMER prescription(s) toward dispensing window. After CUSTOMER information was accepted and verified, CUSTOMER will be instructed (voice, image, text message, print-out) to which AVM ID to proceed inside the Pharmacy to obtain prescription(s). At the HOST Terminal—CUSTOMER has options to view/print instructions pertaining to prescriptions, and other valuable information. The ID number of AVM containing CUSTOMER prescription(s) will stay RED while being busy, and turned GREEN when is ready. At that point—CUSTOMER will be required to provide some information (security, prescription, etc.) and pay for requested items. When all is verified- and paid for, AVM will dispense requested prescriptions into a security bag or package, for convenient pick-up by CUSTOMER. Depending on number of prescriptions, the service of a CUSTOMER by AVM may take as little as few seconds. In addition, based on: number of AVM available; PVC installed; real-time inventory status of items, ADVSP controllers will perform optimization algorithm defined by ADVSP configuration parameters, which includes algorithm for Controller to coordinate available resources on-site (Pharmacy) to achieve the most efficient and effective service of CUSTOMERS with minimum delays. As illustrated, ADVSP components can be configured as closed-loop real-time process control system with Controllers executing algorithm defined by ADVSP configuration parameters, allowing Controllers to optimize utilization of pharmacy resources, and providing the most effective service to customers, and most efficient results for providers, with highest quality of products—by delivering only medications within required specifications parameters to Customer. Remaining components are labeled same as on FIG. 79.

Figure 82:
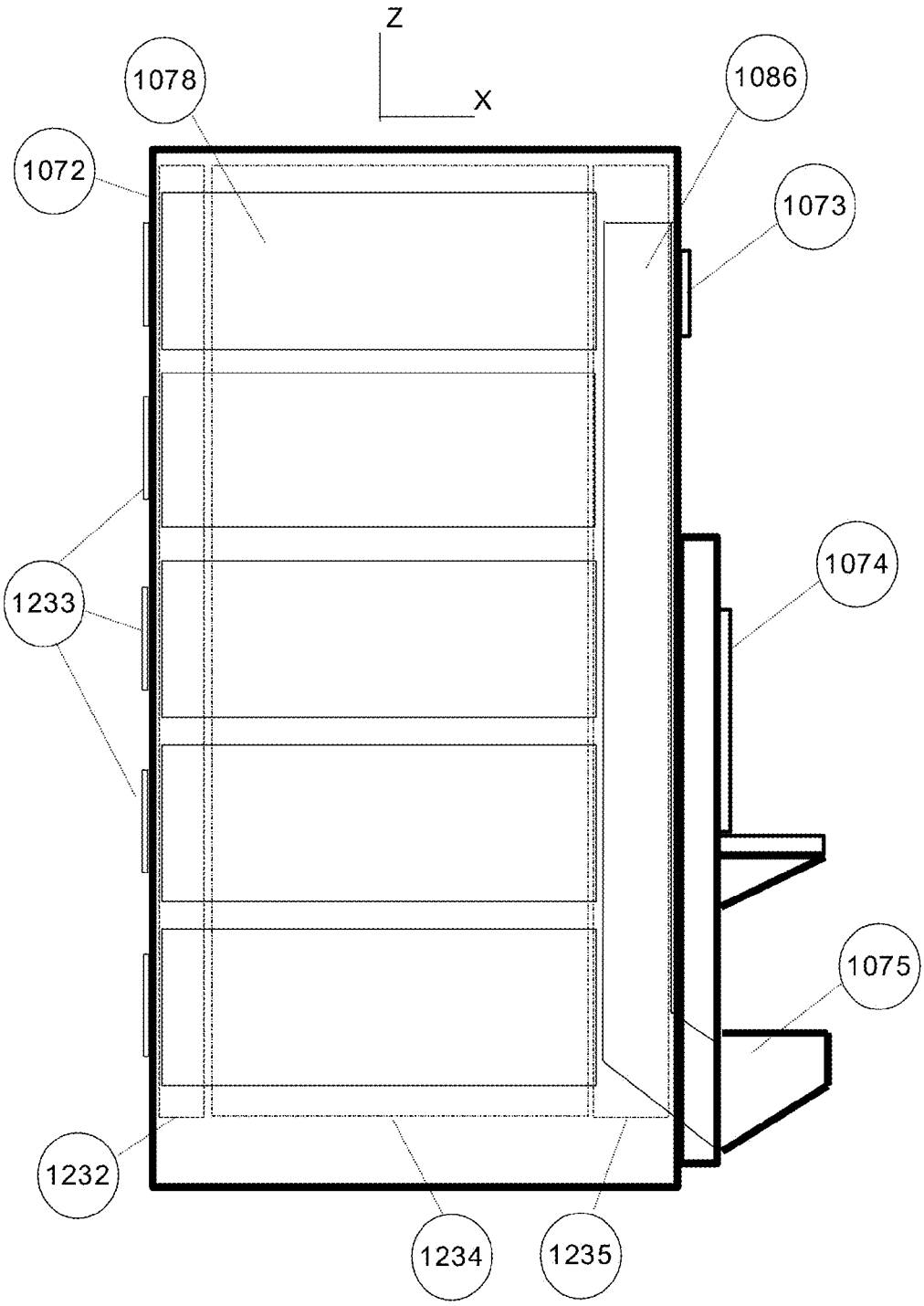

FIG. 82—illustrates Z-X view of assembled AVM (1072), such as AVM-200, shown on FIG. 34, configured with addition of thermal insulation layers (1232, 1233, 1234, 1235). In addition to thermal insulation, heat generating components, including conveyor drivers, can be configured inside each PVC away from the carriers, as shown on FIG. 18, further assisting Controllers in maintaining items, such as medications, test samples—within required specifications, including refrigeration temperatures. Figure elements labeled:

1232—Thermal insulation layer of the carriers inside PVC modules from the Provider side

1233—Insulation doors for accessing PVC modules inside, Provider side

1234—Thermal insulation layer of the carriers inside PVC modules from all sides

1235—Thermal insulation layer of the PVC modules from Customer side

Remaining elements are labeled same as on FIG. 35

Figure 83:
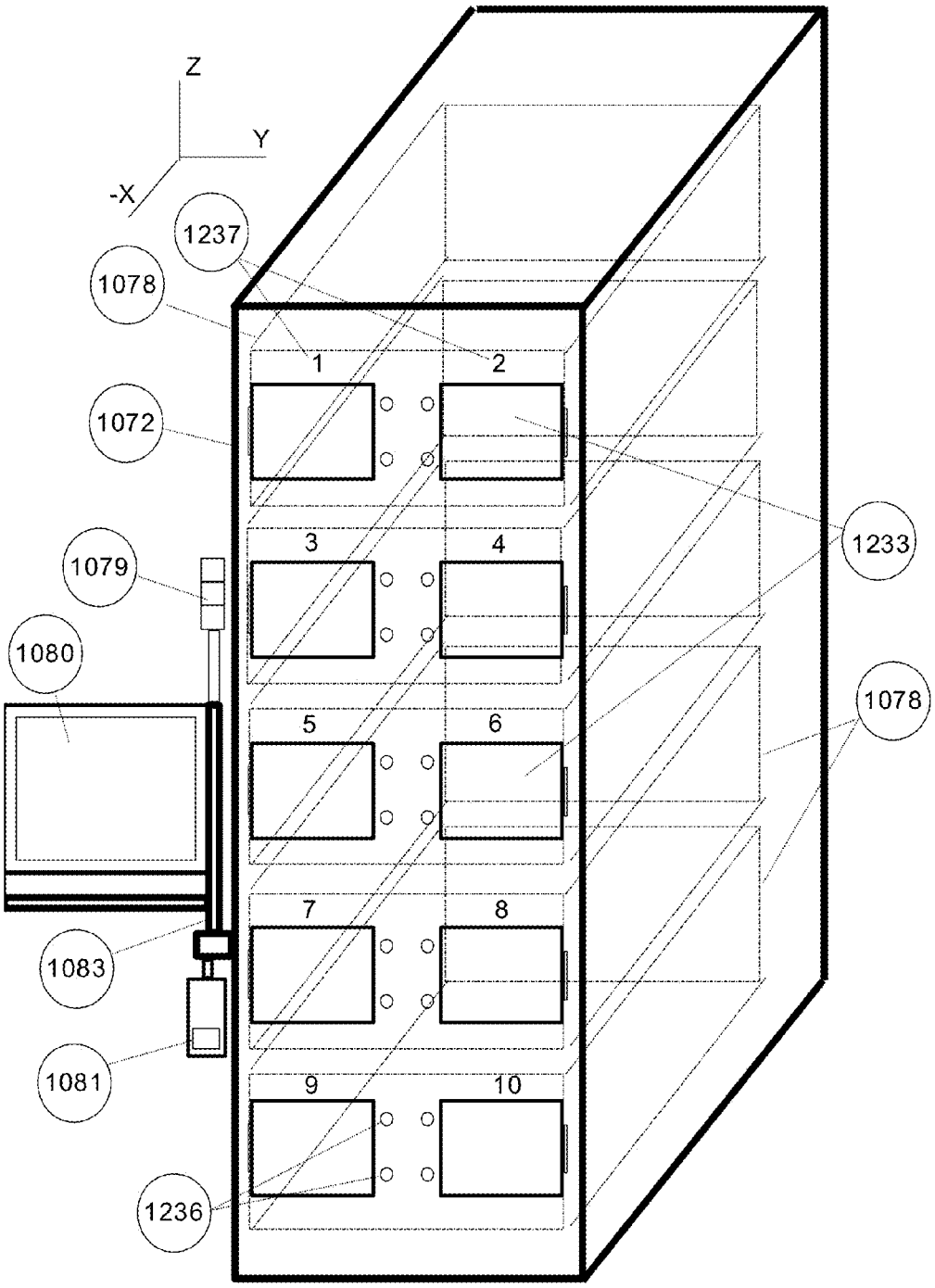

FIG. 83—illustrates 3-D view of assembled AVM shown on FIG. 82. Figure elements are labeled as follows:

1236—Status indicators (such as LED) for each door gate (1233), which can be configured by Controller to indicate to Provider the respective carrier is ready for either: loading, unloading, inspection.

1237—Numeric identifications for each door gate (1233)

Remaining elements labeled same a FIG. 82

Figure 84:
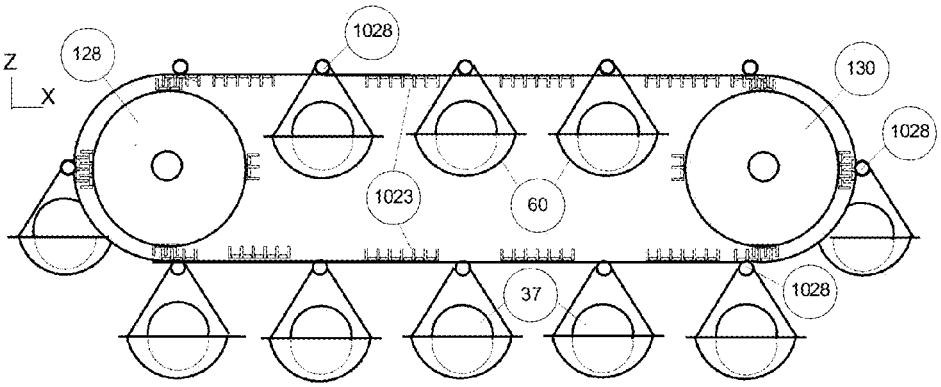
Figure 85:
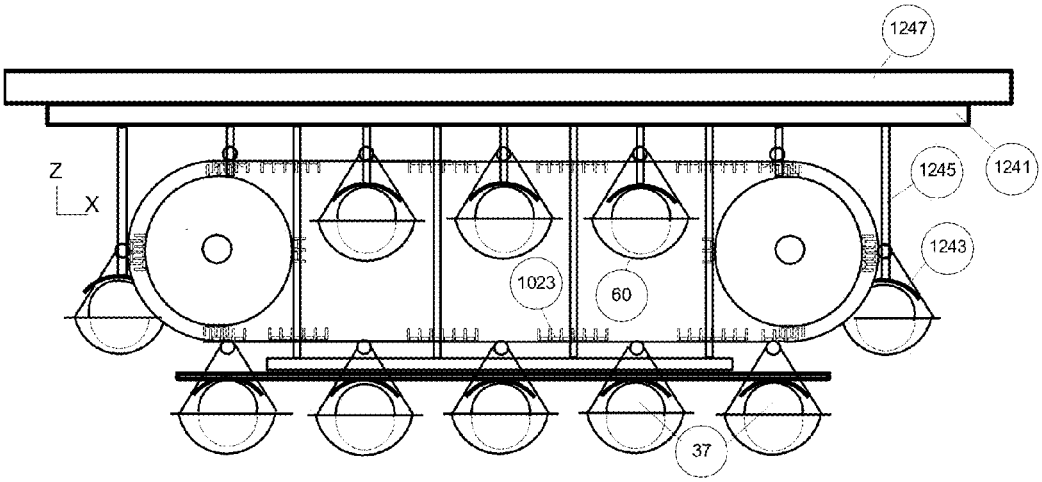
Figure 86:
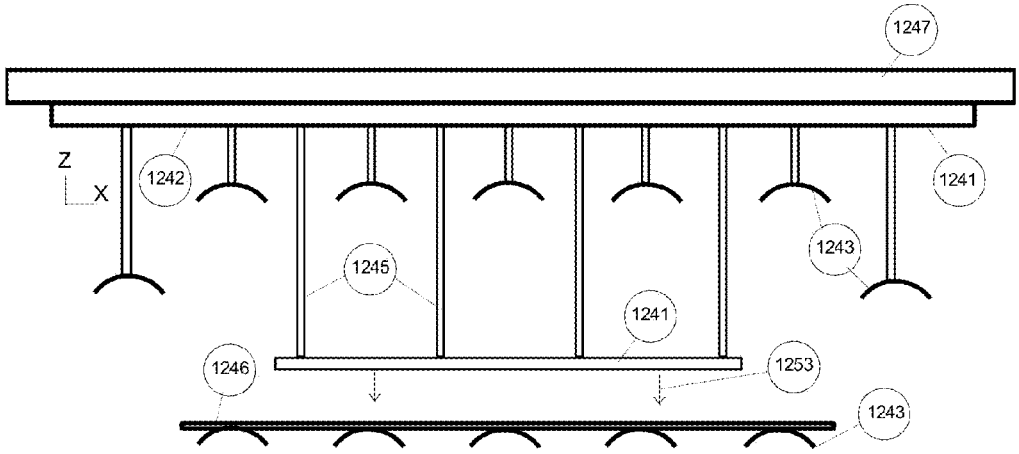

FIG. 84—illustrates Z-X view of a carrier conveyor (1023), which is for simplicity is configured as synchronized dual belt single track. For simplicity, other components, such as: PVC outline where the conveyor (1023) is installed, support wheels for the carriers on each side opposite to the conveyor—are also not shown. FIGS. 84, 85 and 86 illustrate method to secure each item (37) inside respective carriers (60) during transportation of PVC. Figure elements are labeled as follows:

128—Support drive pulley for Timing Belt Conveyor (1023)

130—Support idle pulley for Timing Belt Conveyor (1023)

1023—Timing Belt conveyor with embedded permanently attached bearing assemblies (1028)

FIG. 85—illustrates Z-X view of the conveyor (1023) shown on FIG. 84, and a top plate (1247) configured to be attached to the top of a PVC (for simplicity the outline of the PVC is not shown) where conveyor assembly (1023) is installed, and further configured to include item retaining assembly (1241). The item retaining assembly (1241) is configured to extend its components (1245) just above each item (37) and prevent the item (37) from rolling out of its respective carrier (60) during transportation. For carrier configurations with a base-plate (63), reference FIG. 104, which are configured to retain vials (69) with test samples inside the vials, the retaining bracket (1243) will be configured to align with the lid of the vials (71) and prevent the vials (69) from falling out of the base plate (63) during transportation. The item retaining assembly (1241) can be configured for process controls, and include a process-specific component, such as flex heater, which can be configured to attach to selected sections of the (1247) facing the item. The process component of (1241) under directions by Controller will execute process-specific controls, such as temperature controls, which can be required to maintain items (37) within specifications, as outlined in apparatus configuration parameters.

FIG. 86—illustrates Z-X view of a top plate (1247) with attached item retaining assembly (1241), described on FIG. 85. The top plate (1247) and the item retaining assembly (1241) can be configured to include process-specific component, such as flex heater, which can be configured to attach to selected sections of the (1247) and (1241), including sections facing the item. The flex heater can be configured under directions of Controller to maintain specific temperature of the area in the near proximity from the top of the item (37), as required by item specifications included in the apparatus configuration parameters. The heater can be configured to maintain a specific temperature profile. All components shown, can be configured, including: selection of materials, shape—to support process control functions. Figure elements are labeled as follows:

1242—Bottom surface of (1241) to which retaining arms (1245) are attached

1243—Retaining bracket configured to match the outline of the item (37), which will be placed just above the item (37) and prevent the item (37) from rolling out of its respective carrier (60) during transportation. As needed, the retaining bracket can be configured to fully engage with the item (37) inside carrier (60), and together with the base components of the carrier prevent the item from any movement inside the carrier. Retaining bracket can be configured to include process-specific component, such as flex heater, which is attached to the surface of the (1243) facing the item. The flex heater can be configured under directions of Controller to maintain specific temperature of the area in the very near proximity from the top of the item (37), as required by item specifications included in the apparatus configuration parameters. For carrier configurations with a base-plate (63), reference FIG. 104, which are configured to retain vials (69) with test samples inside the vials, the retaining bracket (1243) will be configured to align with the lid of the vials (71), and the flex heater attached to the surface or embedded into the (1243), can be configured by Controller to execute item-specific process control, including preventing the content of the vial (69) from evaporating from the vial through the lid (71), as outlined in apparatus configuration parameters.

1246—Lower section item retaining assembly with attached (1243). The lower section (1246) in the direction (1253) is configured to attach to (1241), and is configured to extend its components (1245) just above each item (37) in the lower section of the conveyor (1023) and prevent the item (37) from rolling out of its respective carrier (60) during transportation.

Figure 87:
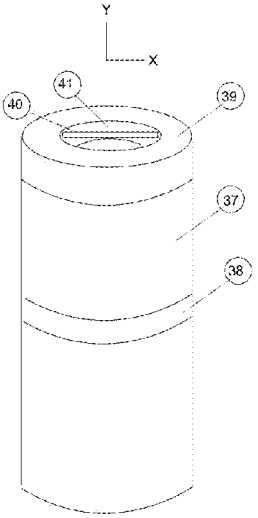

FIG. 87—illustrates a cylindrically configured Item or an Item housed inside cylindrical Container. Container shown on FIG. 87, 88, 89 are configured to support item-specific specification requirements listed in the non-volatile memory under apparatus configuration parameters. Figure elements are labeled as follows:

37—Cylindrical Container, which can house one Item. Container can be made out of plastic.

38—Container circular barcode label, which can be in a form of a tape wrapped around body of Container as shown. Barcode label can contain information about Container and/or it's content.

39—Container lid, which protects content inside

40—Container lid pull-out handle

41—Container lid recess area

Figure 88:
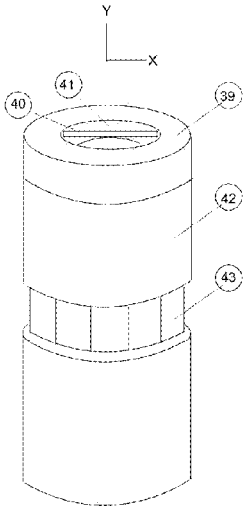

FIG. 88—illustrates a cylindrically shaped Container, which can be configured for housing several Items. The middle section of Container is configured for convenient handling by ADVSP loading and unloading components. The interior of the Container can be configured to have vertical and/or horizontal separator walls/panels, as shown on FIG. 89. Figure elements are labeled as follows:

39-41—are labeled same as on FIG. 87

42—Compartmental Container, which can house several Items

43—Section of Container, which is shaped for convenient handling by ADVSP loading and unloading components, and which can be configured for placement of a barcode label.

Figure 89:
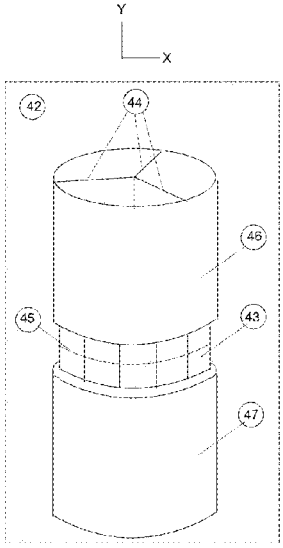

FIG. 89—illustrates a cylindrically shaped compartmental Container with the lid removed. As shown, Container is configured with six individual compartments, each of which can house an Item. Figure elements are labeled as follows:

39-43—are labeled same as on FIG. 87

44—Compartmental Container vertical separator walls

45—Compartmental Container horizontal separator walls

46—Compartmental Container upper section(s)

47—Compartmental Container lower section(s)

Figure 90:
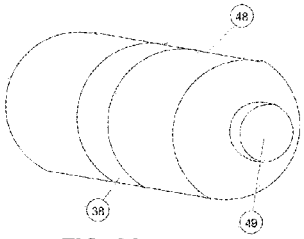

FIG. 90—Item or Container (48) shaped in a form of a bottle with barcode label (38) and lid (49).

Figure 91:
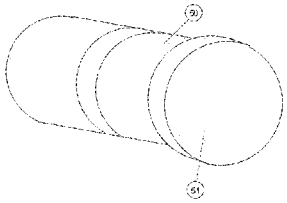

FIG. 91—Container (50) similar to (48) shown on FIG. 90, configured with a different type lid (51).

Figure 92:
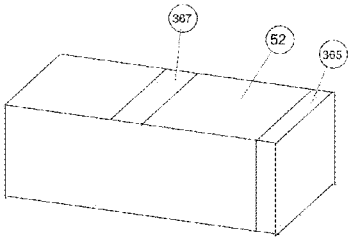

FIG. 92—Item or Container (52) shaped as a rectangular box, with barcode label (367) and lid (365).

Figure 93:
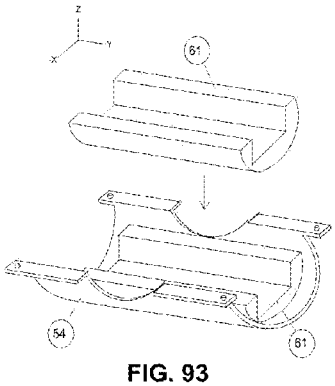

FIG. 93—Illustrates Carrier Insert (61) configured for rectangular type Items. The base (54) can be configured to match the outer surface geometry of respective Item or Container it will need to house inside. For more flexibility, an Insert (61) can be configured to have inner surface matching the outer surface geometry of respective Item and used, as shown. The outer surface of Inserts can match the inner surface of Carrier base assembly (54). The Insert (61) can be configured to provide thermal insulation for the Item residing inside. The methods of attaching and securing Inserts (61) inside the Carrier base assembly (54), include: mounting screws, glue, Velcro-type strips, etc. Depending on application, Carrier Inserts can be configured to be made out of plastic (molded), or sheet metal, or aluminum, etc.

Figure 94:
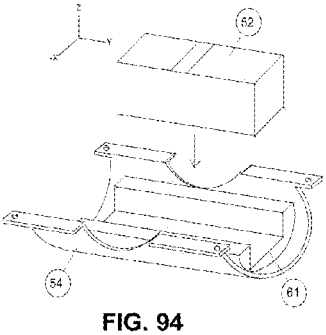

FIG. 94—Illustrates rectangular type Item (52) being placed inside Carrier base assembly (54) with attached Insert (61) configured to match Item's shape.

Figure 95:
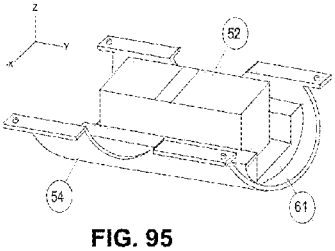

FIG. 95—Illustrates rectangular type Item (52) inside Carrier base assembly (54) configured with Insert (61) inside to match Item's shape. Velcro-type strips (not shown) can be added to the inner surface of (61) to engage with mating Velcro-type strips of (52).

Figure 96:
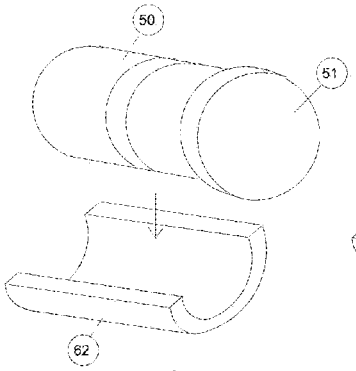
Figure 97:
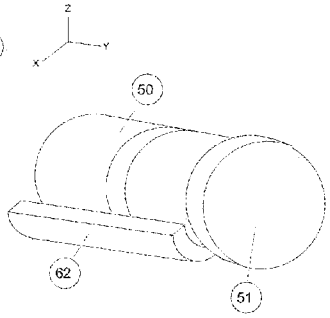

FIG. 96 and FIG. 97—Illustrate Carrier components and it's assembly steps configured for applications with cylindrical type Item or Container packing (50), which has a rather large lid (51). As with the previous case, this Item packing can be accomplished by Item specific Insert (62). Velcro-type strips (not shown) can be added to the inner surface of (62) to engage with mating Velcro-type strips of Item or Container, to secure their position inside Insert and Carrier. Depending on application, Carrier components can be configured to be made out of plastic (molded), or sheet metal, or aluminum, etc.

Figure 98:
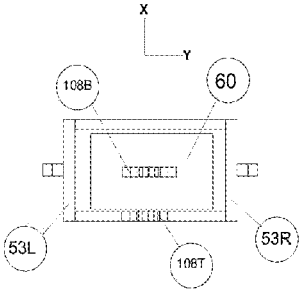

FIG. 98—Top view of the empty Carrier (60). Figure elements are labeled as follows:

53L—Carrier support assembly, left side

53R—Carrier support assembly, right side

60—Conveyor Carrier assembly (not all components are shown)

108B—Carrier barcode label, located at the bottom of Carrier. Barcode label can be configured to contain information about the Carrier. The information can include Carrier parameters, which can be used by ADVSP for proper identification and usage of the Carrier for respective range of Items or Containers. This barcode label at the bottom will be covered by Item or Container loaded inside the Carrier. This fact can be detected by respective ADVSP Controller, and can be used by Controller to verify or establish if respective Carrier is loaded or not, and also used by ADVSP computer(s) for overall real-time inventory management of available capacity of empty Carriers with an objective to optimize their loading to achieve prompt availability of specified Items at designated locations.

108T—Carrier barcode label, which can be the same as 108B, but located on top of Carrier side ledge. This barcode label can be used by respective ADVSP Controller for continuous verification of presence of respective Carrier within the system.

Figure 99:
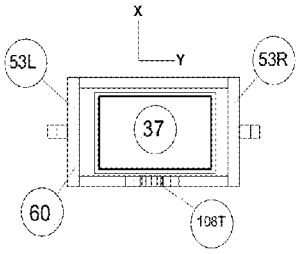

FIG. 99—Top view of the Carrier shown on FIG. 98 with Container (37) inside. The container can be filled with medications. Figure elements are labeled same as on FIG. 98

Figure 100:
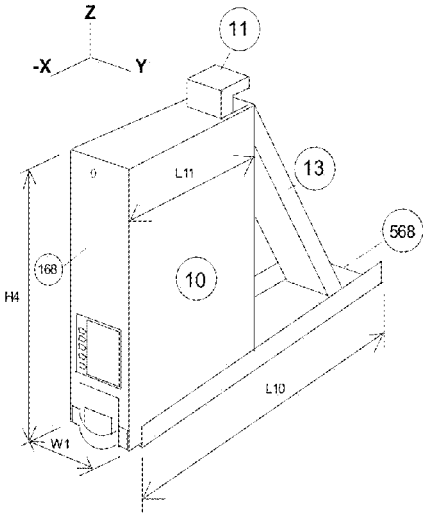
Figure 101:
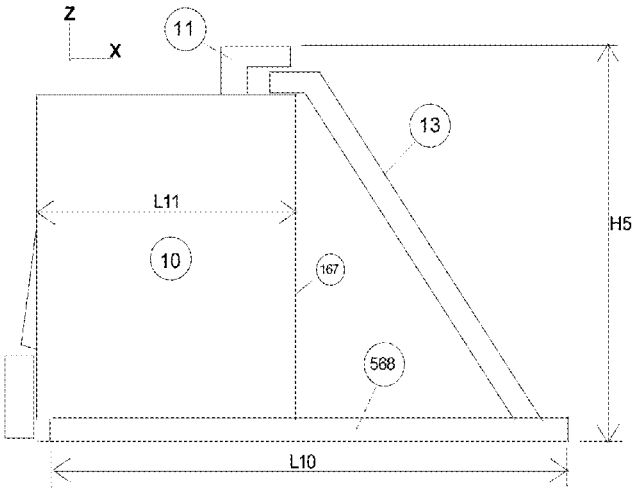

FIG. 100 and FIG. 101—Illustrate an example of installation details of Automatic Vending Module (AVM) (10), supported by Automatic Loading components (11, 13). Controller will coordinate all components to ensure items are loaded into carriers inside AVM, as outlined by ADVSP configuration parameters. Figure elements are labeled as follows:

11—Automatic Item Loading assembly configured for interfacing with Feeding assembly (13), and moving items from (13) into empty carrier aligned for loading inside AVM (10). Loading assembly (11) is installed on Provider side (167), opposite to Customer side (168)

13—Automatic Item Feeding assembly configured for accepting or loading of items at the base, and moving loaded items to the top toward Loading assembly (11). Feeding assembly (13) can be configured to support automatic item loading at the base, and manual loading of items by Provider. Items, prior to loading, will be inspected to ensure compliance to specification requirements listed under apparatus configuration parameters 568—AVM support platform, which can be configured to include: rollers at the base of the platform to allow the AVM to slide in, mechanical latches to secure AVM after installation is complete. The platform is configured, including dimension L10, to support Feeding assembly (13). L10 can be also configured to allow partial pull-back of a AVM, after (13) is removed, for inspection or maintenance. W1, H4, L11—respectively width, height and or depth of AVM FIG. 102—Carrier base-plate assembly (63), which can be configured for holding/support of individual tubes or vials, as shown. This configuration of the Carrier base-plate will allow ADVSP to process Items placed inside each tube. Tubes/vials can contain various type of Items in a form of: liquid, powder, solid, etc., and the items can include: medications, patient test samples (blood, urine, tissue, etc.). Figure elements:

43—Area of base-plate assembly platform for placing barcode label, which can contain information about holding plate and/or Items loaded into it.

58—One of mounting holes, not threaded

63—Carrier removable base-plate, with the section (64) configured to retain 24 tubes or vials, as shown

65—Openings (total 24, as shown) configured for placing an Item or a Container, such as: vial, tube, etc. The size of each opening can be configured accordingly to the size of respective type of Item or Container it is intended for.

Figure 102:
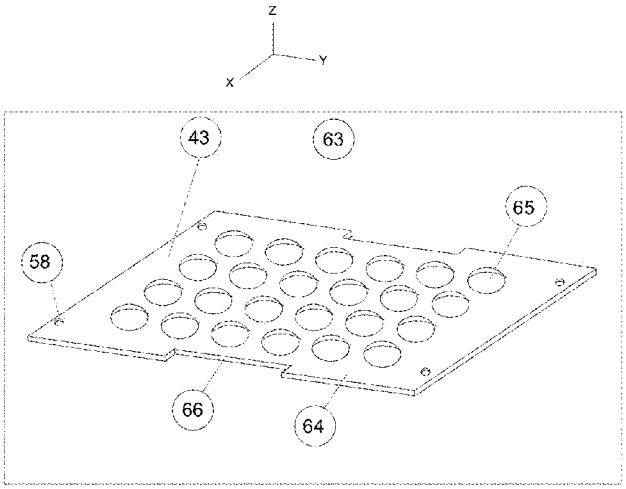
Figure 103:
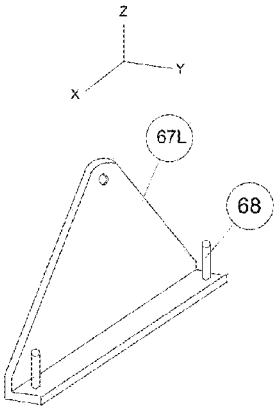

66—Slot in platform (64) configured for mechanical interfacing with loading/unloading components FIG. 103—Carrier side support bracket (67) left side (as shown), which can be configured with pins (68) to support removable base plate (63) shown on FIG. 102.

Figure 104:
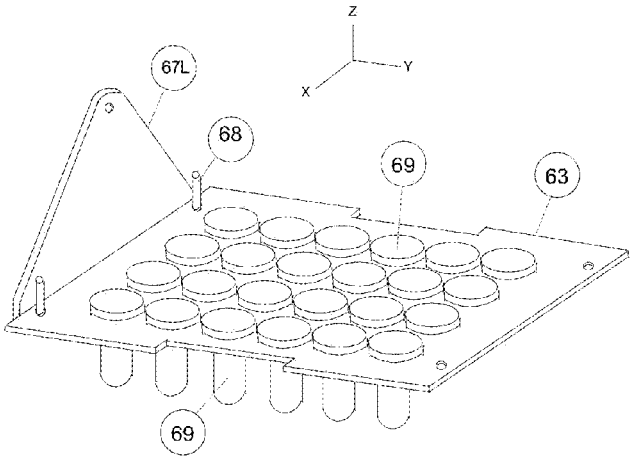

FIG. 104—Section of Carrier assembly configured with support bracket (67), removable Item base-plate (63) engaged with alignment pins (68), and the base-plate (63) configured for supporting specific size tubes/vials (69), shown loaded with 24 tubes. Base-plate (63) can be loaded or unloaded from Carrier Conveyor manually by authorized personnel, or automatically by ADVSP support component.

Figure 105:
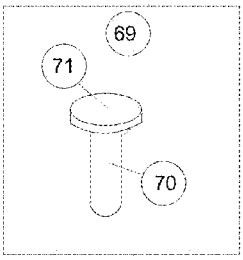

FIG. 105—Item or Container (69) shaped as a tube/vial, with vial body (70) and lid (71). This type of Containers can be configured and used for handling and processing a variety of items, including: medications, patient test samples (blood, urine, tissue, etc.)

Figure 106:
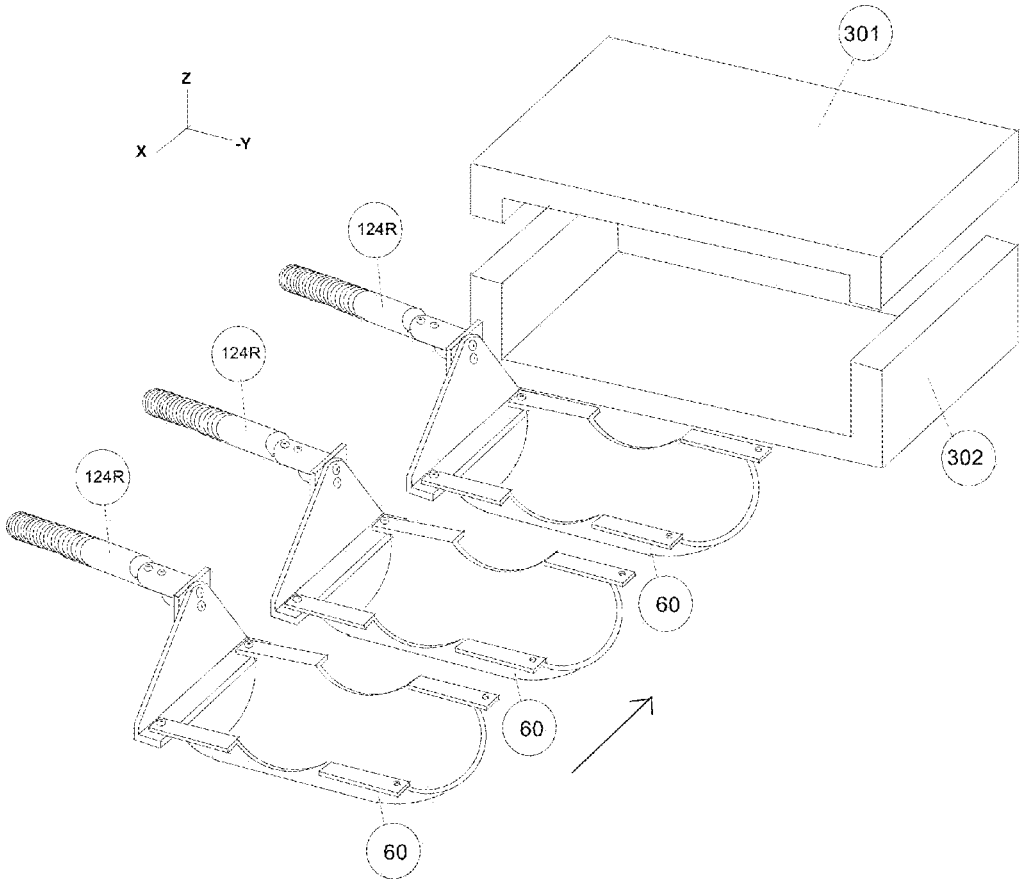

FIG. 106—Illustrates Process Chamber configuration layout in relationship to Conveyor Carriers. Process Module can be installed or integrated inside Automatic Vending Module (AVM), and can be configured to contain several Process Chambers. Each chamber can be configured to allow controller to execute chamber-specific or item-specific process control algorithm defined by apparatus configuration parameters. Chamber-specific process can include: temperature, humidity, UV level. For simplicity, only one Chamber is shown. Figure elements are labeled as follows:

60—Item Carrier assembly, attached to a Carrier conveyor (not shown for simplicity). Controller will execute process controls, including: setting environment inside Process Chamber (301, 302), moving Conveyor with Carrier (60) with item inside (not shown) into Process Chamber (301, 302) as pointed by the arrow, keeping Carrier inside the Chamber for required period of time, and moving Carrier out of the Chamber. Carrier conveyor (not shown) can be configured to maintain required distance between the Carriers, as required to execute process controls.

124R—Carrier Support Shaft from the right side of the Carrier

Figure 107:
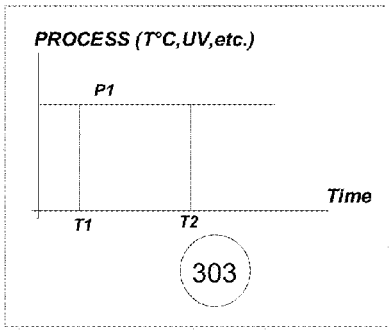

301. 302—respectively Process Chamber upper and lower section assemblies FIG. 107—Illustrates example of a single Process graph (303) of a controlled Process parameter within Process Chamber, such as temperature, UV radiation, etc. vs. time. As shown, Process Chamber can be configured under directions from Controller to maintain a required value of Process parameter. Under directions of Controller, each Carrier with its content, such as medications, patient test samples, upon entry into this type of Process Chamber, can be exposed to controlled value of Process parameter, such as: constant (P1) temperature, UV radiation, etc. for a specified by Controller period of time (T1, T2).

Figure 108:
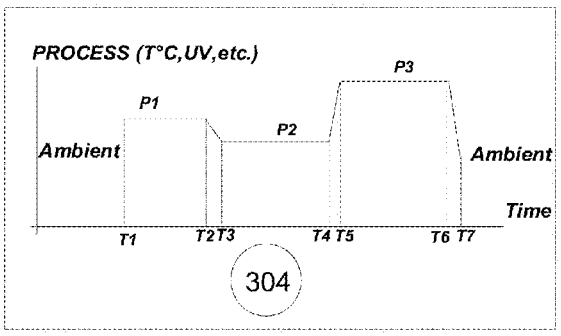

FIG. 108—Illustrates example of Process graph (304) of controlled Process parameters, which Controller can execute by utilization of three Process Chambers. As shown, each Process Chamber can be configured to allow Controller to control required values (P1, P2, P3) of Process parameter. Each Carrier with its content such as medications, patient test samples, upon entry into respective Process Chamber, will be exposed to controlled value of respective Process parameter, such as: temperature, UV radiation, etc. for a specified period of time. For simplicity—temperature process control is shown. Figure elements:

304—Process graph, which can be attained utilizing three Process Chambers, located next to each other with distance in between to allow proper indexing of Carriers in-between them.

P1—Process Chamber #1 process parameter value

P2—Process Chamber #2 process parameter value

P3—Process Chamber #3 process parameter value

T1—Time a Carrier enters the Process Chamber #1

T2—Time a Carrier exits the Process Chamber #1

T3—Time a Carrier enters the Process Chamber #2

T4—Time a Carrier exits the Process Chamber #2

T5—Time a Carrier enters the Process Chamber #3

T6—Time a Carrier exits the Process Chamber #3

Figure 109:
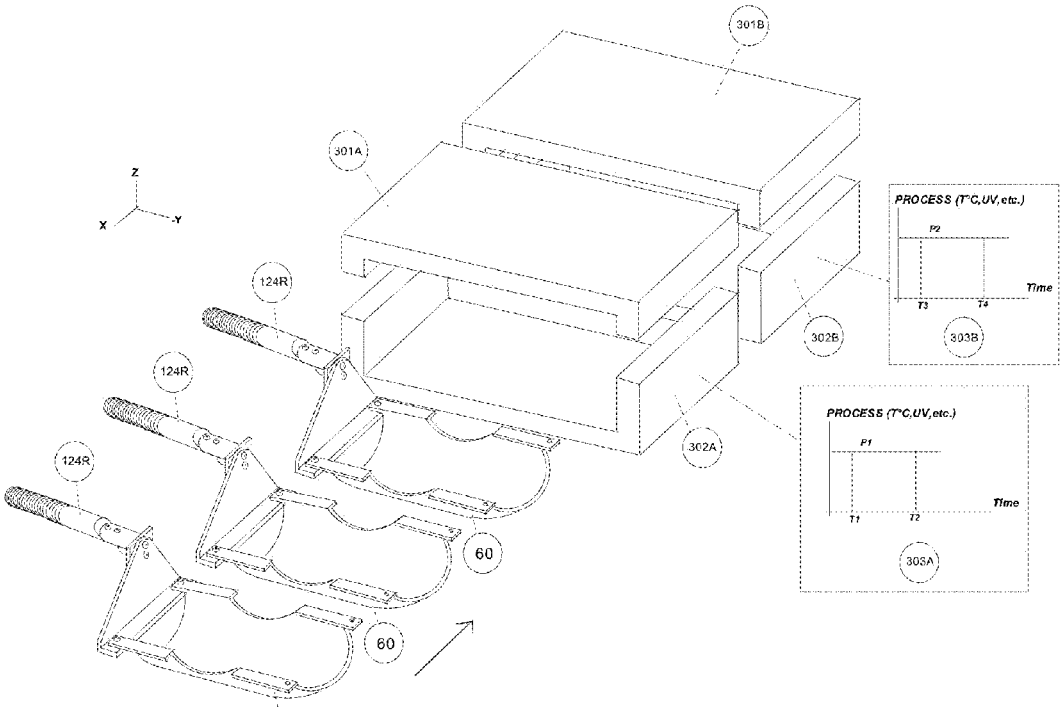

T7—Time a Carrier exited the Process Chamber #3 and reached ambient environment FIG. 109—Illustrates configuration of Item Processing inside Carriers (shown empty for simplicity) by exposing each Item to two Process Chambers. Figure elements are labeled as follows:

60—Item Carrier assembly

124R—Carrier Support Shaft from the right side of the Carrier

301A—Process Chamber #1 upper section assembly

302A—Process Chamber #1 lower section assembly

301B—Process Chamber #2 upper section assembly

302B—Process Chamber #2 lower section assembly

303A—Process graph, Chamber #1

303B—Process graph, Chamber #2

Figure 110:
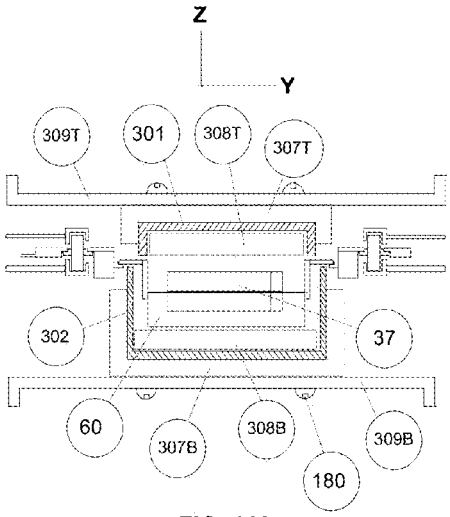

FIG. 110—Illustrates side view (cross section) of Conveyor configured with a Carrier loaded with Item going through a Processing temperature Chamber. Figure elements are labeled as follows:

37—Item configured as cylindrical shape with cap on one side

60—Item Carrier assembly

180—One of mounting screw, recessed as needed to keep low profile

301—Process Chamber upper section assembly

302—Process Chamber lower section assembly

307T—Process Chamber insulation material, top side

307B—Process Chamber insulation material, bottom side

308T—Process control element, top side. Process element can be configured to include: flexible foil heater, rubber heater, cartridge heater, quartz lamp, UV lamp, etc.

308B—Process control element, bottom side. Process element can be configured to include: flexible foil heater, rubber heater, cartridge heater, quartz lamp, UV lamp, etc.

309T—Process Chamber mounting bracket, top side

309B—Process Chamber mounting bracket, bottom side

Figure 111:
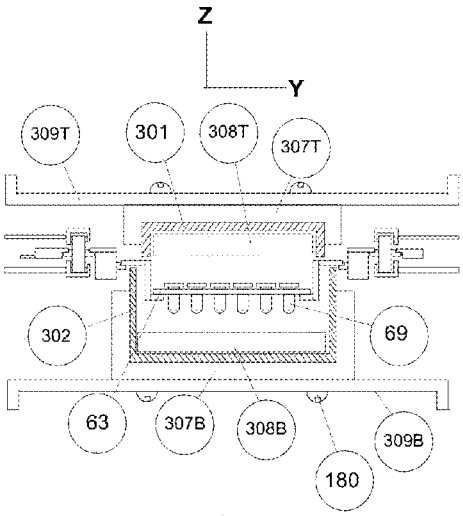

FIG. 111—Illustrates side view (cross section) of Conveyor configured with removable Carrier base-plate assembly loaded with Items, such as: medications, patient test samples, inside tubes/vials, going through Processing temperature Chamber. Figure elements:

63—Carrier removable base-plate assembly

69—Tubes or vials with Item(s) inside

Remaining elements are same as shown on FIG. 110.

Figure 112:
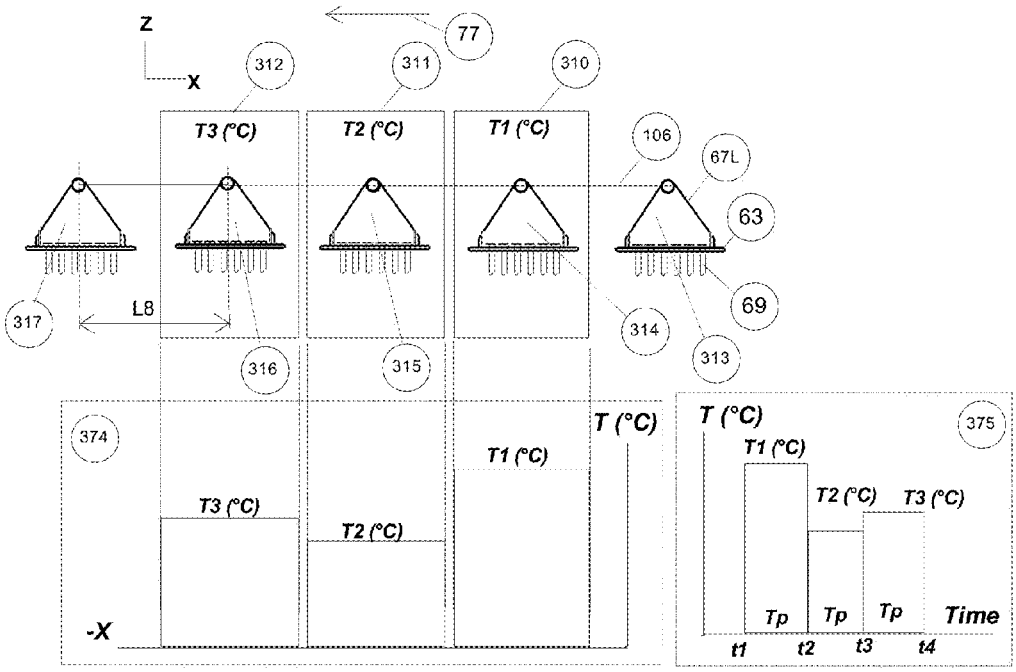

FIG. 112—illustrates section of a Carrier Conveyor inside a Process Module, which is configured for Item Processing, and which is further configured, as shown, of three Item Processing Chambers. Each Process Chamber can have specific Process. Each Process within each Chamber—can be configured to have the same Processing time or cycle. For simplicity, shown example has each Process Chamber with specific temperature maintained inside—Process chart (374), which will be stored in the non-volatile memory under apparatus configuration parameters. Controller based on algorithm included in the apparatus configuration parameters, will execute controls as described below. Items are Processed within each Chamber for time duration equal to constant Process Time—Tp. Total Processing time, or Process Cycle, of one Carrier loaded with Items is equal to Tp*3 (for simplicity, Conveyor index time is considered<< than Tp). Controller can be configured as a close loop real-time process controller, which will include: monitoring process sensors for actual process parameters and executing controls of respective process devices to sustain the actuals within the required proximity from the set parameters. Controller can be configured to execute process controls in real-time without operator assistance, and further configured to inform Provider if process deviations exceeded pre-defined limits. Example of the Processing sequence executed by Controller:

Step 1. Controller will execute item loading sequence of carriers which will result in the carrier conveyor to include: 3 loaded carriers followed by 3 unloaded carriers followed by 3 loaded carriers, and so on.

Step 2. Controller will advance the carrier conveyor in direction (77) and align 3 empty carriers within Process Chambers.

Step 3. Controller will set the temperature for each Process Chamber according to the Process chart (374).

Step 4. Once each Chamber reached its respective temperature setting, Controller will advance the carrier conveyor along (77) and align the first carrier with item for processing inside Process Chamber #1 (310).

Step 5. Controller will proceed with indexing the Carrier conveyor per timing outlined by Process chart (374), and will maintain each Process Chamber within specifications, which will result in each item being processed according to Process chart (374).

Step 6. Once all Items loaded inside Module have been Processed, Controller will stop Conveyor, with three empty Carriers remaining inside respective three Chambers.

Step 7. Controller can turn off each Chamber.

Step 8. Once temperature inside each Chamber reached near ambient temperature, Controller can index Carriers (empty and loaded), as needed. Processed Items can be unloaded by Controller, as needed, to Provider and/or to authorized Customer.

For simplicity, only loaded carriers are shown. Figure elements are labeled as follows:

63—Carrier removable base-plate for tubes/vials with Item (s) inside

67L—Carrier left support assembly for removable holding plates

69—Tube or vial with Item(s) inside

77—Direction of Conveyor motion

106—Conveyor direct linkage line, for illustration purposes

310—Process temperature Chamber #1, set to maintain temperature inside at T1(° C.)

311—Process temperature Chamber #2, set to maintain temperature inside at T2(° C.)

312—Process temperature Chamber #3, set to maintain temperature inside at T3(° C.)

313—Carrier loaded with tubes/vials, awaiting Processing. When Processing time of respective Carriers inside respective Chambers has expired (equal to T), Conveyor will advance one index.

As result, Carrier (313) will end up inside Chamber #1, Carrier (314)—inside Chamber #2, Carrier (315)—inside Chamber #3, Carrier (316)—will complete the entire Process Cycle.

314—Carrier loaded with tubes/vials, being Processed inside Chamber #1

315—Carrier loaded with tubes/vials, being Processed inside Chamber #2

316—Carrier loaded with tubes/vials, being Processed inside Chamber #3

317—Carrier loaded with tubes/vials, with Items, which have been through the entire Process Cycle L8—Distance between centers of adjacent Conveyor Carrier Support Bearings

374—Process chart, based on Process Chambers (310,311, 312) settings.

375—Illustrates Process graph, which each Item was processed with.

Figure 113:
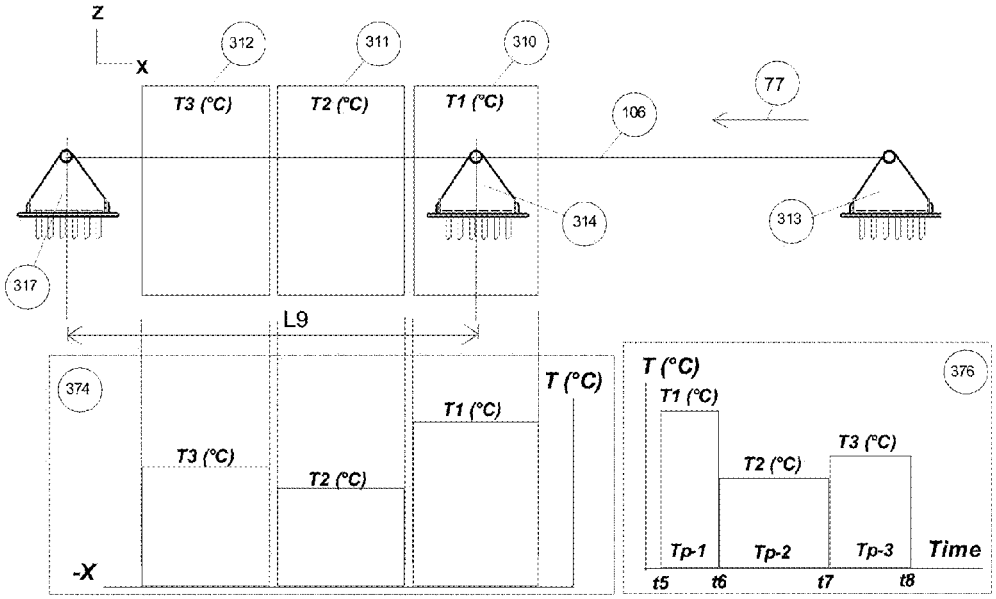

FIG. 113—illustrates section of a Carrier Conveyor configured inside a Process Module with Process Chambers same as on FIG. 112, except the Carriers are spaced apart distance (L9) to allow Item Processing with variable Process time. Process time graph (376), is an example which can be stored in non-volatile memory under apparatus configuration parameters. Total Processing time, or Process Cycle, of one Carrier loaded with Items is equal to Tp1+Tp2+Tp3 (for simplicity, Conveyor index time is considered<< than Tp1, Tp2, Tp3). Controller can be configured as a close loop real-time process controller, which will include: monitoring process sensors for actual process parameters and executing controls of respective process devices to sustain the actuals within the required proximity from the set parameters. Controller can be configured to execute process controls in real-time without operator assistance, and further configured to inform Provider if process deviations exceeded pre-defined limits. Example of the Processing sequence:

Step 1. Controller will execute item loading sequence of carriers which are spaced apart by distance L9

Step 2. Controller can set the temperature for each Chamber according to the Process chart (374). While the Chambers are in-process of reaching the set process parameter, the carrier conveyor is configured to retain only empty carriers inside the Process Chambers.

Step 3. Once each Chamber reached its respective temperature setting, Controller will advance the carrier conveyor along (77) and align the first carrier with item for processing inside Process Chamber #1 (310).

Step 4. Conveyor, under commands from Controller, can execute required number of index moves equal to ⅓ distance of L9, with rest times starting with Tp1 followed by Tp2, Tp3, Tp1, Tp2, Tp3, Tp1 and so on until all Items inside Module have been Processed. Controller can then stop Conveyor, with one empty Carrier remaining inside Chamber (310), while the other Carriers loaded with Processed Items remain outside the Process Chambers.

Step 5. Controller can turn off each Chamber.

Step 6. Once temperature inside each Chamber reached near ambient temperature, Controller can index Carriers, as needed. Processed Items can be unloaded, as needed, to Provider and/or authorized Customer. Figure elements are labeled as follows:

376—Illustrates Process graph, which each Item processed with.

Remaining elements are same as shown on FIG. 112.

Figure 114:
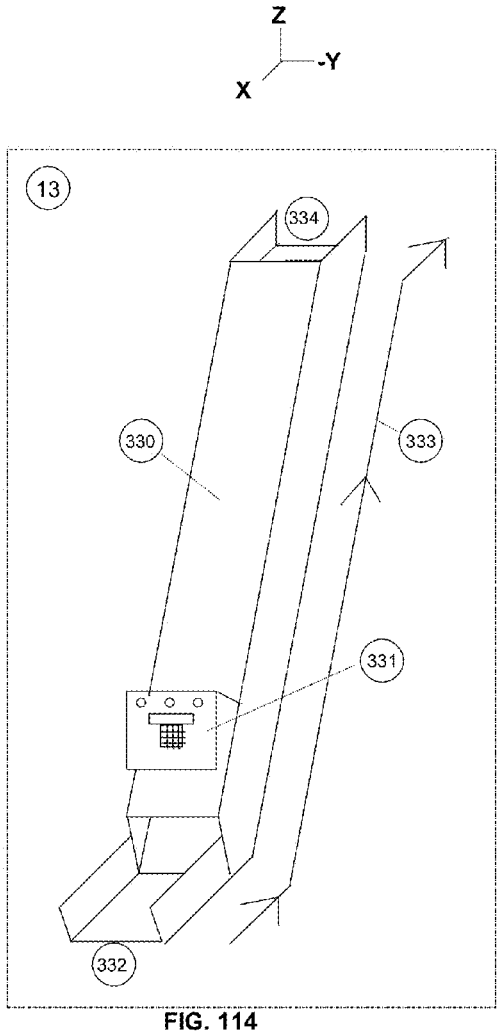

FIG. 114—Illustrates ADVSP Automatic Item Feeding assembly (13), which can be configured to serve as an intermediate buffer of Items awaiting being loaded into respective Module, expanding capacity of Items within ADVSP. Transfer of Items from Feeding assembly can be configured for unattended direct control from respective Controllers—Module and Feeder. Figure elements:

13—Automatic Item Feeding assembly, which in addition to shown components, can include: Conveyor Drive assembly; Sensors for monitoring Item presence at various locations such as: Loading Platform, Pick-up Platform, etc.; Sensors for monitoring Conveyor position; Barcode Scan devices, which can report to Controller Item barcode label information.

330—Automatic Item Feeding conveyor assembly configured for advancing Items from point of entry (332) to point of unloading (334).

331—Feeding assembly (13) Provider interface panel for Controller. Feeder Controller can be configured to interface with Module Controller, which can be used to synchronize operations related to Item Feeding and transporting from Feeder Pick-up Platform (334) into respective empty Carrier within Module by Automatic Loading assembly (not shown).

332—Item Loading Platform, which can be configured for manual loading of items by Provider or via assistance of automatic components of the ADVSP. Item loaded on Platform, can have their barcode label verified by Barcode Scan device. If accepted, Item information can be added to Item Inventory, otherwise Feeder Controller can notify Provider via Control panel (331), that the loaded Item has been rejected.

333—Direction of Item motion inside Automatic Feeding assembly (13)

334—Item Pick-up Platform, which can be configured for manual unloading of Items, or automatic unloading by ADVSP components. Unloaded Items can be picked-up from this Platform by respective Automatic Item Loading assembly, and then can be loaded into respective empty Carriers inside Module.

Figure 115:
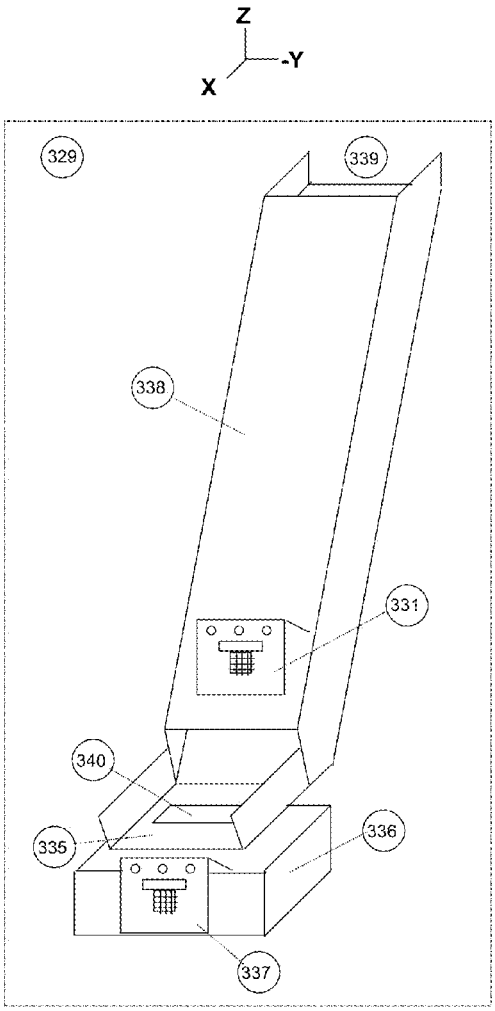

FIG. 115—Illustrates ADVSP Automatic Item Feeding assembly (329) configured with Automatic Item Inspection device (336). Figure elements are labeled as follows:

331—Controller interface panel of Feeding assembly (329) configured for Provider

335—Item loading and Inspection Platform.

336—Item Automatic Inspection device, which can be configured and used by Controller for measuring Item's weight, size, etc. In addition, a Barcode Scan device can be placed above (335), and used by Controller to obtain Item barcode label information.

337—Item Automatic Inspection device Control panel. Inspection Controller can be configured and programmed by Provider directly via (337), or via ADVSP Station Computer to inspect Items specific parameters. If results are within acceptable range stored in apparatus configuration parameters, Item can be accepted, otherwise Inspection Controller can inform Provider that loaded Item is rejected.

338—Automatic Item Feeding conveyor assembly, for large size Items

339—Item Pick-up Platform

340—Item Inspection window configured for measuring Items weight, size and/or reading barcode label.

Figure 116:
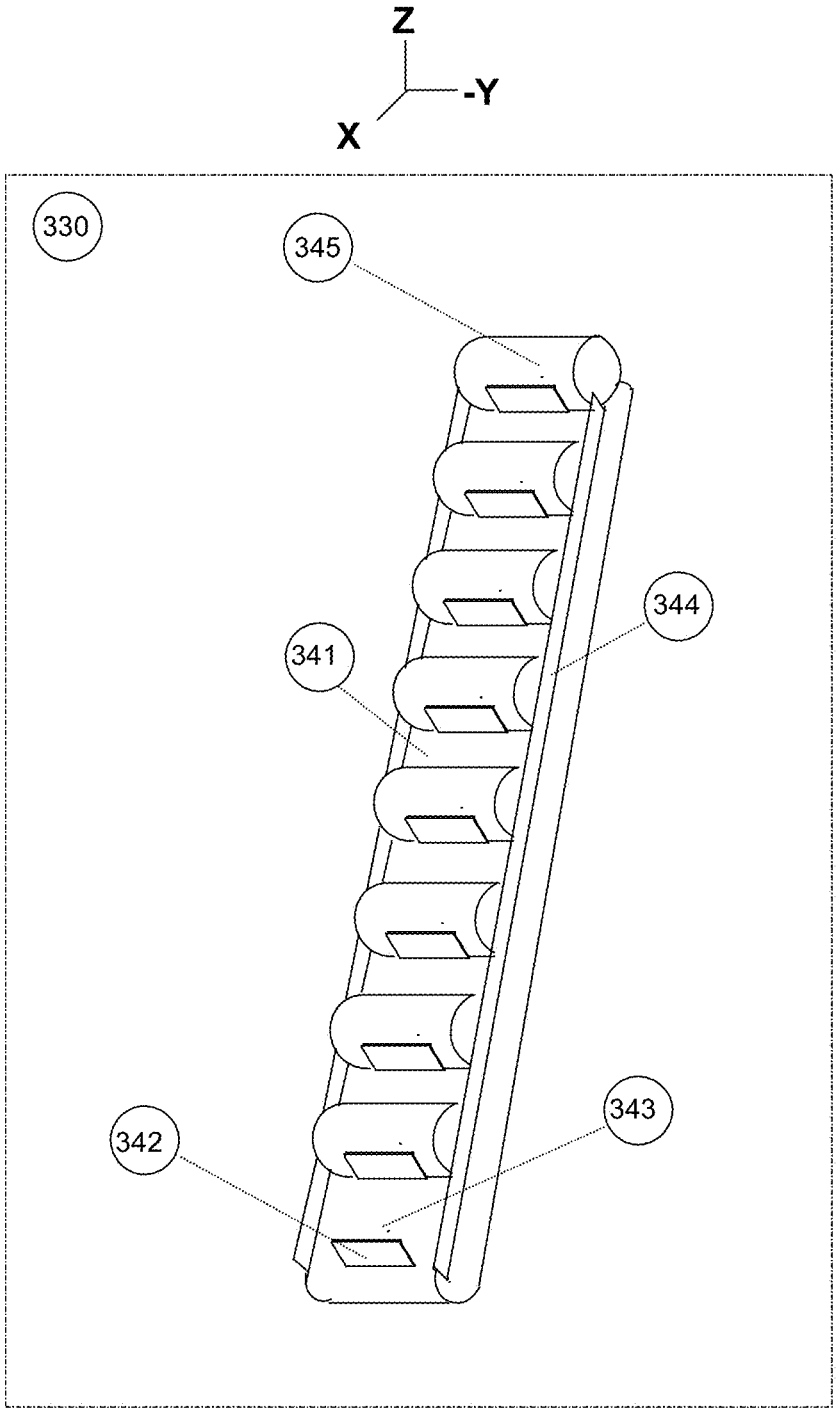

FIG. 116—Illustrates configuration of Automatic Item Feeding Conveyor assembly (330). Figure elements:

341—Automatic Item Feeding belt assembly

342—Item support bracket assembly, which can be used to secure location of Items on the conveyor

343—Open slot on (330), ready for Loading of an Item

344—Item retention panel, which can be used to secure Items within (330)

345—Item on top of Pick-up Platform (reference element 339, FIG. 115). This Item must be removed manually by Provider or by ADVSP Automatic Item Pick-up assembly before Feeding Conveyor (330) can start indexing by Feeder Controller.

Figure 117:
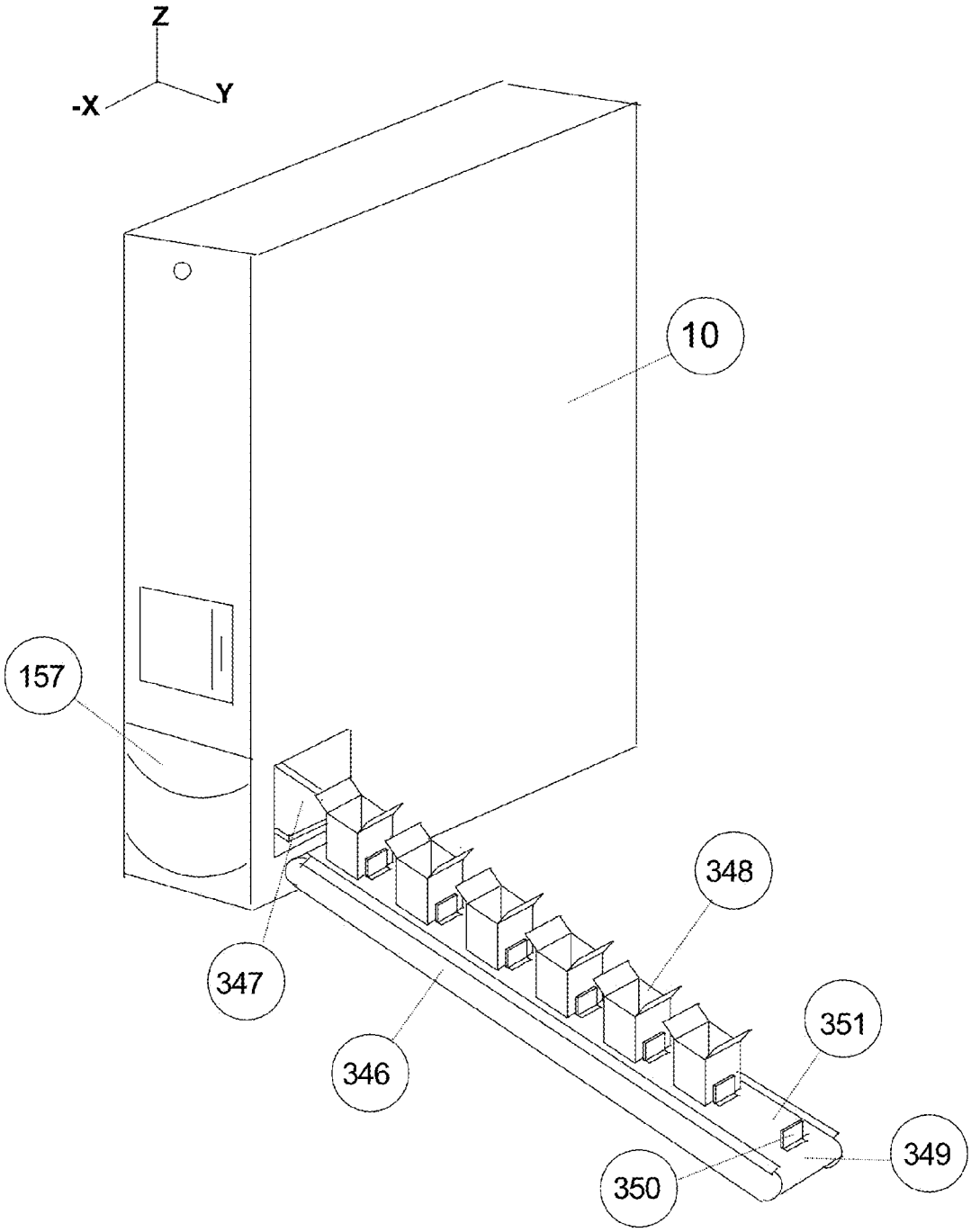

FIG. 117—illustrates configuration of ADVSP in support of automatic packing of Items being dispensed. Packing materials and type can be configured to provide additional security, safety and privacy. Shown—ADVSP layout with Item Automatic Packing assembly (346) installed along "Y-axis". Prior to vending an Item, Controller can command Controller of Automatic Packing assembly to advance empty package to Item unloading location. Controller can detect presence of empty package, verify package position and barcode label, as needed. Controller can then unload requested Item into empty package. Empty packages can be loaded onto Automatic Packing assembly manually or by other ADVSP automation components. Rejected by Controller empty package(s) can be dropped into reject bin, located under Item unloading platform. Figure elements are labeled as follows:

10—ADVSP Automatic Vending Module (AVM), which is configured with a side opening (347) for mechanical interface to Automatic Packing assembly (352)

157—Pick-up bin for Customer to receive Items packaged inside boxes

346—ADVSP Item Automatic Packing assembly. As shown, this assembly can inclined upward toward AVM side opening (347).

347—Opening inside AVM Outer Enclosure configured for mechanical interfacing with (346)

348—Empty box/Container for housing Item

Figure 118:
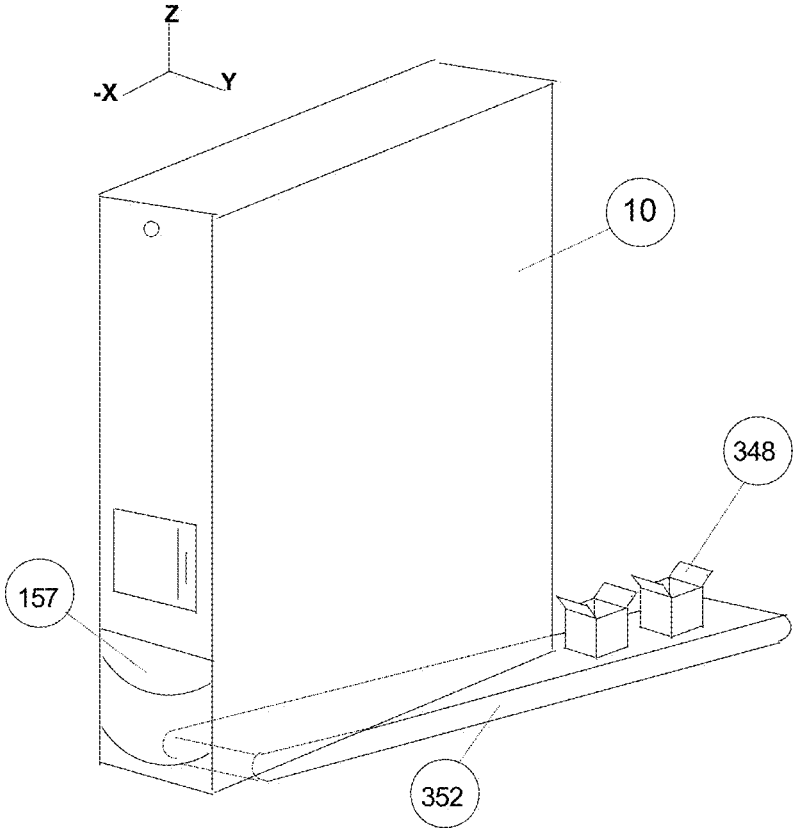

FIG. 118—ADVSP configuration layout with Item Automatic Packing assembly (352), which can be installed along "X-axis". Prior to vending requested Item, Controller can command Controller of Automatic Packing assembly to advance empty package to Item unloading location. Controller can detect presence of empty package, verify package position and barcode label, as needed. Controller can then unload requested Item into empty package. Rejected by Controller empty package(s) can be dropped into reject bin, located under Item unloading platform. Figure elements are labeled as follows:

10—ADVSP Automatic Vending Module (AVM), which is configured with an opening at the bottom (not shown) for mechanical interface to Automatic Packing assembly (352).

157—Pick-up bin for Customer to receive Item(s) inside boxes

348—Empty box/Container for housing Item

Figure 119:
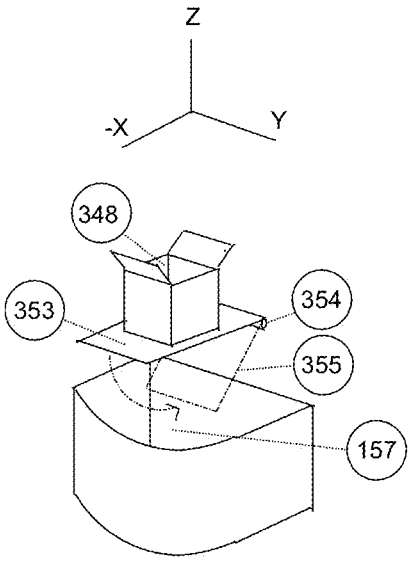

FIG. 119—Configuration of ADVSP AVM item unloading platform (353) detail. Empty box (348) can be placed by Item Automatic Packing assembly on top of unloading platform (353). Requested Item (not shown), can be unloaded out of its Carrier inside AVM by ADVSP component and then placed inside empty box (348). The platform (353) can be configured to swing about "Y-axis" of the hinge (354) down along "Z-axis" to position indicated by (355), as commanded by Controller. Platform in its upper position (354) can hold box (348) with Item inside. Under direction of Controller, the platform (353) can swing about axis of hinge (354) as indicated by (355), and cause content on top—box with Item inside to fall into Pick-up Bin (157). Figure elements are labeled as follows:

348—Empty box, which can be configured for packing dispensed Item

353—AVM Item unloading platform in it's up position

354—Hinge of unloading platform along 'Y-axis", which can allow platform to swing around the axis

355—Item unloading platform in it's down position

Figure 120:
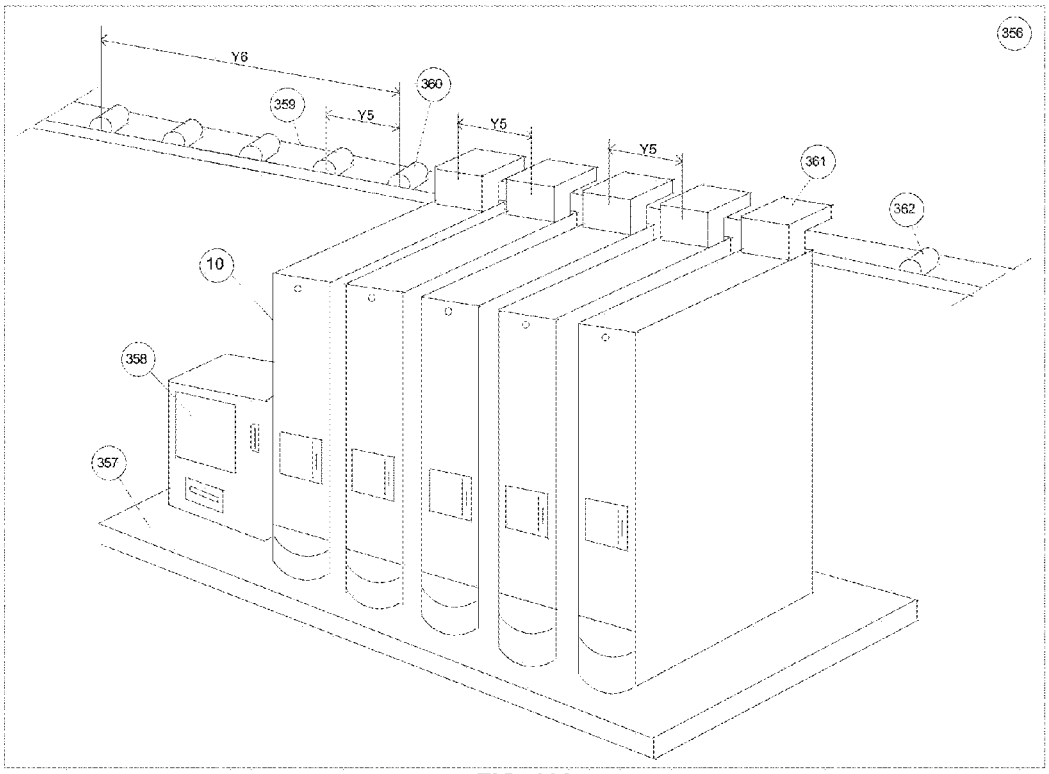

FIG. 120—illustrates 3-D view of ADVSP in-line automation features. As shown, ADVSP configured with Section Computer (358) and five same-type Automatic Vending Module (AVM) (10), and can be mounted on loading platform (357), which can then be rolled to designated automatic feeding location to re-fill content of each AVM. Distance Y5 between AVM (10) located on top of platform (357) along "Y-axis" can match respective distance between Items or Containers (360) located on top of conveyor of Item Feeding assembly (359). This can significantly increase Item loading efficiency. The Item Feeding assembly (359) can be configured to serve required number of AVM at once. The Item Feeding assembly (359) can be configured to handle variety of Items (360) in terms of their packaging size and weight. Items can be loaded onto Automatic Item Feeding conveyor manually or by other ADVSP automatic components. In some applications, Automatic Item Feeding can take place directly at the manufacturer of Items, or at a location where Item(s) are packaged into Container. Position of Automatic Item Feeding conveyor can be referenced in relation to positions of AVM on platform (357). Controller can advance it's conveyor, loaded with Items or Containers with Item(s), a distance equal to Y5*N, where N—number of AVM being loaded. As shown, N=5. Controller can detect presence of Item or Container on Item Feeding conveyor, and after verification of its barcode, can command it's Automatic Item Loading assembly (361) to pick-up respective Item from conveyor and transfer it to an empty carrier inside respective AVM. Rejected Items, one is shown (362), can remain on conveyor, and then removed at appropriate location. Throughout entire operation, Automatic Item Feeding Controller can be configured to communicate via ADVSP Network real-time, with respective Controllers to ensure reliable, secured and safe loading of Items. Once each AVM is loaded with required quantity of Items, the entire Section can be transported back to its designated vending location. Same principal (not shown), as needed, can be used in reverse, for automatic unloading of Items out of AVM onto (359), and transported by (359) to designated location, where they can be removed. Controller of (356) will coordinate and synchronize all activities per apparatus configuration parameters. Figure elements:

10—ADVSP AVM, which can be mounted on top of platform (357). AVM location on platform can be designated, so that the distance Y5 between adjacent AVM along "Y-axis" can match respective distance between Items (360) located on top of conveyor of Item Feeding assembly (359).

357—Platform, which can be configured to mechanically interface with (359), and include wheels, which can serve for convenient transportation of ADVSP Sections or Modules between loading and vending locations.

358—ADVSP Section Computer, which can be configured for supervision of loading activities. Computer, as shown, can include; touch-screen monitor, security access ID card reader, printer, etc.

359—Automatic Item Feeding assembly, which can be loaded with Items or Containers with Item(s) inside. Items or Containers can be loaded on top of Feeding Conveyor manually or by ADVSP components. Item Feeding assembly is configured to mechanically interface with platform (357).

360—Item or Container with Item(s) inside, which can be loaded on top of Item Feeding conveyor (359).

361—AVM Automatic Item Loading assembly, which can be configured for automatic pick-up of a respective Item from conveyor (359) and transfer it into respective Carrier inside AVM.

362—Item or Container with Item(s) inside, which was rejected by Controller. Rejected Item can remain on Conveyor, and then removed at appropriate location.

Figure 121:
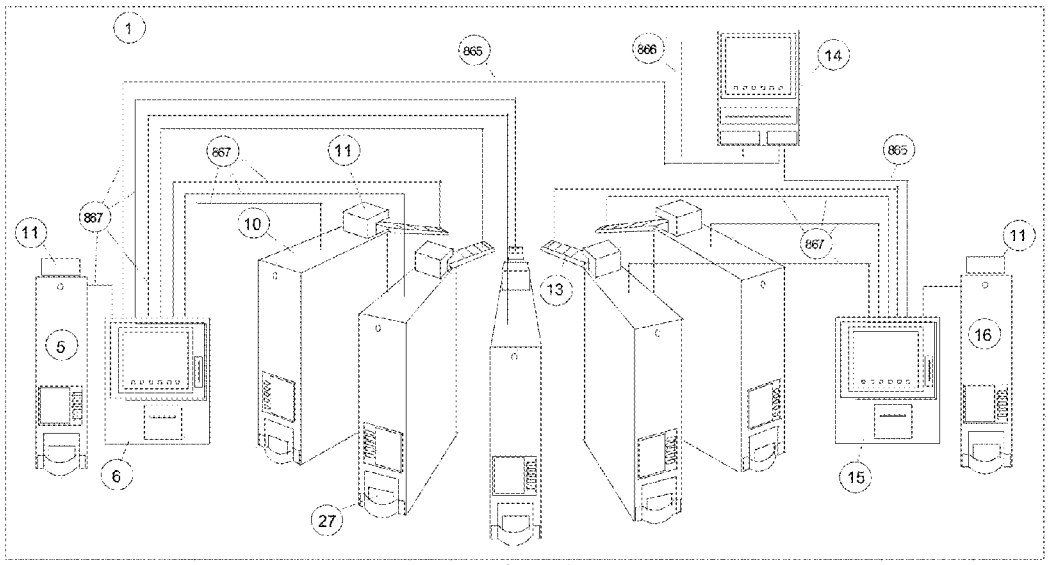

FIG. 121—ADVSP configuration example consisting of 7 AVM units, each AVM with capacity of 200 prescription medications. ADVSP components, including Controllers, AVM units, support devices—can be configured to be interfaced via wired or wireless LAN. Figure elements are labeled as follows:

5,16—respectively configured as AVM Dynamic Modules #1 and #2, which are used for loading on-site processed prescription medications

6,15—respectively Station Computers #1 and #2, which can consist of such components as: touch-screen monitor, card reader for accepting ID/ATM/credit cards, printer, etc.

10—One of AVM, which can be used for General vending or Assigned vending

11—Automatic Item Loading/Unloading assembly configured to interface with AVM Automatic Item Loading/Unloading (13)

13—Automatic Item Feeding assembly configured to interface with AVM Item Loading/Unloading (11)

14—ADVSP Host Computer

27—Item Pick-up Bin, Customer side

865—Network interface between Station Computer and ADVSP Host Computer and Controllers

866—Network interface, which can be used for connecting ADVSP Host Computer to Corporate computer

Figure 122:
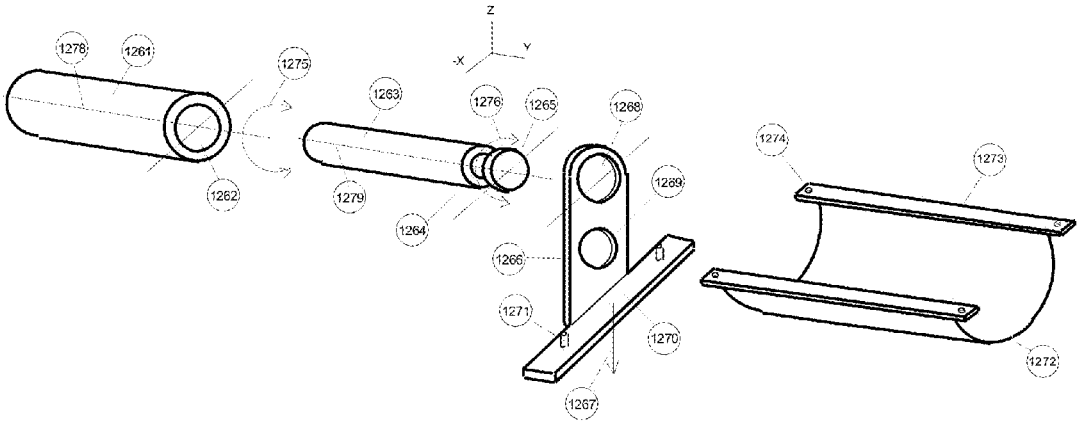

867—Hi-speed serial Local Network interface configured as interface between devices within ADVSP FIG. 122—Illustrates configuration of a support for a carrier (1272) which enables the carrier (1272) to swing in direction (1275) about the primary axis (1278) of the bearing (1261), and independently swing in direction (1276) about the secondary axis (1279) of the carrier support shaft (1263). For simplicity, only one side of the carrier support is illustrated. For small and light items, and respectively small and light carriers, the support for the carriers can be configured from one side only, with the opposite side being suspended in the air. The independent dual axis rotational support (referenced for simplicity as "dual axis support") illustrated will reduce friction for the carrier to swing about the primary axis (1278), which will in-turn reduce required forces required to be applied to the carrier (1272) in order to swing required angle in respect to the primary axis (1278), or Y-axis, and allow the item originally located inside the carrier (1278) to roll-out for dispensing. The "dual axis support" is applied for dispensing via sliding tunnel, as described on FIG. 124. Figure elements:

1262—Cavity of (1261) configured with an inner race into which the carrier support shaft (1263) of the item carrier is inserted, allowing the item carrier to swing in direction (1275) about the axis (1278) of the inner race

1264—Slot in the carrier support shaft (1263) configured to accept a carrier support bracket (1266) and allow the carrier support bracket (1266) together with attached carrier to swing in direction (1276) about the axis (1279) of the carrier support shaft (1263)

1269—Opening in the support bracket (1266) as illustration of removing extra materials to reduce weight

1270—Platform of carrier support bracket (1266) configured to provide support for item carrier base (1272)

1271—Holding pin or threaded stud of (1270) configured to accept or mate the mounting opening (1274) of the item carrier base (1272)

1273—Section of carrier base (1272) configured for mounting the carrier (1272) to support bracket (1266). This section can be used for placement of a barcode label with information about the carrier (1272)

Figure 123:
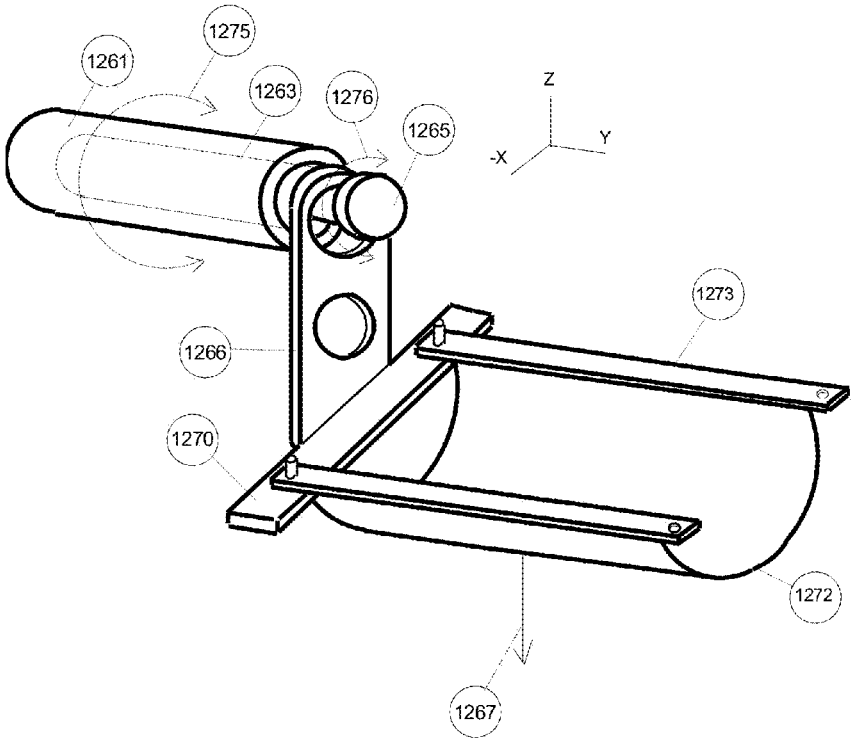

FIG. 123—Illustrates assembled carrier (1272) supported from the cavity (1264) of the shaft (1263) inserted into inner race of the bearing (1261). For simplicity, the conveyor belt to which the bearing (1261) is attached is not shown. The illustrated mounting will enable carrier (1272) together with support bracket (1266) to swing in direction (1275) about the primary axis (1278) of the bearing (1261), and independently swing in direction (1276) about the secondary axis (1279) of the support shaft (1263). For simplicity, only one side of the carrier support is illustrated. For small and light items, and respectively small and light carriers, the support for the carriers can be configured from one side only, with the opposite side being suspended in the air. The independent dual axis rotational support (referenced for simplicity as "dual axis support") illustrated will reduce friction for the carrier to swing about the primary axis (1278), which will in-turn reduce required forces required to be applied to the carrier (1272) in order to swing required angle in respect to the primary axis (1278), or Y-axis, and allow the item originally located inside the carrier (1278) to roll-out for dispensing. Additional bracket can be configured to restrict the support bracket (1266) during transportation or as needed, from exiting the slot (1264) of the support shaft (1263). The "dual axis support" illustrated, can be applied for dispensing items from carriers via sliding tunnel, as described on FIG. 124.

Figure 124:
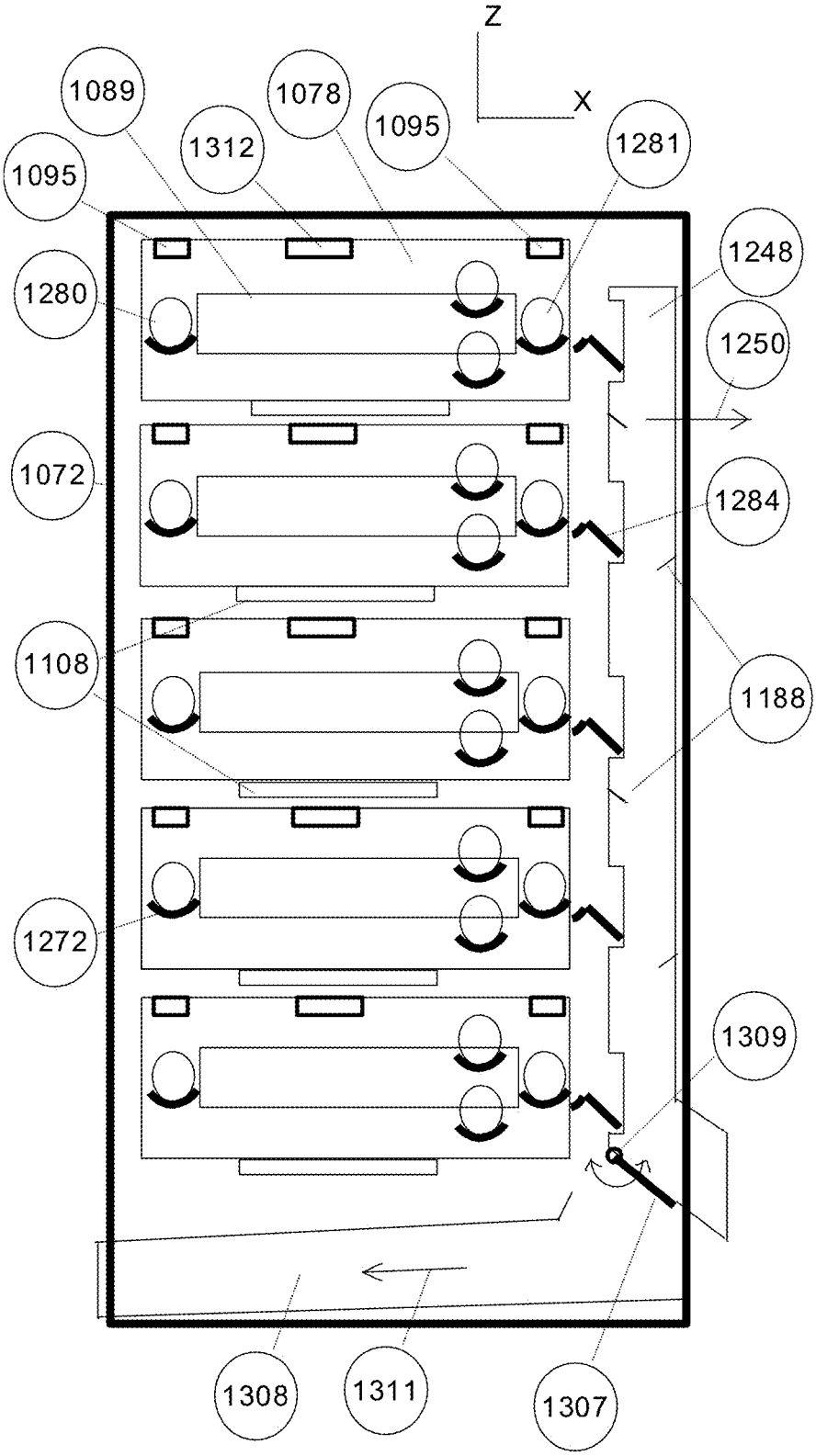

FIG. 124—Illustrates Automatic Vending Module (AVM) (1072) configured with 5 installed Portable Vending Cartridges (PVC) (1078), shown on FIG. 48, with a Slide-able Unloading Tunnel (SUT) (1248). The Slide-able Unloading Tunnel (1248) is configured under directions of controller (not shown) to advance in direction toward the PVC (1078) installed inside AVM (1072), and engage with carriers (1272) of the respective PVC (1078) which are aligned by controller for unloading. As shown, SUT (1248) is in its default "home" position, or re-tract position as indicated by the direction (1250), allowing respective carrier conveyors (1089), as directed by controller, to advance carriers (1272) without any interference from SUT (1248). Figure elements:

1089—Carrier conveyor assembly installed inside PVC (1078), which is configured to allow controller (not shown) to align a carrier (1272) with item inside (1280) for loading/unloading on Provider side, and to align a carrier (1272) with item inside (1281) for unloading on Customer side.

1095—Barcode reading device, connected to Controller, which is installed at required locations inside each PVC (1078) or AVM (1072). The locations are selected to allow Controller to conduct in real-time in-process and final verifications of barcode information reported by the barcode labels attached to items inside the carriers, and barcode labels attached to carriers. The barcode labels can be reported by Barcode reading device (1095) to Controller dynamically as the carriers with or without items pass by the barcode reader (1095), or statically, when the carrier with or without item is stationed for inspection within the "barcode readable" area under the barcode reader (1095). Final barcode inspection is performed by Controller to verify Item (1281) barcode information prior to proceeding with dispensing Item (1081) to a Customer via SUT (1248). If barcode information is incorrect, Controller will "mark" the Item (1281) as reject, and return the rejected Item to Provider. Return of the rejected Item can be configured as follows: notification is sent to Provider by Controller; respective carrier conveyor, under directions of Controller, will advance the conveyor to align the rejected item in position as indicated by Item (1280); Controller via barcode reader (1095) placed in position over the loading/unloading of Items (1280) on Provider side, will detect presence of the rejected item, and via diagnostics will inform Provider the rejected item is ready to be removed manually by Provider. When rejected item is removed, Controller will detect the respective change in weight of the PVC (1078), and verify via barcode scan device (1095) the rejected item was removed from carrier (1272), and mark the carrier as empty. In addition, rejected items can be returned back to Provider as described on FIG. 125, via "Return Gate" (1309) directing items back to Provider along the direction (1311) inside the "Return Tunnel" (1308).

1108—Scales installed inside AVM (1072) to measure and report to controller weight of each PVC (1078) installed inside. These scale are used by controller to verify the change in weight when an item is either added to a carrier inside or unloaded from the carrier inside, and is one of the quality verification process steps to ensure the dispensed items are within their respective specifications, including weight.

1188—Restraining brackets installed inside sliding tunnel (1248), which are configured to slow down the speed of falling dispensed items inside the tunnel (1248). The restraining brackets (1168) can be configured to be covered with soft "cushion" materials, to act as "shock absorbers".

1250—Direction of the motion of the tunnel (1248) toward the "idle" or "home" position, where it is completely disengaged from the carriers inside PVC units (1078) installed in the AVM (1072).

1307—Gate, which is operated by a drive mechanism, such as spring loaded solenoid (not shown). The Gate is shown in its "dispense" position, directing items coming down the SUT (1248) to a pick-up bin (not shown) on the Customer side. As needed, Controller in real-time will activate the drive mechanism to open the Gate (1307), so that unloaded items can be returned to Provider in direction (1311) along the Return Tunnel (1308). The control logic of the entire process is configured to DEFAULT (under loss of power, or a component failure) to the safest state, preventing dispensing of unverified items to Customer. Returned items to Provider can include rejected items, such as items failed inspections, including: barcode, weight, size, due date, etc. The size of the Item (such as container with prescription medication inside) can be verified by respective devices, such as optical reflection sensors, connected to Controller, and installed along the path of carriers, including final inspection points.

1312—Sensor, connected to Controller, and configured to measure and report dimensions of the item (such as container with prescription medication inside). Sensor can be configured as optical reflection sensor, and perform required measurements dynamically when an Item is passing by the sensor (1312), or statically when an item is aligned within the sensing area of the sensor (1312)

Slide-able Unloading Tunnel (1248), as shown, can be installed inside Automatic Vending Module (AVM). The tunnel (1248) can be configured to support unloading items out of multi-track PVC units (1078) installed inside AVM (1072). For example, for PVC (1078) with dual track carrier conveyor (1078), the Tunnel (1248) can be configured to unload both tracks at the same time. Unloading of each track can be supported by respective "Self-adjustable Plate" (1284) configured to engage with respective carriers inside of each conveyor track aligned for unloading. The tunnel (1248) can be driven by controller forward and back via drive component, such as: spring-loaded plunger of a solenoid, or a gear motor. The tunnel (1248) can be configured under direction by controller to the tunnel drive component, to slide inside the AVM toward the carrier assembly and engage with carriers aligned by controller for unloading items inside the carriers. In process of engaging, the tunnel components will force the carriers to swing back around their support shaft, and as result, will allow item inside the carrier, under its own weight, to slide out of the carrier into the opening inside the tunnel, and then proceed under controlled decent down to the bottom of the tunnel, where the item can be diverted to a pick up pocket or a bin. Tunnel components are configured to match the shape of the carriers (1272), to allow smooth engagement with the carriers selected by controller for unloading, while maintaining clearance from other carriers. As directed by controller, the tunnel (1248) will retract back in direction of (1250) to its original position, where it will maintain required clearance from carriers being indexed by conveyors inside PVC.

Figure 125:
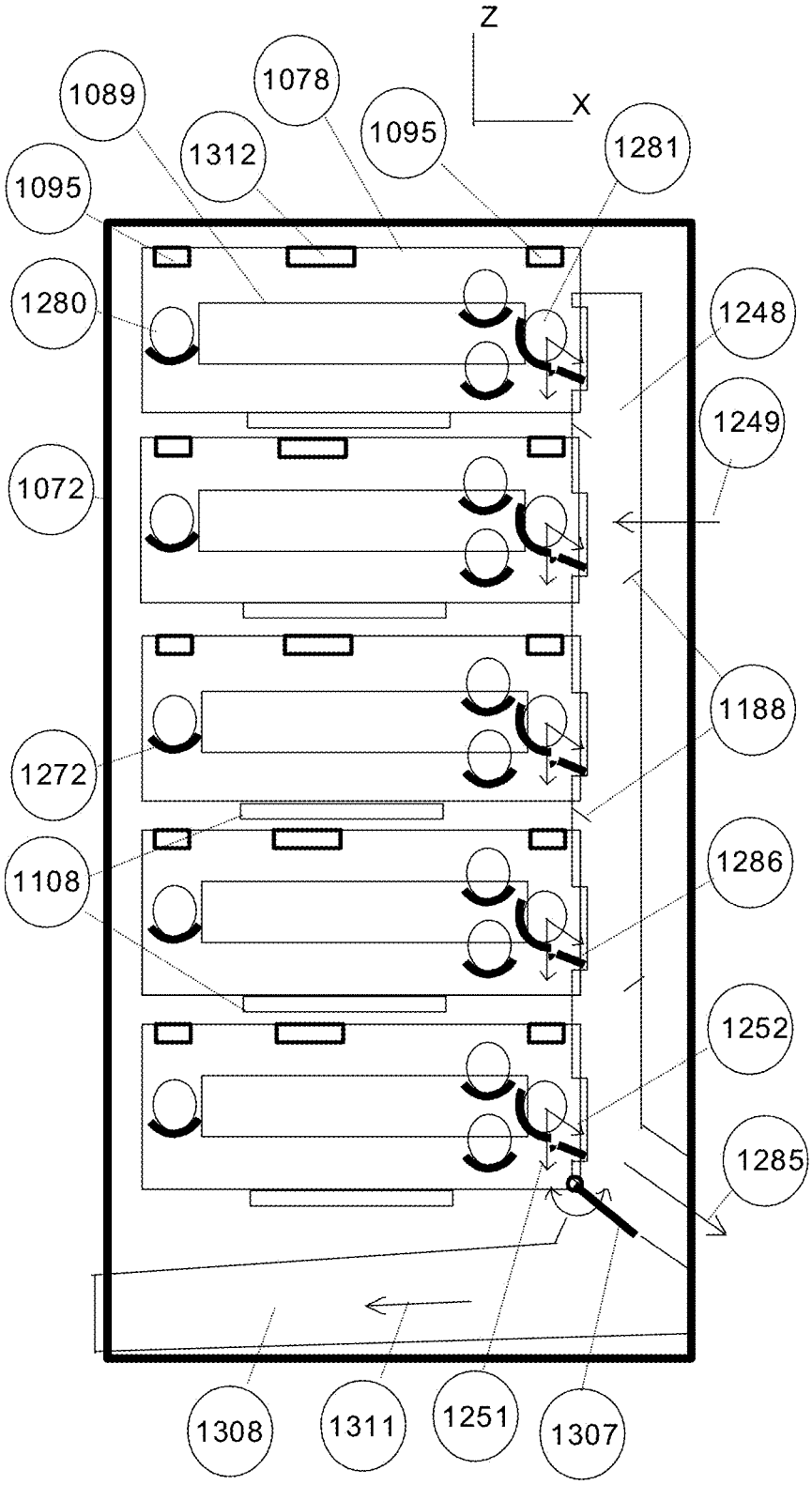

FIG. 125—Illustrates Automatic Vending Module (AVM) (1072) configured with 5 installed Portable Vending Cartridges (PVC) (1078), shown on FIG. 124, with a Slide-able Unloading Tunnel (SUT) (1248) installed on Provider side, and is directed by controller to advance in direction (1249) toward unloading position, and engage its "Self-adjusting Plates" (1286) with respective carriers (1272) aligned by Controller for dispensing the items (1281) they contain. As shown, when SUT (1248) is advancing along direction (1249) toward the PVC (1078), the "Self-adjusting Plates" (1286) will engage with the carrier (1272), and as result, the carrier (1272) will tilt back about the axis of the carrier support bearing (not shown). As the carrier (1272) is tilted further back, the item (1281) inside the carrier (1272) under its own weight as indicated by (1251) will begin moving out of the carrier (1272) in direction (1252) along the "Self-adjusting Plate" (1286) and enter the SUT (1248), and then continue to decent or fall down along the vertical section of the tunnel (1248). The speed of the item falling down will be restrained by the Restraining Brackets (1188). In this example, at least one carrier from each PVC is aligned for dispensing, which will result in simultaneous dispensing of at least 5 items on the Customer side. The "Self-adjusting Plates" shown on FIG. 124 in default position (1284) can be configured to have a spring retract or tilt mechanism, allowing the "Self-adjusting Plate" (1284) to float or adjust enough, as indicated by position (1286) as shown on FIG. 125, so that engagement with the carrier (1272) will be smooth. Specific configuration of "Self-adjusting Plate" (1284) is described on FIG. 127 through FIG. 129. The tunnel (1248) can be configured to comprise a number of different "Self-adjusting Plates" (1284), such as size, shape, in order to match configuration shape and size of the respective carriers each Plate (1284) is configured to engage with. As shown on FIG. 125, the carrier conveyor (1089) inside each PVC (1078) is configured to allow controller to align simultaneously a carrier (1272) with item (1281) inside on Customer side and loaded carrier (1272) with item (1280) inside, or just an empty carrier (1272) on the Provider side. As result, the system is configured for parallel processing of Items by Provider on one side and dispensing items to Customer on the opposite site. While items (1281) are being dispensed on Customer side, Provider, independently of Customer, can load or unload respective carriers presented by Controller on the Provider side. Remaining elements are labeled same as on FIG. 124.

Figure 126:
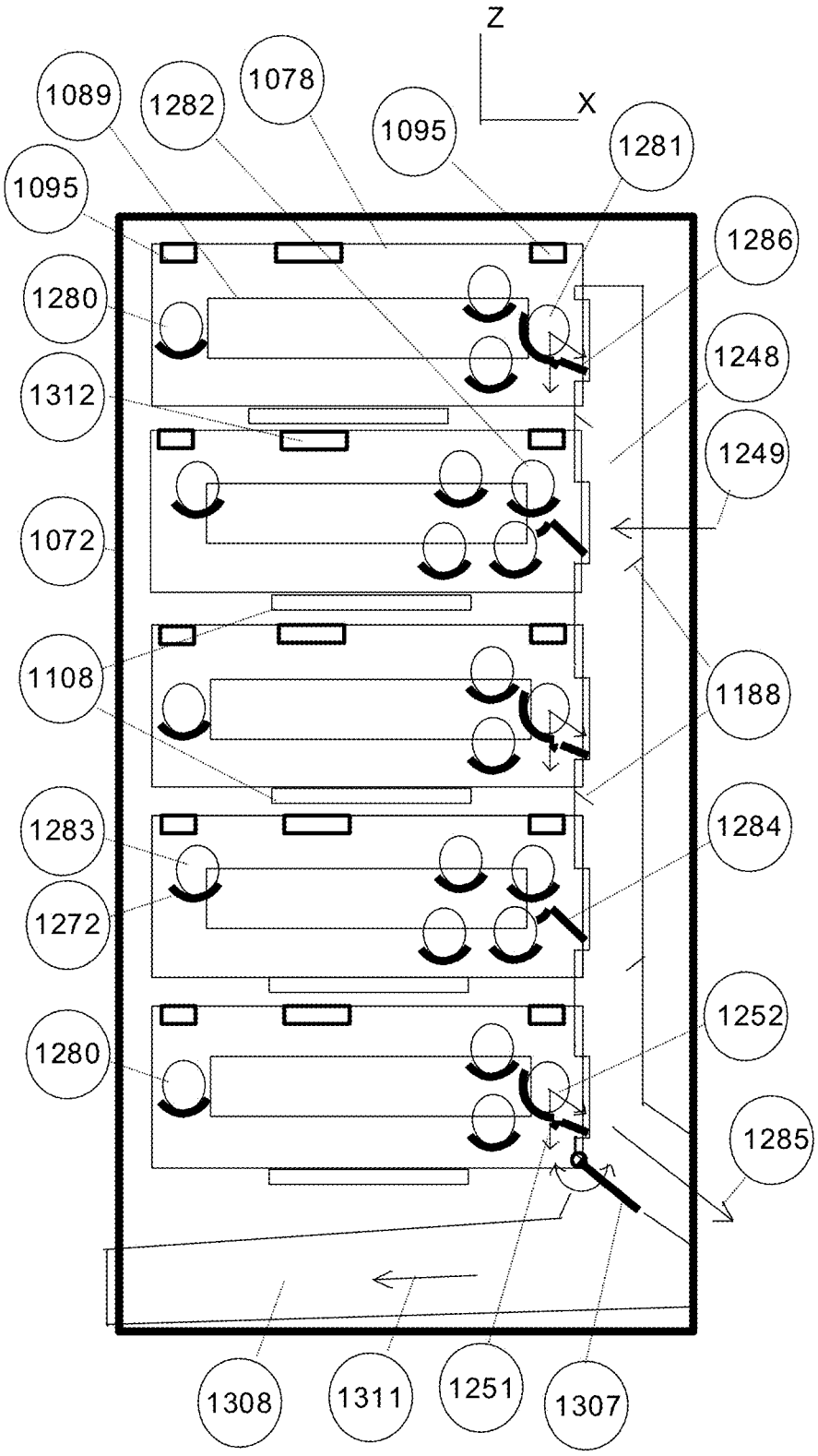

FIG. 126—Illustrates Automatic Vending Module (AVM) (1072) configured with 5 installed Portable Vending Cartridges (PVC) (1078), shown on FIG. 125, with variation where a selected number of carriers (1272) with items (1281) inside selected PVC units are aligned for unloading on Customer side, and respectively—selected number of carriers (1272) with items (1280) inside selected PVC units are aligned for loading/unloading on Provider side. At the same time, Controller will direct other conveyors inside their respective PVC, which are not selected for loading/unloading, as indicated by items (1283), to move carriers with items (1283) away from SUT (1248). Controller of each PVC will communicate in real-time with controller of the AVM (1072), and the entire process control sequences described on FIG. 125 and FIG. 126, will be executed by controllers in real-time, as defined by ADVSP configuration parameters. Depending on control algorithm and acceptance criteria included in the ADVSP configuration parameters, Controller, with or without operator assistance, can execute controls to achieve required criteria. Criteria can be preset by the Provider, and include: time sequences to attain required dispensing rates; optimization of power consumption, by starting each actuator or motor in sequence to avoid unnecessary peak power demands; lowering noise; lowering power dissipation; lowering vibrations. Criteria can also include continuous monitoring of specifications parameters of items inside AVM (1072), such as: ambient temperature and humidity surrounding items; items barcode label information, matching expected location of the item inside designated carrier with its own barcode label; weight of the item (such as container with prescription medication); size of the item; due date limitation for item to remain inside AVM. Controller based on algorithm can in real-time with or without operator assistance, execute controls to maintain items within ADVSP within respective specifications, including: environment, weight, size, due dates. Controller will in real-time execute process controls to: 1) Maintain all items inside AVM (1072) within respective specifications, and dispense to authorized Customer only items within quality specifications; 2) Promptly detect conditions outside specifications, and execute required process steps to remove rejected items from AVM (1072), and return rejected items back to Provider.

Figure 127:
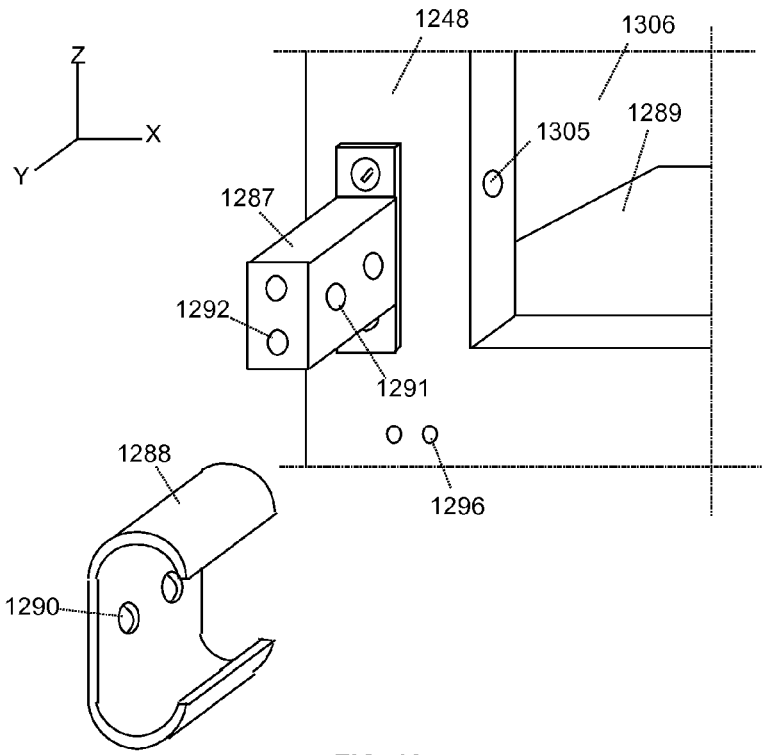

FIG. 127—Illustrates mounting components of the "Self-adjusting Plate" (1284), which are configured to attach the plate (1284) to Slide-able Unloading Tunnel (SUT) (1248). For simplicity only components for mounting (1284) from one side are shown. Figure elements are labeled as follows:

1287—Support bracket, attached to SUT (1248), and configured for mounting the "Y axis" Guiding Channel (1288) via mounting hardware, such as screws, installed via respective openings (1290) and (1291)

1289—Platform attached to SUT (1248) from the inside, configured to further guide the items entering the SUT (1248) through the opening (1306)

Figure 128:
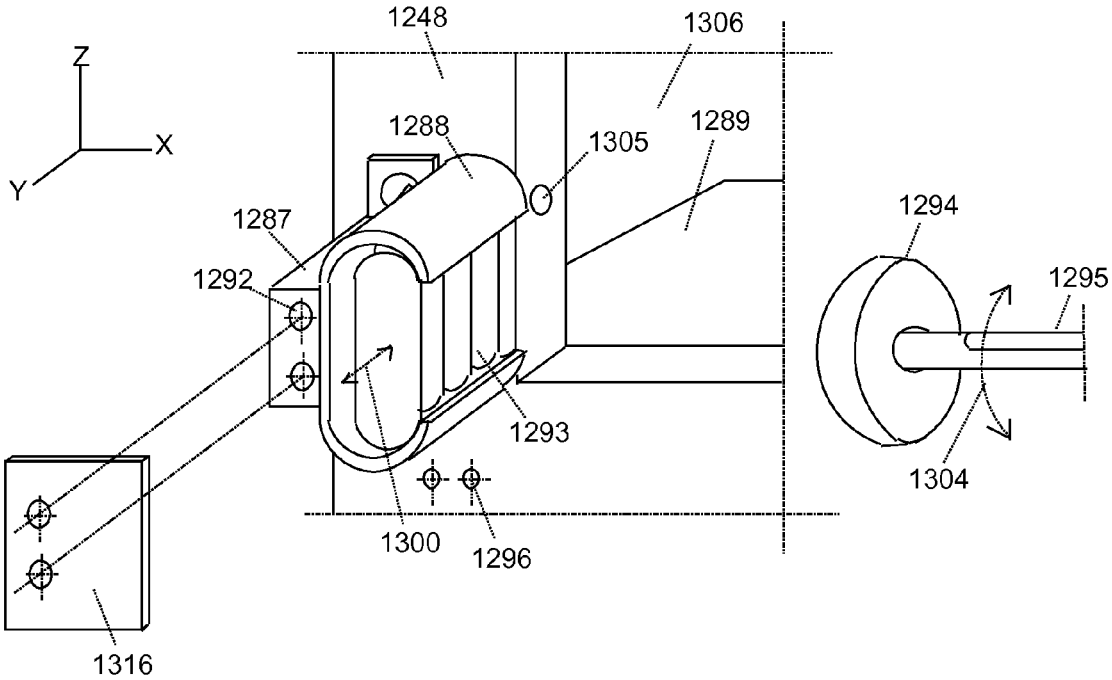

FIG. 128—Illustrates assembled mounting components of the "Self-adjusting Plate" (1284) configured to attach the plate (1284) from one side to the Slide-able Unloading Tunnel (SUT) (1248). The Roller with embedded bearing (1294) is configured to be inserted into "Y-axis" Guiding Channel (1288), and then retained inside (1288) by the Stop Plate (1316) attached to the Mounting Bracket (1287) via mounting holes (1292). The Spring (1293) inside the Guiding Channel (1288) is configured to apply force along the "Y-axis" to the Roller (1294), and keep the Roller against the Stop Plate (1316). The Shaft (1295) is configured to be inserted into the bearing of the Roller (1294), and serve as the mounting platform for the "Self-adjusting Plate" (1284), as shown on FIG. 129, and provide rotation of the Plate (1284) about the "X" axis of the bearing embedded into the Roller (1294). Remaining elements are labeled same as on FIG. 127.

Figure 129:
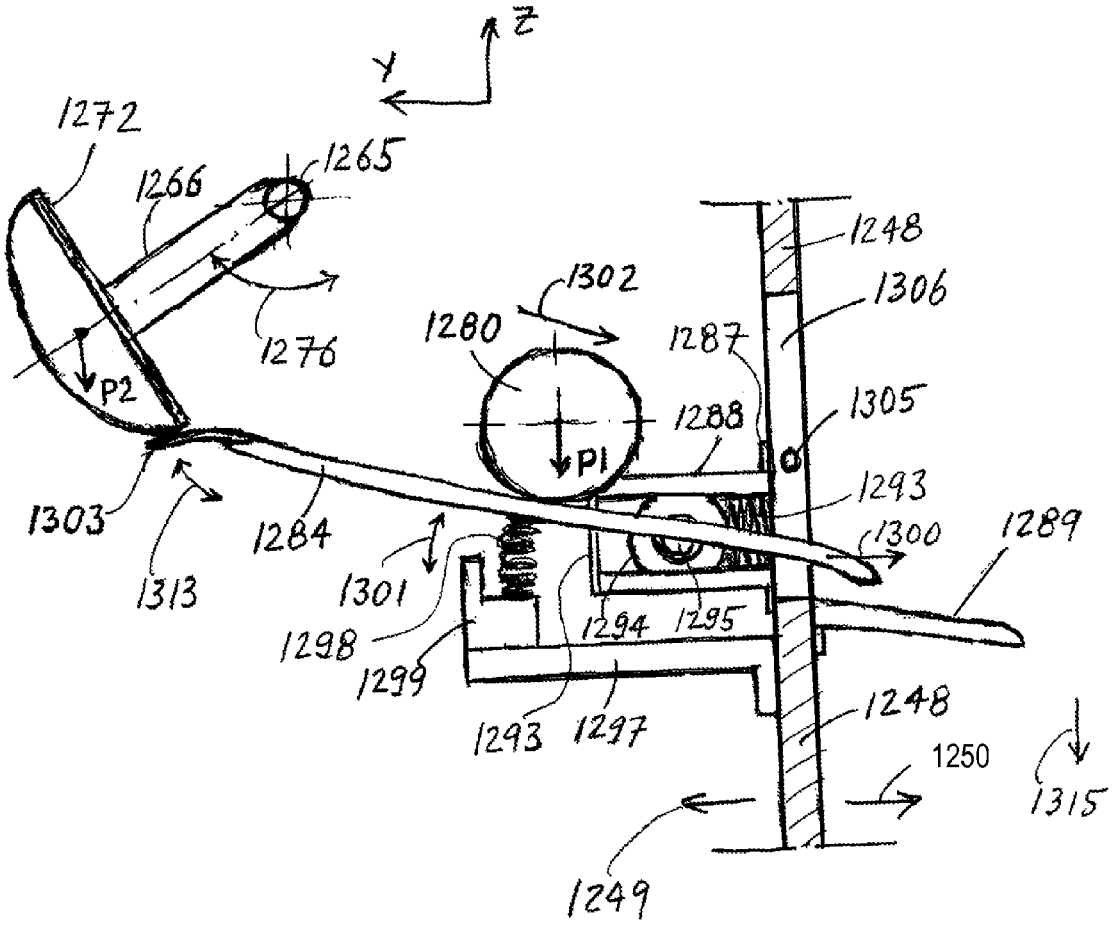

FIG. 129—Illustrates Z-Y view of assembled "Self-adjusting Plate" (1284), which together with SUT (1248) under direction by Controller, had advanced along (1249), and engaged its Tip (1303) with the Carrier assembly (1272). For simplicity, only limited number of components is shown, and the engagement point illustrated, represents the distance the SUT (1248) had to advance, to demonstrate the principal. As the SUT (1248), under direction of Controller, is advancing toward the Carrier (1272), the Tip (1303) of the Plate (1284) will begin engaging with the Carrier (1272) and force the Carrier (1272) to swing, as indicated by (1276), about the "X" axis of the Carrier (1272) support Shaft (1265). The Tip (1303) is configured from flexing materials, and will self-adjust its position in respect to Plate (1284) under resistance or reaction forces, resulting from the weight P2 of the Carrier (1272), and the Tip (1303) is further configured to provide reliable engagement with the Carrier (1272) at all times during the engagement. In addition, the section of the Carrier (1272) designated for engaging with (1303) can be configured to provide reliable engagement with the Tip (1303) at all times during the engagement. The support components, as described on FIG. 127 and FIG. 128, and as shown on FIG. 129—allow the Plate (1284) under reaction forces from the Carrier (1272) to retract back in direction as indicated by (1300) along the "Y-axis" as controlled by the Roller (1294) inside the "Y-axis" Channel (1288) and the Spring (1293), and also swing as indicated by (1301) about the "X-axis" of the support Shaft (1295) inserted into the bearing of the Roller (1294) under control of the Spring (1298), which is configured to minimize the friction and respective forces resulted from the engagement. As shown, the Carrier (1272) had tilted in direction (1276) about its support shaft (1265) around the "X-axis" far enough to allow the Item (1280), originally stored inside the Carrier (1272), under the influence of the Item (1280) weight "P1" to exit the Carrier (1272) and move, as indicated by (1302), along the Plate (1284) toward the opening (1306) in the SUT (1248). Item (1280) under its own weight "P1" will eventually enter the SUT (1248), which will be detected by Controller via Sensor (1305), and further slide down from Plate (1284) to the Platform (1289), and continue its decent down, eventually rolling off the Platform (1289) and falling down, as indicated by (1315), along the "Z-axis" inside SUT (1248) toward the Gate (1307), described on FIG. 126. After unloading of items is completed, Controller will direct the SUT (1248) to re-tract back in direction (1250) to its home position.

The invention claimed is:

1. An intelligent modular configurable apparatus comprising:

at least one configurable vending module, at least one configurable controller, at least one non-volatile memory, at least one configurable vending cartridge, number of configurable sensors, at least one configurable conveyor with carriers, at least one configurable unloading tunnel, at least one configurable user interface, at least one configurable operation parameter, at least one configurable item, configurable insulation materials, wherein the at least one configurable vending module is configured to accept the at least one configurable vending cartridge, and mechanical interface between the vending module and the vending cartridge is configurable to include slide-able inter-lockable guides and channels;

wherein the at least one configurable vending module is configured to accept the at least one configurable vending cartridge, and depending on configuration of the cartridge, the vending module is further configured to provide mechanical and electrical components for operation of the conveyor with carriers installed inside the vending cartridge;

wherein the at least one configurable vending module is configured to accept the at least one configurable vending cartridge, and depending on configuration of the cartridge, the vending module is further configured to provide mechanical and electrical components for manual or automatic loading of items into the carriers of the conveyor with carriers installed inside the vending cartridge;

wherein the at least one configurable vending module is configured to accept the at least one configurable vending cartridge, and depending on configuration of the vending cartridge, the vending module is further configured to provide mechanical and electrical components for manual or automatic unloading of items from the carriers of the conveyor with carriers installed inside the vending cartridge;

wherein the at least one configurable vending module is configured to comprise the at least one configurable user interface, and the user interface is further configured to enable an operator to perform operations including: loading of items into the vending module, unloading of items from the vending module, status verification of the vending module, process controls within the vending module;

wherein the at least one configurable item configuration includes medication, including prescription medication, and wherein the at least one configurable item configuration includes test samples obtained from a patient, including samples of: blood, urine, skin tissue;

wherein the at least one configurable item is configured to have an identification label, including barcode label, and the barcode label of the item will reference the item specification parameters, which are stored by at least one configurable controller in at least one non-volatile memory connected to the controller;

wherein the at least one configurable item configuration includes containers of different shapes to store a content, including medication;

wherein the at least one configurable controller is configured to interface with the at least one non-volatile memory, and the controller will in real-time use the non-volatile memory to access the apparatus configuration of the operation parameters, and based on the configuration of the operation parameters execute controls, including recording and maintaining in real-time information about the status of the apparatus, status of components within the apparatus, and status of the items within the apparatus;

wherein the at least one configurable controller is configured to be powered by external power source, including rechargeable battery, maintaining operation of the controller during a partial or complete power outage;

wherein the at least one configurable controller is installed inside the vending module, and is configured to interface with components installed inside the vending module, including: sensors of the vending module, motor drivers of the vending module, user interfaces of the vending module, other controllers of the vending module, and is further configured to interface with the controllers installed outside the vending module;

wherein the at least one configurable controller is installed inside the vending cartridge, and is configured to interface with components installed inside the vending cartridge, including: sensors of the vending cartridge, motor drivers of the vending cartridge, user interfaces of the vending cartridge, other controllers of the vending cartridge, and is further configured to interface with the controllers installed outside the vending cartridge;

wherein the at least one configurable controller is configured by an operator, or by another controller, and the at least one configurable controller configuration parameters including control algorithm are stored in the non-volatile memory;

wherein the at least one configurable operation parameters includes acceptable quality parameters of the items inside the apparatus, with the acceptable quality parameters defined as the item specification parameters, which include: expiration date of the item, ambient environment for the item, weight, size, access record, and the acceptable quality parameters of each of the item, or group of the items, is recorded by the at least one configurable controller in the non-volatile memory under reference identification attached to the item, which includes the barcode label;

wherein the at least one configurable controller connected to the sensors of the apparatus, will in real-time monitor and record in the non-volatile memory actual quality parameters of the items inside the apparatus, and the controller performing controls with or without operator assistance, maintaining the actual quality parameters of the items inside the apparatus within the acceptable quality parameters, and the controller will execute controls to ensure that only the items with the acceptable quality parameters are dispensed to authorized customers, while the items which do not, are removed from the apparatus and returned to provider;

wherein the at least one configurable operation parameters will be stored in the non-volatile memory;

wherein at least one configurable operation parameters will include acceptance criteria for identification of providers, and acceptance criteria for identification of customers;

wherein the at least one configurable operation parameters will include acceptance criteria for operation of components inside the apparatus, including: synchronization tolerances between position of moving components including the conveyors with carriers; dispensing rate requirements of the items to customers; power consumption limits; utilization criteria of resources within the apparatus; criteria of availability of the items, including medications, at specified locations and at required time intervals; transaction records in respect to the items;

wherein the at least one configurable controller is configured for real-time closed-loop control operation of the apparatus, and the controller with or without operator assistance, will monitor actual status of the at least one configurable operation parameter of the apparatus, and compare the actual status with the acceptance criteria configured for the at least one configurable operation parameter, and based on results of the comparison, the controller will execute real-time controls to sustain the actual status within the acceptance criteria;

wherein the least one configurable vending cartridge is configured to include the at least one configurable conveyor with carriers, and is further configured as a with single or multiple parallel indexing tracks supporting the carriers of the at least one configurable conveyor with carriers;

wherein the least one configurable vending cartridge is configured to be installed into the at least one configurable vending module, and the configuration of the vending cartridge and the configuration of the vending module includes guiding channels and slides to allow the vending cartridge to be slideably inserted into the vending module, and includes latching to secure the installed vending cartridge inside the vending module, and the configuration of the vending cartridge and the configuration of the vending module enables the at least one configurable controller to execute control algorithm, and the control algorithm will include the at least one configurable per respective configuration of the operation parameters for the vending cartridge and the at least one configurable configuration of the operation parameters for the vending module;

wherein the least one configurable vending cartridge is configured to function as a portable vending cartridge, which can be installed into a mating slot inside the at least one configurable vending module situated at one location, and the configuration of the portable vending cartridge supporting removal of the vending cartridge from the vending module at one location and transportation of the vending cartridge for installation into a mating slot of at the least one configurable vending module at a new location;

wherein the configurable sensors are configured to connect to the at least one configurable controller, and the sensors are further configured to report to the controller a specific measured result or event, including: barcode label information, position of the items including medications inside the apparatus, RFID when it is attached to the items and the components inside the apparatus, position and location of the components inside the apparatus, environment within various sections of the apparatus, the item weight, the item size;

wherein the configurable sensors are configured to report information to the at least one configurable controller, and the information including; identification parameters entered by provider, and identification parameters entered by customer;

wherein the configurable sensors are configured to report information to the at least one configurable controller, and the information including: location of the items, including medications, within the apparatus; the item entering the apparatus and the item exiting the apparatus; and the controller executing control algorithm to sustain the least one configurable operation parameters within the acceptance criteria of the least one configured operation parameters, including maintaining and controlling the item inventory within the apparatus at all times;

wherein the configurable sensors are configured to report information the at least one configurable controller, and the information including: change in weight of the vending module when the at least one configurable item, including medications, is added or removed from the vending module;

wherein the configurable insulation materials are configured for installation inside the apparatus, and the configuration providing insulation of the at least one configurable items, including medications, inside the apparatus, and assisting the least one configurable controller in maintaining environment surrounding the items within the acceptable criteria of the at least one configurable operation parameters;

wherein the configurable sensors are configured to be attached to a patient, and the sensors reporting information to the at least one configurable controller, and the information including: the patient temperature, the patient blood pressure;

wherein the at least one configurable vending module is configured to contain the at least one configurable vending cartridge with the at least one configurable conveyor with carriers inside the cartridges, and the carriers of the at least one configurable conveyor with carriers inside the vending cartridges is configured to contain the at least one configurable items including medications, and type of the medication and amount of the medication in each of the carriers is based on the at least one configurable operation parameter, which is configured for a patient by an authorized provider;

wherein the at least one configurable operation parameters includes an algorithm, which is defined for a patient by a provider including an authorized physician of the patient, and the physician defining the patient specific configuration of the operation parameters, and the algorithm including definition of criteria for providing specific dosages of medications to the patient as a function of status of the patient, and the criteria will include: measurements made by the at least one configurable controller of a current status of the patients, and the current status including running average of the specified measured operation parameters of the patient, history of the patient reactions to previously administered medications recorded by the controller in the non-volatile memory;

wherein the at least one configurable controller, based on a patient specific configuration of the at least one configurable operation parameters, will in real-time with or without operator assistance, execute the patient specific algorithm, which will include: scheduled reading of the sensors and recording of the patient status, performing predefined calculations including averaging, comparing calculated status of the patient to criteria defined by the patient specific algorithm, and based on the algorithm the controller will direct in real-time the at least one configurable vending module within the apparatus, which is assigned and located near the patient, to dispense specified amount of medication, and the controller via the at least one configurable user interface of the vending module—informing the patient or authorized operator that the medication were dispensed and are ready for being administered to the patient, and the user interface configured to register transactions in respect to the medications administered to the patient;

wherein the at least one configurable controller, based on the at least one configurable operation parameter of the apparatus will in real-time with or without operator assistance, execute a process specific algorithm, which will include controlling environment surrounding an item within the apparatus, including controlling environment surrounding the at least one configurable items located within the apparatus;

wherein the at least one configurable unloading tunnel is configured to include: at least one configurable guiding rail, at least one configurable self-adjustable plate, at least one opening for the at least one configurable item to enter the tunnel, at least one opening for the item inside the tunnel to exit the tunnel, a configurable gate, and the configurable sensors;

wherein the at least one configurable guiding rail is configured to create a path for advancing the unloading tunnel along the guiding rails back and forth in respect to position of the vending module;

wherein the at least one configurable self-adjustable plate is configured to self-adjust its position in respect to the unloading tunnel when an external force is applied to the plate;

wherein the at least one configurable unloading tunnel under directions of the at least one configurable controller will advance along the at least one configurable guiding rail back and forth;

wherein the at least one configurable unloading tunnel under directions of the at least one configurable controller will engage with at least one carrier of the conveyor with carriers, and force the carrier into a position at which the item inside the carrier will slide out of the carrier and enter the unloading tunnel;

wherein the at least one configurable unloading tunnel is configured for dispensing the at least one configurable item;

wherein the configurable sensors of the at least one configurable unloading tunnel are configured to connect to the at least one configurable controller and the sensors providing information to the controller, including: position of the unloading tunnel along the at least one configurable guiding rail, position of the gates inside the unloading tunnel, an event when the item entered the tunnel, an event when the item exited the tunnel, position of the item inside the tunnel;

wherein the configurable sensors of the at least one configurable unloading tunnel are configured to connect to the at least one configurable controller and the sensors providing information to the controller, including the at least one configurable operation parameters of the item inside the tunnel, and the parameters including: the item identification, the item weight, the item size, environment surrounding the item;

wherein the at least one configurable conveyor with carriers is configured to advance the carries, and is further configured to maintain the carriers in essentially vertical position;

wherein the at least one configurable conveyor with carriers is configured to accept the at least one configurable item into the carrier;

wherein the at least one configurable conveyor with carriers is configured to engage at least one of the carriers with the unloading tunnel resulting in unloading the item from the carrier into the unloading tunnel;

wherein the at least one configurable vending module is configured to engage with the at least one configurable unloading tunnel, resulting in the vending module unloading at least one of the items inside the module into the unloading tunnel.

2. The apparatus of claim 1 configured as a closed loop system, with the controller configured to execute a patient specific control algorithm, which is defined within the patient specific configuration of the operation parameters, and as instructed by the algorithm, with or without operator assistance, the controller in real-time executing controls, including dispensing of specified amount of verified quality of medications, and informing the operator or the patient via the user interface of availability of the dispensed medications and necessity for these medications to be administered to the patient, and request the operator or the patient to confirm to the controller that the medications were administered to the patient.

3. The apparatus of claim 1 configured as a closed loop system, with the controller configured to execute a pharmacy specific algorithm defined within the pharmacy specific configuration of the operation parameters, and as instructed by the algorithm, with or without operator assistance, the controller will perform controls in real-time, and the controls will include monitoring and directing activities within the apparatus, and the activities comprising of: processing of prescription medications at a remote centralized location, processing of prescription medications on-site at the pharmacy, distribution of the centrally processed medications inside the vending cartridges to locations associated with the pharmacy, directing which of the vending modules the cartridges should be inserted in, followed by dispensing of verified quality medications to authorized customers.

4. The apparatus of claim 1 configured as a closed loop system, with the controller configured to execute specific algorithm defined for a group of pharmacies, and as instructed by the algorithm, with or without operator assistance, the controller will perform controls in real-time, and the controls will include monitoring and directing activities within the apparatus, and the activities comprising of: processing of prescription medications at centralized locations, processing of prescription medications on-site at the pharmacies within the group of the pharmacies, and then distribution of the centrally processed medications inside the portable vending cartridges to locations associated with the group of the pharmacies, and then directing which of the pharmacies and which of the vending modules within the pharmacy the portable cartridges should be inserted in, followed by dispensing of verified quality of medications to authorized customers.

5. The apparatus of claim 1 configured to operate within a designated location or business, including: a stand-alone pharmacy, a pharmacy as part of a group of pharmacies, a stand-alone un-attended kiosk, a pharmacy designated for centralized processing of prescription medications with a follow-up distribution of the processed medications to the designated locations; and the apparatus is further configured to operate as a closed loop control system, executing algorithms defined by the apparatus configuration of the operation parameters, including processing and dispensing of verified quality of medications to authorized customers at all locations.

6. The apparatus of claim 1 configured to execute medication-specific process control algorithm defined by the medication configuration of the operation parameters, and which is applied to selected medications inside the apparatus, and the process control algorithm will change properties of the medications to match specifications defined by the medication configuration of the operation parameters.

7. The apparatus of claim 1 configured to execute test sample-specific process control algorithm defined by the test sample configuration of the operation parameters, and which is applied to selected test samples inside the apparatus, and the sample, including test samples obtained from a patient, including the samples of: blood, urine, skin tissue, and the process control algorithm will change properties of the test samples to match specifications defined by the sample configuration parameters.

8. The apparatus of claim 1 configured to verify quality of medications at the point of entry of the medications into the apparatus, and then the apparatus periodically verifying the quality of the medications within the apparatus, and the verification of the quality of the medications include verification of: barcode label on the container with the medication, weight of the container with the medication, size of the container with the medication, ambient environment surrounding the medication.

9. The apparatus of claim 1 configured to accept from a provider and then retain within the apparatus only quality medications verified by the apparatus, and then dispense the medications which failed the quality verification back to the provider.

10. The apparatus of claim 1 configured to verify a customer information, and establish if the customer is authorized to receive medications located within the apparatus.

11. The apparatus of claim 1 configured to inform an authorized customers of availability of verified quality medications, and of the location and identification of the dispensing module within the apparatus where the verified quality medications can be obtained from.

12. The apparatus of claim 1 configured to dispense to an authorized customer requested by the customer verified quality medications, and depending on number of and location of the requested medications within the apparatus, the apparatus dispensing the medications to the authorized customer simultaneously.

13. The apparatus of claim 1 configured to service at least one customer, and when several customers are present, depending on the number of the vending modules within the apparatus and the control algorithm of the apparatus, the apparatus will be further configured to maximize the use of the vending modules, providing simultaneous service to the customers, and the service accomplished with or without operator assistance.

14. The apparatus of claim 1 configured to service at least one authorized customer, and when several authorized customers are present, depending on: the number of the vending modules within the apparatus, the control algorithm of the apparatus, and the inventory of the medications within the apparatus, the apparatus will be further configured to maximize the use of the vending modules, providing simultaneous service to the authorized customers, and the service accomplished with or without operator assistance.

15. The apparatus of claim 1 configured to service at least one customer without operator assistance.

16. The apparatus of claim 1 configured for operation indoors, or outdoors, with the configuration of the apparatus for outdoors supporting service of a customer standing in-front of the apparatus, or a customer remaining inside a vehicle.

17. The apparatus of claim 1 configured for conducting periodic self-diagnostics, and the self-diagnostics of the apparatus to include: availability of resources within the apparatus, operational status of the resources within the apparatus, environmental parameters within the apparatus, and the apparatus informing the provider of the results of the self-diagnostics, including requests for preventive maintenance.

18. The apparatus of claim 1 configured for monitoring inventory of medications present within the apparatus, and the report of conducted inventory of the medications to include: location of the medications within the apparatus, and status of the medications.

* * * * *